US007999720B2

(12) United States Patent
Jung et al.

(10) Patent No.: US 7,999,720 B2
(45) Date of Patent: Aug. 16, 2011

(54) CAMOUFLAGE POSITIONAL ELEMENTS

(75) Inventors: Edward K. Y. Jung, Bellevue, WA (US); Royce A. Levien, Lexington, MA (US); Robert W. Lord, Seattle, WA (US); Mark A. Malamud, Seattle, WA (US); John D. Rinaldo, Jr., Bellevue, WA (US)

(73) Assignee: The Invention Science Fund I, LLC, Bellevue, WA (US)

( * ) Notice: Subject to any disclaimer, the term of this patent is extended or adjusted under 35 U.S.C. 154(b) by 1163 days.

(21) Appl. No.: 11/352,835

(22) Filed: Feb. 13, 2006

(65) Prior Publication Data

US 2007/0190368 A1 Aug. 16, 2007

(51) Int. Cl.

| | |
|---|---|
| ***H01Q 17/00*** | (2006.01) |
| ***H01Q 15/00*** | (2006.01) |
| ***F41H 3/00*** | (2006.01) |
| *G01S 13/00* | (2006.01) |

(52) U.S. Cl. ..... 342/3; 342/1; 342/5; 342/12; 342/13; 89/1.11

(58) Field of Classification Search ..... 342/1–20, 342/175; 89/1.11, 36.01, 938; 2/69, 93, 2/94; 428/98, 141, 195.1, 196, 197, 544, 428/577, 583, 919

See application file for complete search history.

(56) References Cited

U.S. PATENT DOCUMENTS 1,434,167 A * 10/1922 Thorner ..... 342/3
1,817,871 A * 8/1931 Brandt ..... 89/36.01
2,278,898 A * 4/1942 Schofield ..... 428/583
2,351,142 A * 6/1944 Meldon ..... 428/141
2,436,578 A * 2/1948 Korn, et al. ..... 342/2
2,744,348 A * 5/1956 Smith ..... 2/94
3,068,472 A * 12/1962 Dell Aria ..... 342/13
3,119,729 A * 1/1964 Ljungbo ..... 428/196
3,150,848 A * 9/1964 Lager ..... 342/13
3,187,331 A * 6/1965 Beller ..... 342/3
3,233,238 A * 2/1966 Barker ..... 342/2
3,315,259 A * 4/1967 Ludwig ..... 342/3
3,339,201 A * 8/1967 Fischer et al. ..... 342/14
3,349,397 A * 10/1967 Rosenthal ..... 342/3

(Continued)

OTHER PUBLICATIONS

Berkely Webs: Wireless Embedded Systems, "Building Sensor Networks with TinyOS" May 5, 2003 Mobisys Tutorial, San Francisco Powerpoint Presentation, Culler, David; Levis, Phil; Szewczyk, Rob; Polastre, Joe; pp. 1-41, printed on Apr. 15, 2004.

Berkeley Webs: Wireless Embedded Systems, "Publications", p. 1-3, printed on Apr. 12, 2004.

Buonadonna, Phillip; Hill, Jason; Culler, David; "Active Message Communication for Tiny Networked Sensors," pp. 1-11, printed on Mar. 8, 2004.

(Continued)

*Primary Examiner* — Bernarr E Gregory

(57) ABSTRACT

One aspect relates to camouflaging an object by affecting a presentation at least partially using at least one positional element based at least in part on a position of the at least one positional element. Another aspect relates to configuring at least a first camouflage positional element and at least a second camouflage positional element to act as a decoy presentation, an active chaff, and/or a smart chaff. Another aspect relates to providing at least one positional element that can deceive, confuse, defeat, or lead one or more sensors towards or away from a target, such as to act as chaff, one or more flares, fog, one or more decoys, or a combination thereof. Another aspect relates to determining a suitable camouflage for at least one camouflage positional element at least partially considering a background for the at least one camouflage positional element, and affecting a presentation using the at least one camouflage positional element at least partially based on the suitable camouflage.

48 Claims, 17 Drawing Sheets

U.S. PATENT DOCUMENTS

| | | | | |
|---|---|---|---|---|
| 3,401,074 | A * | 9/1968 | Takenouchi | 428/919 |
| 3,427,619 | A * | 2/1969 | Beck et al. | 342/3 |
| 3,992,628 | A * | 11/1976 | Karney | 89/1.11 |
| 4,030,098 | A * | 6/1977 | Nahmias | 342/2 |
| 4,345,254 | A * | 8/1982 | Skomal | 342/5 |
| 4,419,669 | A * | 12/1983 | Slager et al. | 342/6 |
| 4,473,826 | A * | 9/1984 | Pusch et al. | 342/5 |
| 4,716,417 | A * | 12/1987 | Grumet | 342/2 |
| 4,888,590 | A * | 12/1989 | Chase | 342/3 |
| 4,928,130 | A * | 5/1990 | Pfabe et al. | 342/9 |
| 5,014,070 | A * | 5/1991 | Stock et al. | 342/3 |
| 5,077,556 | A * | 12/1991 | Aisslinger | 342/3 |
| 5,214,432 | A * | 5/1993 | Kasevich et al. | 342/3 |
| 5,650,800 | A | 7/1997 | Benson | |
| 6,208,247 | B1 | 3/2001 | Agre et al. | |
| 6,735,630 | B1 | 5/2004 | Gelvin et al. | |
| 6,816,862 | B2 | 11/2004 | Mulgund et al. | |
| 2002/0040639 | A1 | 4/2002 | Duddleson et al. | |
| 2003/0172221 | A1 | 9/2003 | McNeil | |
| 2003/0236866 | A1 | 12/2003 | Light | |
| 2004/0005889 | A1 | 1/2004 | Nishimura et al. | |

OTHER PUBLICATIONS

Center for the Built Environment, "XYZ on a Chip: Integrated Wireless Sensor Networks for the Control of the Indoor Environment in Buildings" pp. 1-2, bearing a date of 2002, printed on Jan. 27, 2004.

Citris, "The Real World as One Giant Database" pp. 1-3, bearing a date of 2003, printed on Apr. 9, 2004.

Gay, David; Levis, Phil; Von Behren, Robert; Welsh, Matt; Brewer, Eric; and Culler, David, "The nesCLanguage: A Holistic Approach to Network Embedded Systems," pp. 1-10; Intel Research Berkeley, The Intel Corporation, Nov. 2002.

Gelsinger, Pat; Intel.com, "Expanding Moore's Law with Convergance" pp. 1-4, printed on Apr. 9, 2004.

Gibson, William; "U2's City of Blinding Lights"; Wired Magazine 13.08; pp. 1-7; The Condé Nast Publications Inc. and Lycos, Inc.; bearing copyright dates of 1993-2005 and 2005, printed on Nov. 29, 2005.

Grabowski, Bob; Navarro-Serment, Luis; Bererton, Curt; "Localization—Millibots"; Carnegie Mellon University.

Hill, Jason; Szewczyk, Robert; Woo, Alec; Hollar, Seth; Culler, David; Pister, Kristofer, "System Architecture Directions for Networked Sensors," ASPLOS 2000, Cambridge, Nov. 2000.

Intel.Com, "Exploratory Research Deep Networking" pp. 1-10, printed on Mar. 25, 2004.

Intel.com; "Intel Research Seattle Handheld RFID Reader and Glove"; pp. 1-4; printed on Aug. 18, 2005.

ISIS Nest: Institute For Software Integrated Systems; "People; The NEST Group", pp. 1 of 1, printed on Apr. 14, 2004.

Jenkins, Chad; "Actuated Sensor Networks"; Brown Computer Science WiCS Lunch; Nov. 3, 2004; Brown University.

Jiang, Xiaofan; Polastre, Joseph; Culler, David; "Perpetual Environmentally Powered Sensor Networks"; pp. 1-6; University of California, Berekely Computer Science Department, Berkeley, CA 94720.

Johnson, R. Colin, "Companies test prototype wireless-sensor nets" EE Times, pp. 1-3, printable version of article, bearing a date of Jan. 29, 2003, printed Jan. 27, 2004.

Kahn, Kevin C.; Culler, David E.; "Ad Hoc Sensor Networks A New Frontier for Computing Applications" bearing a date of Apr. 2002, printed on Apr. 9, 2004.

Kling, Ralph, "Intel® Research Mote" pp. 1-13, Powerpoint Presentation, Intel Corporation Research, Santa Clara, CA, printed on Apr. 13, 2004.

Levis, Philip; Culler, David; "Maté: A Tiny Virtual Machine for Sensor Networks", pp. 1-11, printed on Apr. 12, 2004.

Levis, Philip; Madden, Sam; Gay, David; Polastre, Joseph; Szewczyk, Robert; Woo, Alec; Brewer, Eric; Culler, David; "The Emergence of Networking Abstraction and Techniques in TinyOS" pp. 1-14, printed on Apr. 13, 2003.

Levis, Philip; Patel, Neil; Culler, David; Shenker, Scott; "Trickle: A Self-Regulating Algorithm for Code Propagation and Maintenance in Wireless Sensor Networks", printed on Apr. 13, 2004.

Levis, Philip, "Viral Code Propagation in Wireless Sensor Networks," EECS Department, University of California at Berkeley, printed on Mar. 8, 2004.

Liscano, Ramiro, "Service Discovery in Sensor Networks: An Overview" Powerpoint Presentation; pp. 1-51; School of Information Technology and Engineering, University of Ottawa, Ottawa, Canada, bearing a date of 2003, printed on Mar. 8, 2004.

"Localization Distributed Embedded Systems" UCLA Computer Science 213: Localization Systems Powerpoint Presentation, pp. 1-61, bearing a course name of: CS 213/Estrin/Winter 2003, bearing a speaker name of: Lewis Girod, bearing a date of Feb. 4, 2003, printed on Mar. 15, 2004.

Lorincz, Konrad; Welsh, Matt; "MoteTrack: A Robust, Decentralized Approach to RF-Based Location Tracking"; Harvard University Division of Engineering and Applied Sciences, Cambridge, MA, USA.

Madden, Samuel, "Acquisitional Query Processing in TinyDB" Powerpoint Presentation, pp. 1-51; NEST Winter Retreat 2003, printed on Mar. 8, 2004.

Madden, Samuel, "Challenges in Sensor Network Query Processing" Powerpoint Presentation at the Jan. 15, 2002 NEST Retreat, printed on Mar. 8, 2004.

Madden, Samuel; Szewczyk, R.; Franklin, Michael; and Culler, David "Supporting Aggregate Queries Over Ad-Hoc Wireless Sensor Networks," pp. 1-10, printed on Mar. 8, 2004.

Madden, Samuel; Szewczyk, R.; Franklin, Michael; Culler, David "Supporting Aggregate Queries Over Ad-Hoc Wireless Sensor Networks" Powerpoint Presentation, pp. 1-47, 4th IEEE Workshop on Mobile Computing, dated Jun. 21, 2002.

Madden, Samuel; Franklin, Michael J.; Hellerstein, Joseph; M., and Hong, Wei, "The Design of an Acquisitional Query Processor for Sensor Networks," pp. 1-14, SIGMOD, Jun. 2003.

Marks, Paul; "Living Camera Uses Bacteria to Capture Image"; NewScientist.com; pp. 1-2; bearing a date of Nov. 23, 2005, printed on Nov. 29, 2005.

Niculescu, Dragos; Nath, Badri; "Ad Hoc Positioning System (APS) Using AOA"; Dataman Lab Rutgers University; IEEE Infocom 2003.

Raghunathan, Vijay; Kansal, Aman; Hsu, Jason; Friedman, Jonathan; Srivastava, Mani; "Design Considerations for Solar Energy Harvesting Wireless Embedded Systems"; pp. 1-6; Networked and Embedded Systems Lab (NESL), Department of Electrical Engineering, University of California, Los Angeles, CA 90095.

Raghunathan, Vijay; Schurgers, Curt; Park, Sung; Srivastava, Mani B.; "Energy Aware Wireless Sensor Networks" pp. 1-17; Department of Electrical Engineering, University of California, Los Angeles; printed on Mar. 15, 2004.

Roundy, Shad; Steingart, Dan; Frechette, Luc; Wright, Paul; Rabaey, Jan; "Power Sources for Wireless Sensor Networks"; pp. 1-24.

Ryer, Alex; *Light Measurement Handbook*, http://www.intl-light.com/handbook; pp. 1-64, copyright 1997, printed on Mar. 8, 2004.

Searchnetworking.com Definitions, "Jini" pp. 1-3, bearing a date of Apr. 10, 2003, printed on Mar. 8, 2004.

Spyropoulos, Akis; Raghavendra, C.S., "Energy Efficient Communications in Ad Hoc Networks Using Directional Antennas," Dept. of Electrical Engineering-Systems, University of Southern California, bearing a date of 2002, printed on Feb. 23, 2004.

Steingart, Dan; "Micro Power Systems Overview"; pp. 1-24.

Viswanath, Kumar, "Adaptive, Integrated Multicast Routing for Group Communications in Ad-Hoc Networks" Powerpoint Presentation, pp. 1-12; Computer Engineering Department, University of California, Santa Cruz, printed on Mar. 8, 2004.

Whitehouse, Kamin; Jiang, Xiaofan; "Calamari: a sensor field localization system"; University of California at Berkeley.

Woo, Alec; Tong, Terence; and Culler, David, "Taming the Underlying Challenges of Reliable Multihop Routing in Sensor Networks,"pp. 1-14, SenSys '03, Nov. 5-7, 2003, Los Angeles, California, USA.

Zapisek, John; "Energy-Efficient Methods for Wireless Sensor Networks"; pp. 1-17; bearing a date of Spring 2004; printed on Aug. 18, 2005.

Zhao, Feng; Guibas, Leonidas J.; *Wireless Sensor Networks: An Information Processing Approach*. San Francisco: Morgan Kaufmann Publishers-Elsevier Inc., bearing a copyright date of 2004.

* cited by examiner

CAMOUFLAGE POSITIONAL ELEMENTS

SUMMARY

In certain aspects, a method can include, but is not limited to, camouflage including at least one camouflage positional element(s). In addition to the foregoing, other method aspects are described in the claims, drawings, and text forming a part of the present application.

The foregoing is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

FIG. 6, which includes

FIG. 17, that includes

DETAILED DESCRIPTION

Figure 1A:
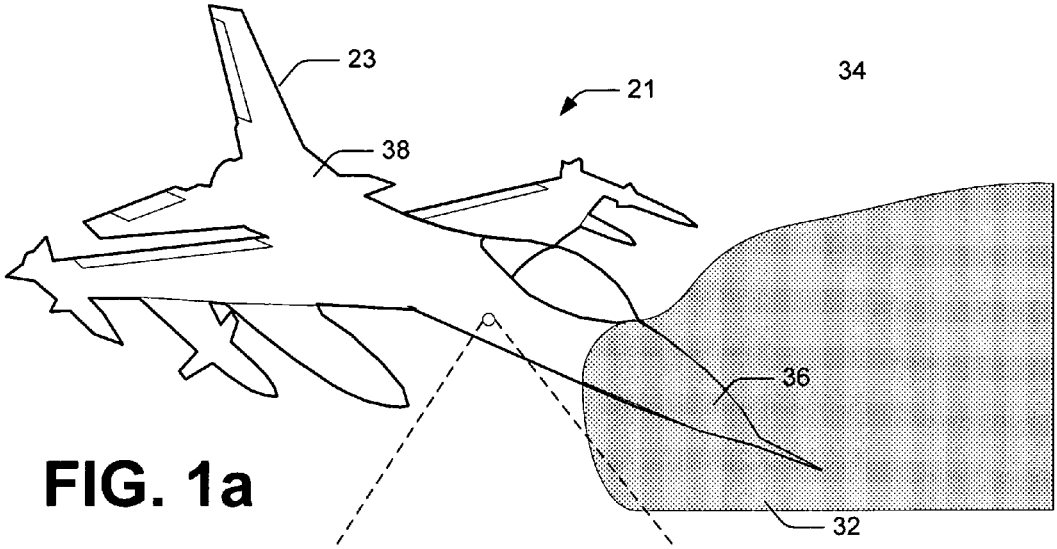
FIG. 1*a* is a diagram of one embodiment of a camouflage including at least one camouflage positional element.

This disclosure relates, in general, to camouflage.

In the following detailed description, reference is made to the accompanying drawings, which form a part thereof. In the drawings, similar symbols typically identify similar components, unless the context dictates otherwise. The illustrative embodiments described in the detailed description, drawings, and claims are not intended to be limiting in scope. Other embodiments may be utilized, and other changes may be made, without departing from the spirit or scope of the subject matter presented here.

The disclosure includes a number of formal outline headings and different embodiments for clarity of presentation. However, the outline headings and the different embodiments are for presentation purposes, and different types of subject matter may be discussed throughout the different portions of the disclosure. For example, device(s)/structure(s) may be described under process(es)/operations heading(s) portions of this disclosure, and/or vice versa. Also, descriptions of single topics may span two or more topic headings. Hence, the use of the formal outline headings and the different embodiments are intended to be illustrative in nature and not in any way limiting in scope. The numbering of the various elements in the disclosure is intended to improve readability and understandability of the disclosure with respect to the drawing, and is not intended to be limiting in scope.

I. Examples of Uses of Camouflage Positional Elements

Certain embodiments of this disclosure relate to a variety of embodiments of a camouflage 21 that can include at least one camouflage positional element(s) 11.

Certain embodiments of the at least one camouflage positional element(s) can be configured to communicate among each other and/or with other devices, utilizing networking techniques such as those known to those skilled with network technologies. This disclosure describes presenting a variety of camouflage affects, which can include but are not limited to hiding a target or object 23 that is present, or alternately acting as a decoy by making the object 23 appear which is actuality not there, e.g., to confuse a weapon such as a missile, or a detector directed at a target to follow a false target. Within this disclosure, the target or object can relate to or include a wide range of underwater, surface, airborne, land-based, and spaceborne vehicles, structures, and/or conveyances.

A number of embodiments of the camouflage 21 are now described with respect to certain ones of the figures. Within this disclosure, the terms "target" and/or "object" 23 can indicate, depending on context, the object 23 such as a vehicle that is being camouflaged at least partially using the one or more camouflage positional element(s). Within this disclosure, the terms "target" and "object" may be used interchangeably, depending upon context.

Within the disclosure, the term "camouflage" can have a variety of meanings depending upon the context. Certain embodiments of the camouflage 21 can include the at least one camouflage positional element(s) 11 that can be configurable to hide or conceal at least part of the existing target or object 23. Certain other embodiments of the camouflage 21 can be used to make one or more targets or objects 23 appear which in actuality are not present. For example, certain embodiments of the camouflage 21 including one or more camouflage positional element(s) can produce light, generate heat, provide, reflect, or absorb other electromagnetic radiation, vibrations, chemical traces, acoustic signals and/or signals, etc. As such, certain embodiments of the camouflage 21 could be configured to act as an "active" or "smart" version of chaff, which could thereby utilize some active of the chaff (e.g., actively and/or controllably emit, reflect, or absorb electromagnetic radiation, vibrations, chemical traces, and/or acoustic signals) to confuse humans, machines, weapons systems, etc. that are seeking the target or heat generated by the aircraft. Certain embodiments of the camouflage 21 to be configured to modify or alter how a target or object 23 appears.

Transmission, reflectance, and/or absorbance of electromagnetic radiation, vibrations, chemical traces, or acoustics from particular normally-operating targets or objects, for example, could vary based on the angle of target or object to the sensor or user. Within this disclosure, certain embodiments of "sensors" could include sight of a human or animal. Less heat, for example, is produced by a jet aircraft viewed from the front as compared to the back. Certain embodiments of this disclosure describes how to mimic or modify signatures (e.g., visible light, heat, reflectance, absorbance) or produced by the target or object, and thereby camouflage the target or object. For example, an electromagnetic radiation signature, vibration or acoustic signature, chemical traces, heat signature, reflective signature, and/or absorbance signature of a military aircraft may appear as a civilian aircraft or a flock of birds; an armed aircraft may appear to mimic an armed aircraft by modification of the emitted signature from the target or object, a group of land vehicles may appear where none exist, or a group of ships may be hidden, etc.

To effectively mimic a target or object, the presentation affected and/or modified by the camouflage positional element(s) 11 should appear similar to the signals, heat, electromagnetic radiation, vibrational signature, chemical traces, acoustic signature, or other signature caused during operation or rest of the object or target. Such mimicking can utilize emissive, reflectance, and/or absorption techniques by the camouflage positional element(s). Such mimicking should affect the appearance of directed or guided motion of a conformation of the target or object. For instance, is the target or object flying or falling? A network or a number of camouflage positional element(s) could be operated in a manner to provide the illusion of one, or a number of, targets or objects during particular operations such as aircraft flying, landing, etc.

Figure 1B:
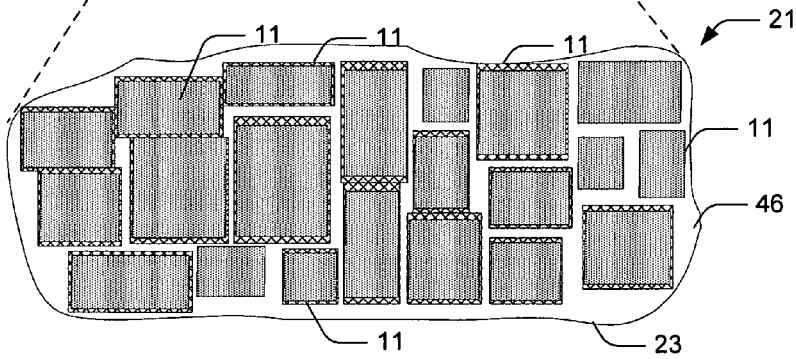
FIG. 1*b* is an expanded view of a portion of the camouflage of FIG. 1*a* including the at least one camouflage positional element(s)

Certain embodiments of the camouflage 21, as described with respect to FIGS. 1*a* and 1*b*, can include the at least one camouflage positional element(s) 11 that can be attached to a vehicle, such as an aircraft. The at least one camouflage positional element(s) can be utilized to affect and/or modify optical characteristics, heat characteristics, electromagnetic radiation characteristics, vibration characteristics, chemical traces, acoustic characteristics, reflectance characteristics, absorbance characteristics, and/or other parameters associated with the target or object 23 (such that the color, light intensity, reflectance, absorbance, or other characteristics) such as an aircraft, automobile, truck, tank, ship, vehicle, building, equipment, etc. FIG. 1*a*, for example, illustrates the target or object 23 that can be protected by the camouflage 21 can be hidden or concealed, modified, and/or mimicked or falsely generated in a controllable manner. One or more camouflage positional element(s) can mimic a large number of aircraft on the ground such that potential attackers would not be certain whether a detected or sensed object is a real object or a mimicked object. Similarly, the mimicked or decoyed object could be configured to appear to move such that a number of "mimicked" or "decoyed" or false aircraft could take off or land at an airport (or false trains or trucks could operate). Other suitable motion (or lack thereof) can be provided for the type of target or object that is being mimicked. FIG. 1*b* shows an expanded view of a portion of the object 23 that can include the camouflage 21. In certain embodiments, the camouflage 21 can include the at least one camouflage positional element(s) 11.

In certain embodiments as described with respect to FIGS. 1*a* and 1*b*, the at least one camouflage positional element(s) 11 to be secured to the target or object 23 by being adhered, secured, fastened, mechanically attached, embedded within (e.g., the object 23 may be at least partially formed from a composite in which the at least one camouflage positional element(s) are embedded), and/or otherwise attached with respect to the object. Certain embodiments of the target or object 23 such as vehicles may be configured such that the camouflage positional element(s) are secured with respect thereto.

In certain embodiments, the at least one camouflage positional element(s) 11 can change color, intensity, or other optical characteristics (e.g., either individually and/or in a group) at least partially based on the appearance or other condition of the background. In certain embodiments, the background can be considered relative to the environment, ambient condition, etc. of the target or object. For example, consider that a portion 36 of the target or object 23 (e.g., the aircraft) of FIG. 1*a* moves across or in front of at least one background feature 32, such as a cloud or ground portion, while another portion 38 of the object 23 moves in front of another background feature 34. As such, the portion 36 of the object 23 could be provided with the different color, intensity, texture, and/or other optical characteristics than the portion 38, and thereby affect the camouflage presentation. In certain embodiments, the ambient condition could include such parameters as, for example, temperature, pressure, humidity, etc. Different embodiments of the camouflage positional element(s) can utilize a variety of emissive, reflective, and/or absorbing techniques to affect the camouflage presentation.

Certain embodiments of the target or object can be viewed from a variety of different vantage points. As such, it may be desired to allow the target or object to affect the variable presentations (optical, electromagnetic, acoustic, vibrational, chemical traces, absorptive, biological, reflective, etc.) depending upon varying vantage points of the observers or detectors and/or varying backgrounds to the target or object. For instance, a particular target or object such as a tank may appear in front of a background of a first color (e.g., green) when viewed from ahead of the tank on one side, but may appear in front of a background of a second color (e.g., brown) when viewed from another angle of the tank on the same side. As such, it may be desired to affect the presentation that is generally green to those sensing or detectors that are positioned ahead of the tank, and affect the presentation is generally brown to those sensing or detectors that are positioned behind the tank.

To affect different presentations to different angles with respect to the object or target can be performed optically using a segmented version of the at least one camouflage positional element. For example, the segmented version of the at least one camouflage positional element can display different colors at relative locations. In certain embodiments, the at least one camouflage positional element can be configured using a distinct light source, a distinct light filter, segmented such as to provide different colors, light intensities, absorbencies, or reflectivities at different relative positions, and thereby can be at different angles with respect to the target or object. When electromagnetic radiation, vibrations, chemical traces, or acoustics is being used for camouflaging, such as creating, modifying, hiding, transforming, and/or otherwise processing the electromagnetic radiation, then a beam-former or other similarly known electromagnetic device can be used to shape, form, process, and/or transform the electromagnetic radiation at different angles with respect to the target or object. Similar mechanisms may be utilized to modify heat, absorption, and/or reflective characteristics of the at least one camouflage positional element(s) 11 depending upon the angle of tractor or sensor with respect to the target or object.

Consider, for example, that an aircraft would likely have a considerably different heat signature or other signature from behind as compared to in front. As such, if it is desired to mimic a target such as an aircraft, it also may be desirable to alter pertinent signatures at different angles with respect to the target or object.

In certain embodiments, to provide effective camouflage for certain embodiments of the target or object 23, a relative position of the object should be considered relative to the background as well as a likely observer. In different embodiments, the observer could be a human, an optical-based detection system, an electromagnetic detector, a static system, a mobile system, a detection system based at one location, and/or a detection system based at multiple locations. As such, the detection systems can be configured using a variety of variables, many of which may be unknown to the target or object 23, or a human or other operator situated therein.

A variety of the camouflage positional element(s) 11 may thereby be utilized for the camouflage 21 that can be used to hide, conceal, mimic, decoy, or modify the target or object 23. Different embodiments of the camouflage positional element(s) 11 may likely have different operating characteristics depending upon the technology, the age, the design, etc. Perhaps more sophisticated, complex, and/or expensive camouflage positional element(s) 11 may be used for those camouflage positional elements 11 that are intended to be quick-acting, such as with the fighter-jet. By comparison, certain embodiments of the camouflage positional elements 11 that are intended to be applied to slower-acting (and in certain embodiments, less complex) systems may depend upon the target to be fully operational, such as perhaps trucks, ground-based systems or mesh coverings, buildings, etc. can utilize perhaps less-sophisticated, slower technology. As such, the designers or users of the camouflage positional element(s) could have considerable input as to the desired operating parameters of the camouflage positional element(s) included in the camouflage.

Certain embodiments of the camouflage 21 can be configured to operate without considering where an observer might be located. For example, certain embodiments of such targets or objects 23 as trucks, buildings, ships, etc. may be associated with the camouflage 21, including one or multiple colors, that remain substantially the same color, light intensity, heat, absorbance, reflectance, and/or color characteristic, etc. over time. Perhaps, in certain embodiments, the color, light intensity, and/or color characteristics, etc. can be adjusted such as with a camouflage controller or computer, or manually.

Certain embodiments of the camouflage may be configured to allow one more of the colors, light intensities, and/or color characteristics, etc. to change depending upon the light-level, background, time-of-day, etc. Consider, for example, during the day the target or object 21 may be covered with the camouflage which could be the color of the background; while at night the target or object 21 transitions to a darker color such as gray or black, absorb much of the electromagnetic radiation (or vibrations chemical traces, or acoustics), and/or reflect little of the electromagnetic radiation.

Certain embodiments of the camouflage 21 can be configured relative to the target or object based at least partially upon a determined or estimated location of an observer (the location of the observer could even be guessed at). In certain ones of these embodiments, the color of the background can be determined using, for example, a camera or imaging device aimed in the direction of the background of the observer (e.g., behind the target or object with respect to the observer). In certain embodiments, the color, light intensity, reflectivity, absorbance, and/or other optical or electromagnetic characteristics (or vibrations, chemical traces, heat, or acoustics) of the at least one camouflage positional element(s) 11 can be matched to the background based at least in part on where the observer is situated.

Certain embodiments of the at least one camouflage positional element(s) 11 can be configured to disperse light having different color, different intensity, different reflectivities, different absorbencies, and/or other different electromagnetic (or vibrations, chemical traces, heat, or acoustics) characteristics in different directions. In certain embodiments, the operator or user of the target or object are likely not be certain precisely where sensors, weapons, and/or detectors may be situated. As such, a particular region of a target or object such as a tank, aircraft, building, etc. can affect different presentations corresponding to the different background characteristics depending upon different locations where the observer could be situated relative to the target or object. For example, the at least one camouflage positional element could utilize a segmented embodiment of the camouflage positional element 11 as described with respect to FIG. 16 to project, reflect, or absorb different electromagnetic radiation (or vibrations chemical traces, heat, or acoustics) at different angles from the object.

For example, an observer or detector that is situated to the left of the target or object 23 may view the background to the target or object as being green, while another observer or detector that is situated on the same side of the target or object (but at a different angle) may view the background to the target or object as being brown. As such, the at least one segmented camouflage positional element(s) can disperse generally green light to one range of angles from the target or object, and generally brown light through another range of angles from the target or object. Many of these concepts as described are applicable to other embodiments of the camouflage 21, as well as other targets or objects, as described in this disclosure.

In certain embodiments, the camouflage 21 can make the target or object 23 appear consistent with to hide into the background. More or less effective camouflage systems can be provided or designed based at least in part on speed, optical characteristics, realism, camouflage mechanism; etc. of the at least one camouflage positional element(s) 11. A variety of technologies are described in this disclosure that can be used to make the target or object appear consistent with, and/or hide with respect to, the background.

Certain embodiments of the at least one camouflage positional element(s) can be supported, maintained, and/or allowed to be displaced and/or move in a variety of manners and utilizing a variety of mechanisms. Certain embodiments of the camouflage 21, as described with respect to FIG. 2, can include the at least one camouflage positional element(s) 11 attached, affixed, adhered or otherwise secured to a substrate 46 that may be made including a plastic, metal, mesh, fabric, fiberglass, composite, adhesives, fasteners, or other materials or devices. As such, a wide variety of the substrate 46, as well as the object or target 21, can be used while remaining within the scope of the present disclosure. In certain embodiments, the camouflage 21 can include a flexible material such as the mesh, fabric, adhesives, and/or jointed structure that can, for example, be positioned over the object or target 23 to conceal or hide the object or target. In certain embodiments, the substrate 46 can be attached with respect to, and/or form a part of a vehicle, building, etc., or alternately could form a material or mesh to lie over the target or object 23 to affect the camouflage presentation, and/or camouflage the object.

Figure 3:
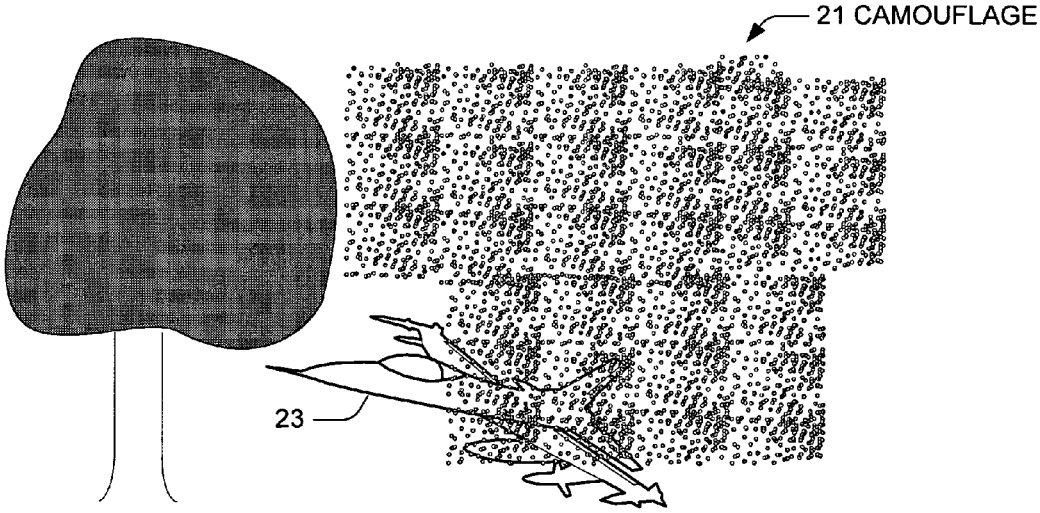
FIG. 3 is a diagram of another embodiment of the camouflage including the at least one camouflage positional element.

Certain embodiments of the camouflage 21, as described with respect to FIG. 3, can include the at least one camouflage positional element(s) 11 that can be situated either above the object or loosely in the air (e.g., to form a cloud of the camouflage positional element(s) 11) that could obscure, distort, hide, or mimic the appearance of the target or object 23 such as a person, aircraft, ship, tank, car, truck, building, etc. to an observer or detector. In certain embodiments, the camouflage can be applied to protect a variety of devices including, but not limited to, a robot, a pre-programmed mechanism, a mobile mechanism, a military mechanism, a remotely-controlled mechanism, an automatically-controlled mechanism, a drone mechanism, a device with mobility (controlled, preprogrammed or random) that robots and other automated devices could morph into, etc. In certain embodiments, the target or object 23 can be situated in the air or on the ground. The embodiment of the camouflage 21, as described with respect to FIG. 3 can thereby be configured as a camouflage cloud that can be dispersed about, and/or maintained with respect to, the object to the target 23 for a desired or designed duration. Certain embodiments of the "clouds" of camouflage 21 can be applied to a static target or object, such as an aircraft, tank, artillery, building, or piece of equipment situated on the ground. Certain embodiments of the "clouds" of the camouflage 21 can be applied to or distributed from a dynamic (e.g., moving) target or object, such as aircraft in-flight or a driven truck, tank, or ship. As such, certain embodiments of the clouds of the camouflage 21 can be maintained relative to or dispersed from the target or object 23 such as an aircraft, tank, car, truck, etc. for example, using air-to-air dummy-missiles (for aircraft), and/or dropping from the target or object such as an aircraft using known mechanisms. In other embodiments, the camouflage 21 can be attached to a fabric, mesh, or other substrate that can be temporarily or more permanently secured with respect to the target or object.

Figure 4:
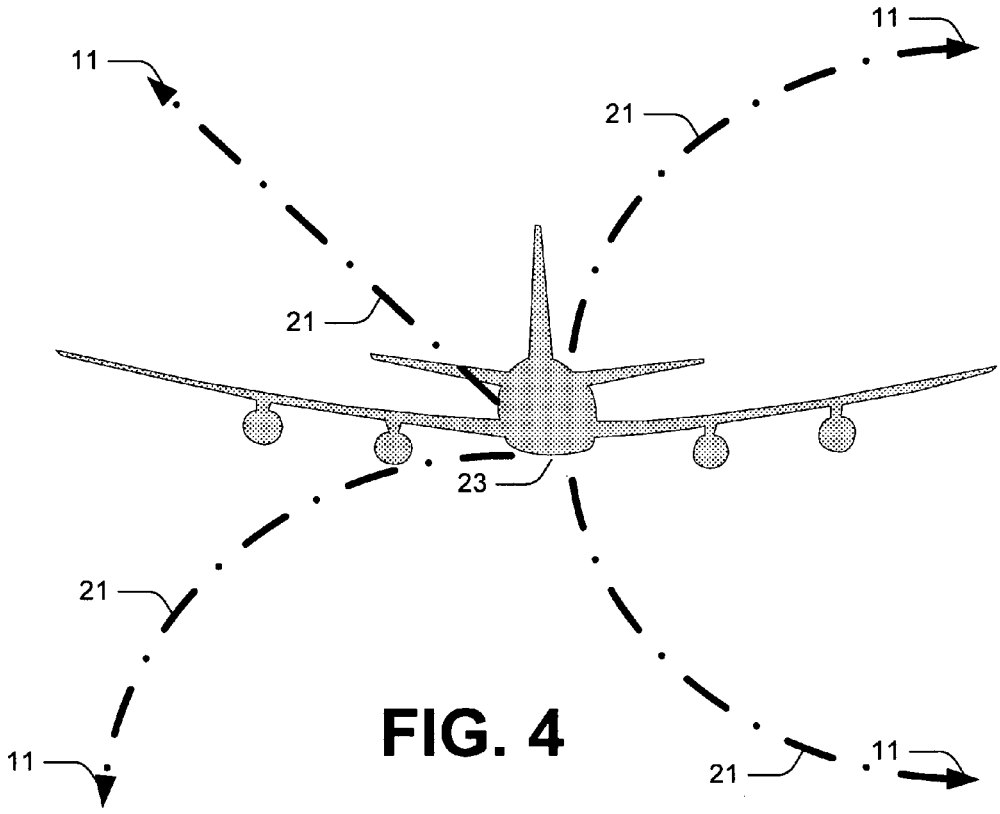
FIG. 4 is a diagram of another embodiment of the camouflage including the at least one camouflage positional element.

Certain embodiments of the camouflage 21, as described with respect to FIG. 4, can include a target or object 23 such as a vehicle including an aircraft, tank, car, ship, etc. that emits the at least one camouflage positional element(s) 11 that are disbursed from the target or object 23. The at least one camouflage positional element(s) 11 can be configured to produce heat, electromagnetic radiation (or vibrations, chemical traces, heat, or acoustics), light, sound, biological, or some other entity (and/or absorb or reflect such entities) that could be used to deflect a weapon (such as a heat-seeking missile, etc.) in a direction generally away from the target or object 23. Using one or more of these mechanisms, the operation of the object or target could be mimicked, distorted, or hidden such as to confuse a weapon, detector, or sensor.

A variety of embodiments of the camouflage 21 including the at least one camouflage positional element(s) 11 can be configured to confuse weapons that are directed at the object or target 23. Different embodiments of the weapons that are directed at the object or target 23 can vary widely in technologies and sophistication. As such, the at least one camouflage positional element(s) 11 are to be configured to divert the particular types of weapons that can be expected to be targeted at the target or object 23. Certain embodiments of the at least one camouflage positional element(s) 11, as described in this disclosure, can include motes, and as such can utilize networking and/or communication computer-based systems and/or techniques. Certain embodiments of the motes could control the affecting the camouflage presentation, while other embodiments of the motes could include the camouflage presentation to be affected.

Figure 5:
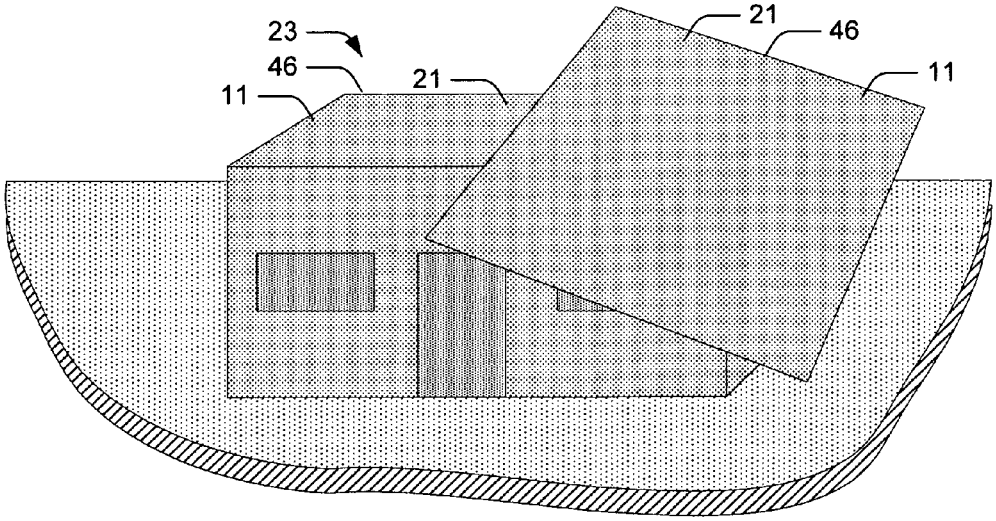
FIG. 5 is a diagram of yet another embodiment of the camouflage including the at least one camouflage positional element.

Certain embodiments of the camouflage 21, as described with respect to FIG. 5, can include the at least one camouflage positional element(s) 11 that can be attached to, secured to, applied to, adhered to, etc. walls or other portions of a building, dwelling, office, or other location that is desired to be camouflaged. For example, the walls of the target or object 23 that includes, for example, a building, office, dwelling, or stationary vehicle, etc. could include the substrate 46. In another embodiment, the substrate 46 can be separate from the target or object 23 to cover and/or hide the target or object. In other embodiments, a camouflage cloud could be provided about the building, stationary vehicle, etc. to mimic or modify the desired are designed characteristics of the target or object 23.

Figure 6A:
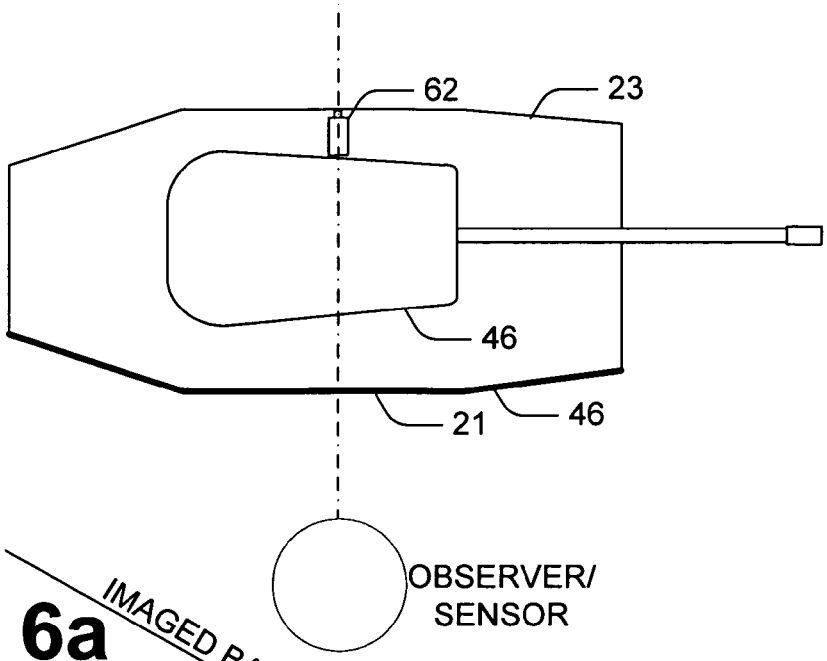
FIGS. 6*a* and 6*b*, is a diagram of another embodiment of the camouflage including the at least one camouflage positional element.
Figure 6B:
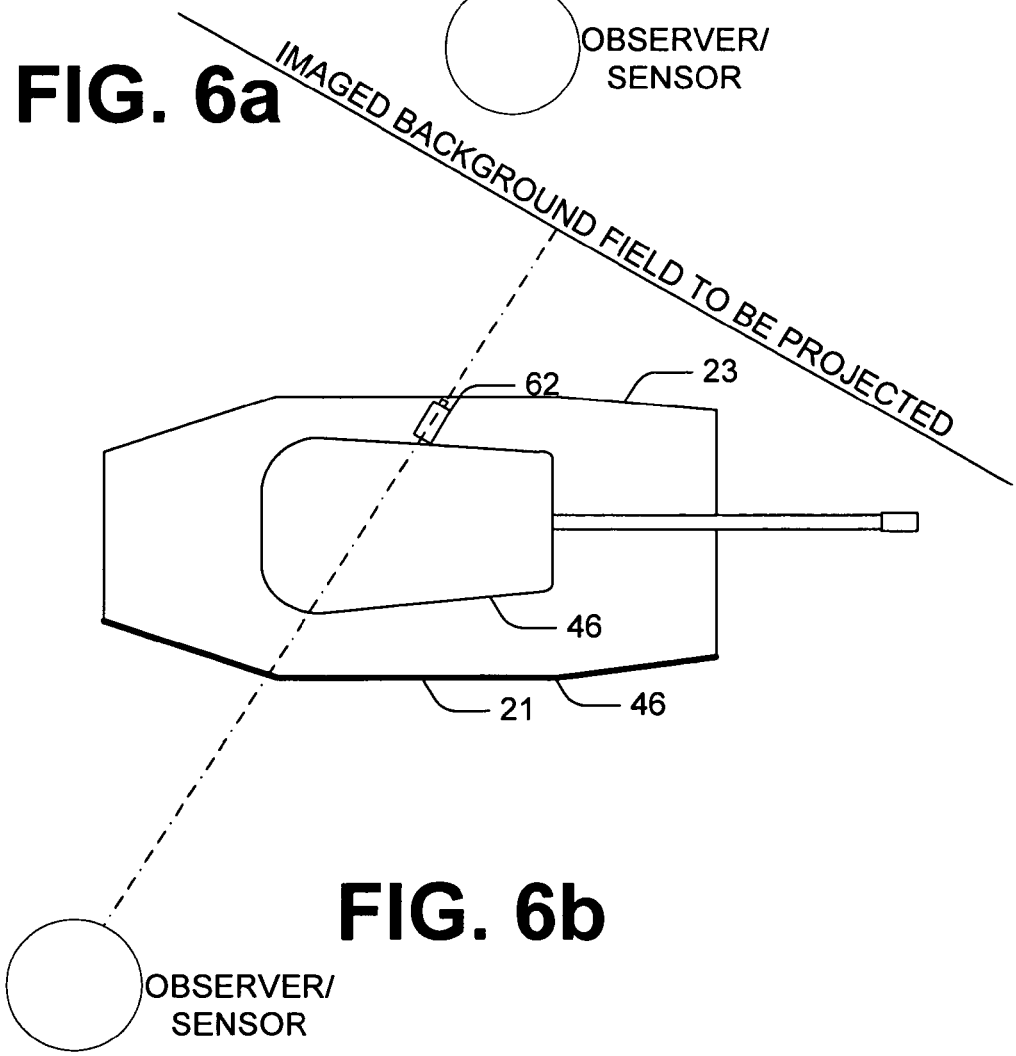

Certain embodiments of the camouflage 21, as described with respect to FIGS. 6*a* and 6*b*, illustrate the at least one camouflage positional element(s) 11 that is secured to the side of the target or object 23 (the tank), in which the camouflage can affect a presentation. In certain embodiments of this disclosure, the presentation can relate to an image or signature captured on an opposing side of the target or object 23 such as to provide a similarly-configured or appearing background to the actual background behind the target or object. Certain embodiments of the camouflage positional element 11 can be configured to affect a suitable presentation depending upon what is desired to be sensed or detected by the sensors, detectors, and/or weapons Certain embodiments of the camouflage 21 can consider a position of an observer with respect to the target or object 23, and as such to derive a suitable background depending upon the actual background or a determined are designed background.

For example, certain embodiments of the camouflage 21 can determine that an observer, weapon, or sensor of the target or object 23 in FIG. 6*a* is situated on one of the target's or object's (e.g., right) flank, surface, or side. As such, an imaging system 62 (which can in different embodiments include a still digital camera capturing frequent images, a motion-picture imaging system, a camcorder, etc.) can image the background such that when viewing the right side of the object or target. The color, intensity, electromagnetic radiation (or vibrations, chemical traces, heat, or acoustics) emission, reflectance, or absorbance as captured by the image or motion image can thereupon be displayed on the suitable camouflage 21 location, such as the substrate 46 or surface of the target or object which could include the metal-plating on the right side of the target or object 23.

As the relative position of the observer changes with respect to the target or object 23 as described with respect to FIG. 6*b*, a different presentation (background) should be affected such that the background still corresponds to the affected presentation. As such, the angle of the imaging system 62 with respect to the target or object can be modified, such that the background field being imaged or captured by the imaging system 62 corresponds to the background behind the target or object 23 as considered with respect to the observer. In certain embodiments, a suitable controller mechanism can be applied to the imaging system 62 to correlate the background field that is being imaged to the relative location of the observer. In certain embodiments, the camouflage positional element(s) can be segmented, such as to reflect a different camouflage presentation depending where an observer or sensor would be situated with respect to the target or object.

Certain embodiments of the camouflage positional element(s) can utilize camouflage information (e.g., signals, data, etc.) that can be used by the camouflage 21 to affect the camouflage presentation, such as to camouflage the target or object 23. Certain embodiments of the camouflage information can provide information relating to the surroundings of the target or object 23, such as the color, texture, consistency, etc. in the vicinity of the target, perhaps in certain directions. Within this disclosure, certain embodiments of the affecting the camouflage presentation can include, e.g., affecting an optical presentation, affecting an electromagnetic (or vibrations, chemical traces, heat, or acoustics) presentation, jamming or obfuscating a signal, absorbing or reflecting electromagnetic radiation (or vibrations, chemical traces, heat, or acoustics), hiding the target or object 23, providing a camouflage technique, etc. Certain embodiments of the camouflage information can include, but are not limited to for example, camouflage data, signals, messages, and/or other information.

In general, camouflage that is intended to hide or conceal the target or object can be applied to any portion of the target or object that would make the target or object less visible. As described with respect to this disclosure, certain ones of the camouflage positional element(s) 11 can be irregularly distributed, regularly distributed, and/or randomly distributed across one, two, or three dimensions to form certain embodiments of the camouflage 21. In addition, certain ones of the camouflage positional element(s) can be allowed to move following distribution across one, two, or three dimensions. As such, certain embodiments of the positioning of the camouflage positional element(s) 11 can be formed in regular, irregular, and/or random spacing, dimensions, operations, characteristics, structures, configurations, etc. as desired, to ensure that the camouflage can affect a suitable camouflage presentation prior to, during, or after such relative motions between the at least one camouflage positional element(s) 11.

In certain embodiments of the camouflages, negligible displacement between camouflage positional element(s) 11 could be allowed or provided such as each camouflage positional element(s) not being allowed to move with respect to the target or object 23. As such, certain camouflage positional element(s) can be maintained in the substantially static state with respect to each other and/or with respect to the target. In other embodiments, the camouflage positional element(s) 11 can be allowed to be displaced or move with respect to each other to affect the camouflage presentation of the camouflage 21. Such movement or displacement between certain embodiments of the camouflage positional element(s) 11 may occur at different rates and/or at different amounts in different embodiments, depending upon the operation, characteristics, and/or structure of the at least one camouflage positional element(s). With certain embodiments of the camouflage 21, the camouflage positional element(s) can be arranged in a regularly sized and/or spaced array configuration, while other embodiments of the camouflage can be irregularly or quasi-randomly sized and/or spaced.

Certain embodiments of the camouflage positional element(s) 11, as described in this disclosure, can actuate a distinct camouflage presentation affecting device or element, and thereby affect the camouflage presentation and/or control a portion of the camouflage. Other embodiments of the camouflage positional element(s) 11 can include an integrated camouflage presentation affecting portion or element to affect the camouflage presentation and/or control a portion of the camouflage. Whether the camouflage presentation affecting element is integrated in the camouflage positional element, or represents a distinct element that is controlled by the camouflage positional element can represent a design choice or an interpretation of those components that are located within the camouflage positional element(s). Such variations of the camouflage positional element(s) 11 that can be configured to affect the camouflage presentation, and can be within the intended scope of the present disclosure depending upon context.

Certain embodiments of the camouflage 21 can act to camouflage a wide variety of vehicles, structures, weapons, devices, roads, landing strips, etc. As such, the target or object 23 can utilize a variety of the embodiments of camouflage 21.

One embodiment of the camouflage 21, such as illustrated in FIGS. 1*a* and 1*b*, 2-5, 6*a*, 6*b*, 7-9, 13, 14, or 16 and/or other aspects as described in this disclosure, may represent an illustrative example of the camouflage 21. As such, certain embodiments of the "displacement" of the at least one camouflage positional element(s) may include a number of discrete camouflage that can have similar or dissimilar dimensions, similar or dissimilar shapes, similar or dissimilar device configurations, similar or dissimilar operating characteristics, similar or dissimilar electromagnetic (or vibrations, chemical traces, heat, or acoustics) radiation emissive, reflecting, or absorbing characteristics, similar or dissimilar attachment mechanisms, similar or dissimilar "stealth" characteristics, etc. As such, certain embodiments of the camouflage 21 can be arranged in any desirable shape, configuration, pattern or size of camouflage positional element(s), emissive, reflective, or absorbing characteristics, density of camouflage positional element(s), etc.

Figure 9:
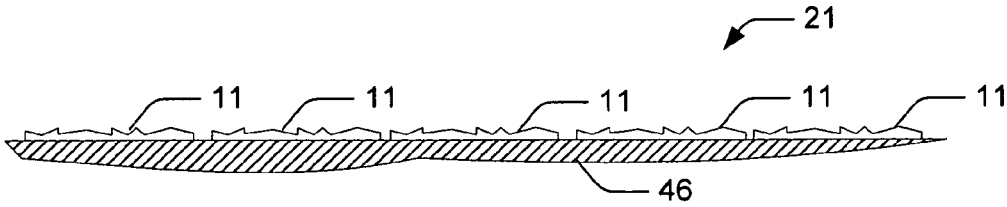
FIG. 9 is a partial cross-sectional view of still another embodiment of the camouflage including the at least one camouflage positional element.

Certain embodiments of the camouflage positional element(s) 11, which may be applied to aircraft, tanks, ships, buildings, and other radar-sensitive devices, can also be used to apply stealth characteristics to the aircraft as described with respect to FIG. 9. Certain embodiments of stealth can rely on providing a substantially uneven surface such as to diffract interrogatory radar signals into many different directions and thereby reduce the radar signature (i.e. which can be equated to the reflected radar signal that returns to the radar to be detected) provided by the aircraft in any one direction such as could be detected by radar. As such, certain embodiments of the camouflage positional element(s) 11 can be curved and/or angled to reduce the occurrences of flat surfaces that might reflect large amounts of incident electromagnetic radiation (or vibrations, chemical traces, heat, or acoustics) uniformly and thereby produce a large radar signature. Stealth technology can also involve selecting a highly absorptive surface finish of the camouflage display elements. Different sizes and/or configurations of the camouflage positional element(s) as illustrated in FIG. 1*b*, may be utilized to improve the camouflage aspects. Certain embodiments of the camouflage positional element(s) 11 can be coated with, or fabricated from, materials that are known to improve stealth capabilities of aircraft, for example. In certain embodiments, a suitably clear or opaque flat layer can be deposited onto the camouflage positional element(s) 11 to smooth out the aircraft's skins or surfaces, which can thereby also improve the aerodynamic qualities of the aircraft. Certain embodiments of the camouflage positional element(s) can be formed from a material that absorbs much of the interrogatory radar signals (or at least does not greatly reflect much of the interrogatory radar signals). Certain embodiments of stealth technology can be applied to a variety of vehicles including, but not limited to, aircraft, helicopters, cars, trucks, tanks, ships, etc.

Certain embodiments of the dimensions of the camouflage positional element(s) can be enlarged, reduced, or even miniaturized (e.g., using semiconductor processing or other techniques) compared to as illustrated with respect to FIG. 1. With certain ones of the target or object 23 can be hidden or concealed using the camouflage 21. Very-Large-Scale Integration (VLSI) techniques can be utilized to fabricate a considerable number of certain embodiments of the camouflage positional element(s) on a chip, either as discrete components and/or as integrated circuits. Such semiconductor device fabrication techniques, chip layouts, etc. are generally well understood by those skilled in the art, and will not be further detailed herein.

Alternatively, the camouflage positional element(s) 11 can be fabricated as discrete components that can be attached to the substrate 46, similar to as illustrated with respect to FIGS. 1*a* and 1*b*. Multiple camouflage positional element(s) can be attached to the substrate 46 with regular or irregular spacing, regular or irregular dimensions, regular or irregular capabilities (able to produce certain amounts of light, electromagnetic radiation, acoustics, vibrations, heat, chemical traces, or other such aspects).

Certain embodiments of the camouflage positional element(s) 11 that can be included in the camouflage 21 can be attached to a large variety of targets or objects that could in different embodiments be solid or flexible substrate surfaces such as a wall, a window, a person, an automated or robotic device, a door, a table, furniture, a desk, a vehicle, etc, as described with respect to FIGS. 1*a*, 1*b*, 2, 3, 5, 6*a*, 6*b*, 7, 8, 9, 13, 14, and/or 16. In certain embodiments, the camouflage positional element(s) can be attached to the solid or flexible surface by coating over the camouflage positional element(s) using a suitably-clear or translucent adhesive, paint, epoxy, etc. at any locations that light or other electromagnetic radiation (or vibrations, chemical traces, heat, or acoustics) generated by the camouflage positional element(s) could pass through. Alternately, certain embodiments of the camouflage positional element(s) could be attached to the solid or flexible surfaces and non-light transmitting portion, such as by affixing the back or side of the camouflage positional element(s) to the substrate 46 using any suitable attachment, adhesive, fastener, etc. that need not be translucent or clear. Certain embodiments of the at least one of the camouflage positional element(s) can be supportable to be displaceable and/or free-floating, such as by being supported by an air, gas, or liquid curtain, by being secured to a surface in an irregular configuration, or by having certain ones of the at least one camouflage positional element(s) having different capabilities, and therefore can output, reflect, or absorb different amounts of electromagnetic radiation (or vibrations, chemical traces, heat, or acoustics) such as light. As such, there can be a variety of mechanisms to support or maintain the camouflage positional element(s) 11 in a suitable orientation and/or position to provide the camouflage 21, when desired.

Certain embodiments of camouflages described in this disclosure can relate to determining the position of the at least one camouflage positional element(s), for example: relative to other camouflage positional element(s), relative to some device, relative to some geographic position (e.g., a position derived using a global positioning system, radar, etc.), relative to a building or structure, relative to an individual, or relative to any other definable entity, etc. The position of each camouflage positional element 11 can be determined at that camouflage positional element, at another camouflage positional element, and/or at another device such as a computer-based controller device. The concepts and embodiments of camouflage positional elements, as described in this disclosure, can therefore be integrated or included in a wide variety of the camouflage 21 including, but not limited to: a personal (human being) camouflage, a vehicle's camouflage, a building's or structure's camouflage, a ship's camouflage, etc. It is envisioned that the concepts as described in this disclosure can thereby be applied to a large variety of camouflage.

The term "camouflage positional element(s)" as used in this disclosure is intended to be broadly interpreted, depending upon the particular context. A variety of technologies can be utilized in certain embodiments of the camouflage positional element(s), which can include but are not limited to such devices as: mote(s), processor-based device(s), wireless camouflage device(s), etc. Many aspects of the camouflage 21, as described in this disclosure, that can include camouflage positional element(s) to provide a variety of computer-based camouflage systems. Certain ones of the different embodiments of the camouflage positional element(s) can be configured using a variety of technologies. In certain embodiments as described in this disclosure, a number of the camouflage positional element(s) (which may include any additional devices or components which can be used to affect the camouflage presentation) can interface with each other and/or transmit data therebetween and to or from a computer/controller or other device as described in this disclosure and is well-known with networked devices, technologies, and/or techniques.

The embodiment of the at least one camouflage positional element(s) 11 can be arranged in a variety of configurations to at least partially form the camouflage 21. In certain embodiments, the at least one camouflage positional element(s) can be arranged in an irregular configuration similar to as described with respect to FIG. 1, such that certain camouflage positional elements along one, two, or three dimensions. Since minor design variation are within the included scope of the present disclosure, the optical characteristics of certain camouflage positional elements, the dimensions of certain camouflage positional elements, and/or other such characteristics of certain camouflage positional elements, and other such aspects can differ from other camouflage positional elements. Certain types of the irregular configuration of certain camouflage positional elements as compared to other camouflage positional element(s) can be compensated. For example, if a first camouflage area has a denser camouflage positional element concentration than a second camouflage area, and it is desired to provide a substantially uniform or consistent illumination in the first camouflage area and the second camouflage area, then at least one of the camouflage positional element(s) of the second area may be configured to produce more light, in general, then at least one of the camouflage positional element(s) of the first area. Such compensation techniques can be applied to compensate for a variety of optical, dimensional, spacing, and/or other irregularities.

In certain embodiments, the at least one camouflage positional element(s) can be allowed to be displaced with respect to each other. In certain embodiments, the at least one camouflage positional element(s) can be applied to and/or attached to a surface in a regular pattern, an irregular configuration, or some other configuration. Certain embodiments of the camouflage positional elements can therefore change their position over time (such as by floating in air, in outerspace, or with respect to another fluid, etc). A variety of techniques may be used to affix certain embodiments of the camouflage positional element(s) to the substrate 46, or alternately support the camouflage positional element(s) relative to the target or object. For example, certain embodiments of the camouflage positional element(s) can be sufficiently small to be easily supported such as by using an air curtain or fluid curtain, air supply, etc. Such support can provide for relative easy displacement of the camouflage positional element(s) with respect to each other. Such air curtains can be provided in an enclosed but externally visible (or otherwise affecting the camouflage presentation externally) to provide the camouflage. Other embodiments of the camouflage positional element(s) can be applied using an adherent liquid (e.g., a clear adhesive or glue) to a surface or substrate 46. Such techniques as "painting", "gluing", "adhering", or other securing processes can be used to secure the camouflage positional elements to substrates, meshes, fabrics, adhesives, metal, glass, etc.

Certain embodiments of the camouflage positional element(s), as described with respect to FIG. 3, can be disbursed about a target such as in the camouflage cloud that could affect the camouflage presentation which may protect, hide, mimic, or otherwise obfuscate the target from a weapon or detection system. Therefore, certain embodiments of the camouflage positional element(s) 11 can be deployed in the vicinity of troops, aircraft, ships, tanks, and/or other potential targets using similar deployment techniques as used for chaff to hide or mimic potential targets. In certain embodiments, the camouflage positional element(s) can be configured to affect the camouflage presentation based at least partially on types of weapons that may potentially be applied against the target or object 23 (e.g., targeted). For example, to protect aircraft, ships, or troops, certain embodiments of the camouflage 21 that may include the camouflage positional element(s) 11 may be dispersed such as in the camouflage cloud that could be used to affect the camouflage presentation. The affecting the camouflage presentation could decoy aircraft, ships, or other camouflaged, distorted, decoyed and/or mimicked targets or objects (e.g., people, weapons, vehicles, equipment, structures, etc.). Such decoyed objects could appear in at a particular location, but in reality would not be located there. Within this disclosure, depending upon context, the terms "decoy" or "mimic" can include camouflage that diverts the object from the target or object, as well as an object that appears as the target or object when no target or object is located therein.

With certain embodiments of the camouflage, it may be desired to hide, mimic, distort, or obfuscate the target from a weapon, detector, or other such locator. One such technique to hide the target can include establishing a cloud about or nearby the target that could hide the target using optical, heat-seeking, and other techniques such as described with respect to FIG. 3 or 4. As such, the camouflage can provide a similar mechanism to make the target not optically electromagnetically, vibrations, chemical traces, acoustics, heat, or otherwise visible to observers, sensors, etc. to protect such objects or targets, aircraft, ships, troops, tanks, etc. In certain embodiments of camouflage, such as where heat-seeking missiles are directed against the target, the affecting the camouflage presentation may include generating sufficient heat such that missiles would be confused as to whether the target or the camouflage positional element(s) are generating the heat, and the missiles would likely be guided away from the target. Depending upon the location of the camouflage positional element(s), it is likely that a number of camouflage positional element(s) could generate sufficient heat to adequately mimic the target or object, and thereby deflect the missile. In certain embodiments, such camouflage positional element(s) as motes could include, or be able to actuate, heat elements for brief durations that could generate considerable heat as to mimic a jet engine or motor. As such, certain embodiments of the camouflage 21, as applied to the target, should be configured to confuse weapons, individuals, vehicles, etc. as applied against the target based at least in part on the guidance or observing the weapons, individuals, vehicles, etc.; and thereby effectively guide the weapons, individuals, vehicles, etc. away from the target such as utilizing heat generating camouflage positional element(s).

Certain embodiments of the camouflage positional element(s) may be configured to be supported within a fluid curtain such as might occur when supported within the air. In different embodiments, the fluid curtain can be naturally occurring (e.g., air, water, outer space) or man-made (such as establishing the fluid curtain). In different embodiments, the curtain may actively support, or not support the camouflage positional element(s) 11. For example, certain embodiments of fluid curtains can actively support the camouflage positional element(s) to suspend it in the air. Alternately, certain embodiments of the camouflage positional element can be made relatively light and/or suspended (e.g., by attachment to balloons, device supporting elements such as miniature propellers or moving vanes, air jets, etc.). At regular intervals those camouflage positional element(s) 11 that are suspended, or floating in a fluid or curtain as described with respect to FIG. 2 (or are otherwise free to move), can determine their position or movement at a rate often depending upon such factors as how far the camouflage positional element(s) can move, and how many camouflage positional element(s) there are.

For those camouflage positional element(s) that remain substantially static (such as those that are attached or affixed to a target such as a side of a jet or missile, or a wall of a building, etc.), the position of the camouflage positional element(s) may only have to be considered once, or alternatively could be considered infrequently. If irregular operations occur and/or are sensed in any embodiment of the camouflage and/or the associated camouflage positional element(s), then it may be desired to determine suitably frequently the position and the operation of at least one of the camouflage positional element(s). Considering that certain embodiments of camouflage involves generally coloring, hiding, mimicking, decoying, or generally obfuscating the target, camouflage may not demand as high a resolution as that necessary to create an actual image such as, for example, displaying. In certain embodiment(s), a variety of the movement and/or position of the camouflage positional element(s) can be monitored using position sensing within that camouflage positional element or another device (e.g., another camouflage positional element).

Such determining of, or determining of movement of, the position of the at least one camouflage positional element(s) 11 can be determined relative to each other in certain embodiments, relative to other devices such as a computer controller, relative to the camouflage 21, and/or relative to some geographic, structural, building, or other definable position. As such, as certain embodiments of the at least one camouflage positional element(s) are displaced to a different position, the camouflage (color, etc.) to be emitted may change as a result of the different position. Additionally, the camouflage may change as the conditions change (e.g., the sky lightens) even if the camouflage positional element are maintained at the same location. As such, the camouflage information that can be used to determine the color, texture, intensity, etc. of the at least one camouflage positional element should be considered dynamic which can change as conditions change. Each of the at least one camouflage positional element(s) can determine which camouflage information to camouflage (which can depend upon such factors, but are not limited to, camouflaged data, etc. such as to indicate colors, absorbencies, reflectivities, intensities, or other characteristics of the camouflage positional element(s)) as a result of its determined position and/or motion. As such, it may represent one goal of the camouflage to determine and/or provide suitable camouflage information using the at least one camouflage positional element(s). One or more of the at least one camouflage positional element(s) 11 can thereby combine to achieve the overall goal of the camouflage 21 by camouflaging a portion of the camouflage information depending upon its particular position. As, such a variety of embodiments of the camouflage can be provided that are established by determining the position of at least some of the camouflage positional element(s), and thereupon determine which camouflage should be provided by each one of the at least one camouflage positional element(s).

The determination of the position of the camouflage positional element(s) 11, and thereupon which particular camouflage information to utilize to provide a useful camouflage therefrom, as well as certain embodiments of the associated processing, can be determined either within or partially within the camouflage positional element(s) and/or within or partially within another device such as a computer/controller 18. As such, in certain embodiments, at least one of the camouflage positional element(s) 11 can affect the camouflage presentation based at least in part on the position of the at least one camouflage positional element(s) with respect to the camouflage 21, and a different camouflage presentation can be affected at another camouflage position.

There are a wide variety of embodiments in which the camouflage positional element(s) can be situated in a fixed position such as described with respect to FIGS. 1*a* and 1*b*; and a variety of embodiments in which the camouflage positional element(s) can be situated in a movable or displaceable position such as with the camouflage cloud as described with respect to FIG. 3. Certain embodiments of the movable camouflage positional element(s) can be configured to be able to transition states and/or move (e.g., change position) at a relatively slow rate while other movable camouflage positional element(s) are configurable to be able to transition states and/or move at a more, less, or similarly rapid rate, depending upon their particular application, media, and rate of movement of the media.

Certain embodiments of the camouflage positional element(s) can be arranged in a variety of configurations as described in this disclosure. In one embodiment, multiple ones of the camouflage positional elements can be uniformly-spaced, such as to form the camouflage to hide, mimic, obfuscate, or distort the target or object. Certain embodiments of the camouflage positional element(s) can be irregularly and/or randomly configured. As such, camouflage positional element(s) can be secured and/or supported using a variety of techniques and in a variety of relative positions. For certain embodiments of the camouflage positional element(s) that are not regularly configured (such as by having an irregular distribution, an irregular spacing, etc.), the intensity of, effect of, or other aspect of the light or other such electromagnetic radiation, vibration, chemical traces, acoustics, and/or heat produced and/or controlled by each of the at least one camouflage positional element(s) could compensate for the irregular distribution or pattern.

Such irregular and/or random configuration may apply to a variety of attributes relating to the camouflage positional element(s) 11 including, but not limited to: irregular spacing, irregular positioning, irregular intensity, irregularity in compensating for malfunctioning or unevenly operating camouflage positional elements, etc. This disclosure thereby provides a technique by which the one or more camouflage positional element(s) may be arranged in a stand-alone configuration and/or in different embodiments integrated in other camouflage positional element(s), devices, controllers, circuits, elements, etc.

Certain embodiments of the camouflage positional elements, as described in this disclosure, can be configured to communicate and/or transfer data with each other in a manner as is generally known by those skilled in networking technologies. A number of addressing techniques may be utilized by the camouflage positional element(s) to determine the camouflage information that should be camouflaged, and/or affect the camouflage presentation, based at least in part on received information. Such affecting the camouflage presentation can equate, depending on the context, to generating camouflage. The at least one camouflage positional element (s) can utilize certain embodiments of the addressing techniques to achieve at least a portion of a goal for the camouflage 21, which may be configured as a network of camouflage positional element(s).

Certain embodiments of the camouflage positional elements can therefore electromagnetically, vibrationally, chemical traces, acoustically, or heat camouflage the target or object 23 that is associated with the camouflage 21 using at least one of the various camouflage techniques as described in this disclosure. Certain embodiments of the camouflage positional element(s) can perform a large variety of other camouflaging operations to affect a presentation (e.g. which may include or be different from the affecting the camouflage presentation). For instance, certain embodiments of the camouflage positional element(s) 11 can emit, reflect, and/or absorb heat, electromagnetic radiation, acoustics, vibrations, chemical traces, a signal, and/or other similar parameters. As such, one or more embodiments of the camouflage positional element(s) can actuate and/or interface with one or more devices such as, described with respect to FIGS. 11 and 12 for illustrative purposes, but not limited to, an antenna 12 that can transmit and/or receive signals, an electrical/magnetic device 142, a pressure device 144, a temperature device 156, a volume device 158, and/or an inertial device 160. Such camouflage positional element(s) actuating operations may be controlled and/or actuated as described in this disclosure and may rely on, consider, and/or be improved by determining the position, and thereby determining suitable camouflage, of the camouflage positional element(s). Certain embodiments of the camouflage positional element(s) can also be configured to sense the variety of parameters such as electro-magnetic waves, pressure values, temperature, volume, inertia, etc. These embodiments of devices and/or parameters are intended to be illustrative in nature, and not limiting in scope. Certain embodiments of the camouflage positional element(s) can be configured to include, utilize, and/or interface with motes, sensor devices, controllers, processor-based devices, etc. as described above.

Certain embodiments of the camouflage positional element(s) can therefore be configured to at least partially affect the camouflage presentation, which can equate, depending on context, to the camouflaging at least a portion of the camouflage 21. In addition, certain embodiments of the camouflage positional element(s) can also be configured to affect the presentation. As such, the affecting the camouflage presentation and/or affecting the (other camouflage) presentation at least partially using the at least one camouflage positional element(s) can represent at least a portion of the goal for many embodiments of the camouflage 21.

Certain embodiments of the camouflage positional element(s), such as those that are included in or controlled or actuated by motes and/or other integrated circuit devices, can be produced to have a relatively small dimension and/or relatively inexpensively. As the effective number and device density of camouflage positional element(s) is increased, the resolution and/or quality of the camouflage that can be achieved by certain embodiments of the camouflage positional element(s) may increase. It is envisioned that many embodiments of the camouflage positional element(s) could be affordably distributed in relatively dense configurations for a variety of applications, such as could be utilized to be able to camouflage the target. Arranging for the distribution of a number of camouflage positional element(s) may be performed in some happenstance or somewhat random fashion, resulting in relative imprecise situating of each camouflage positional element(s). The process of precisely positioning of the camouflage positional element(s) can, in certain instances, be quite expensive and difficult to perform. As such, this disclosure provides a number of techniques by which the position, or relative positions, of certain ones of the camouflage positional element(s) can be determined once they are situated.

Figure 10:
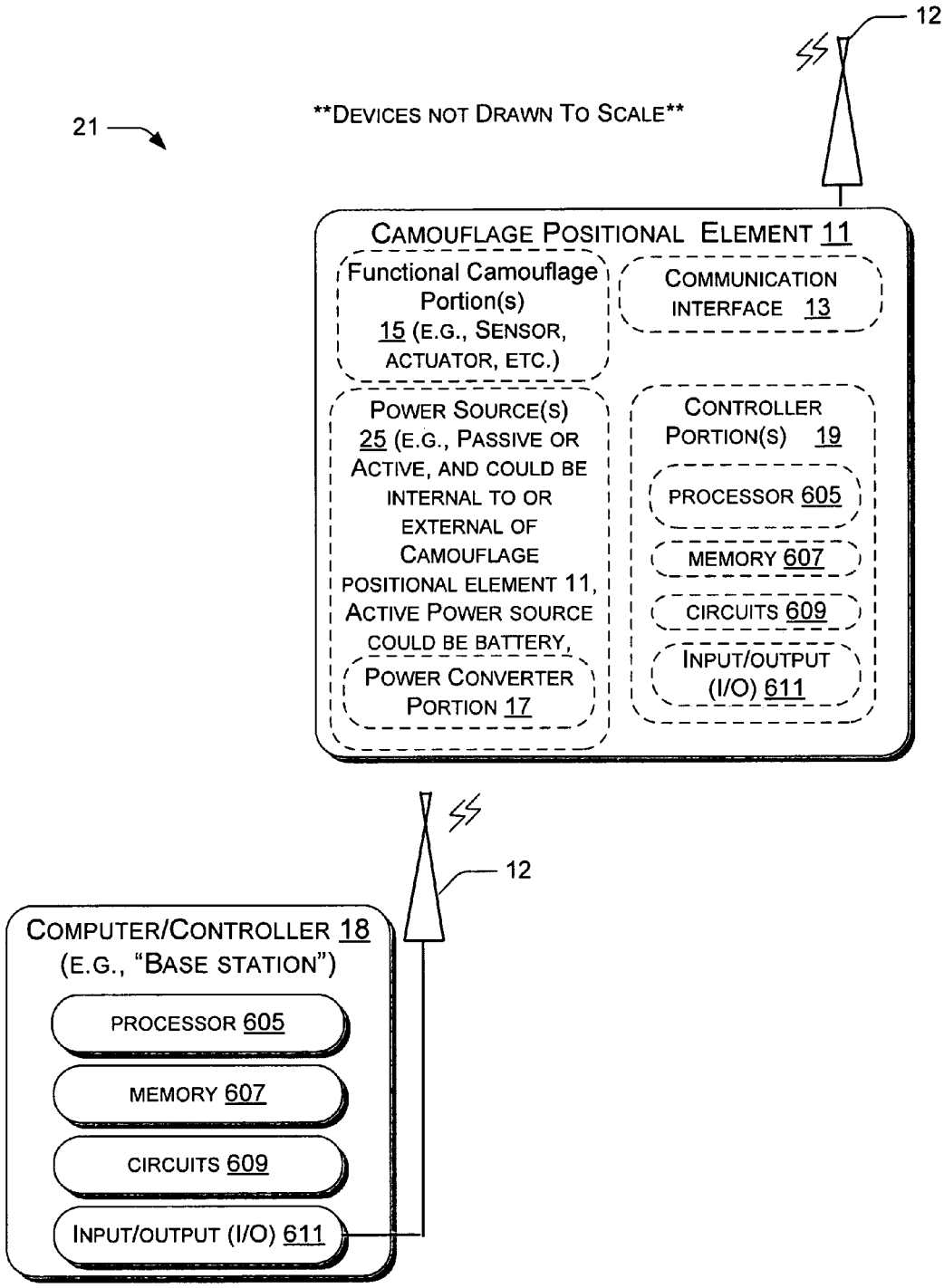
FIG. 10 is a schematic diagram of one embodiment of the at least one camouflage positional element.
Figure 11:
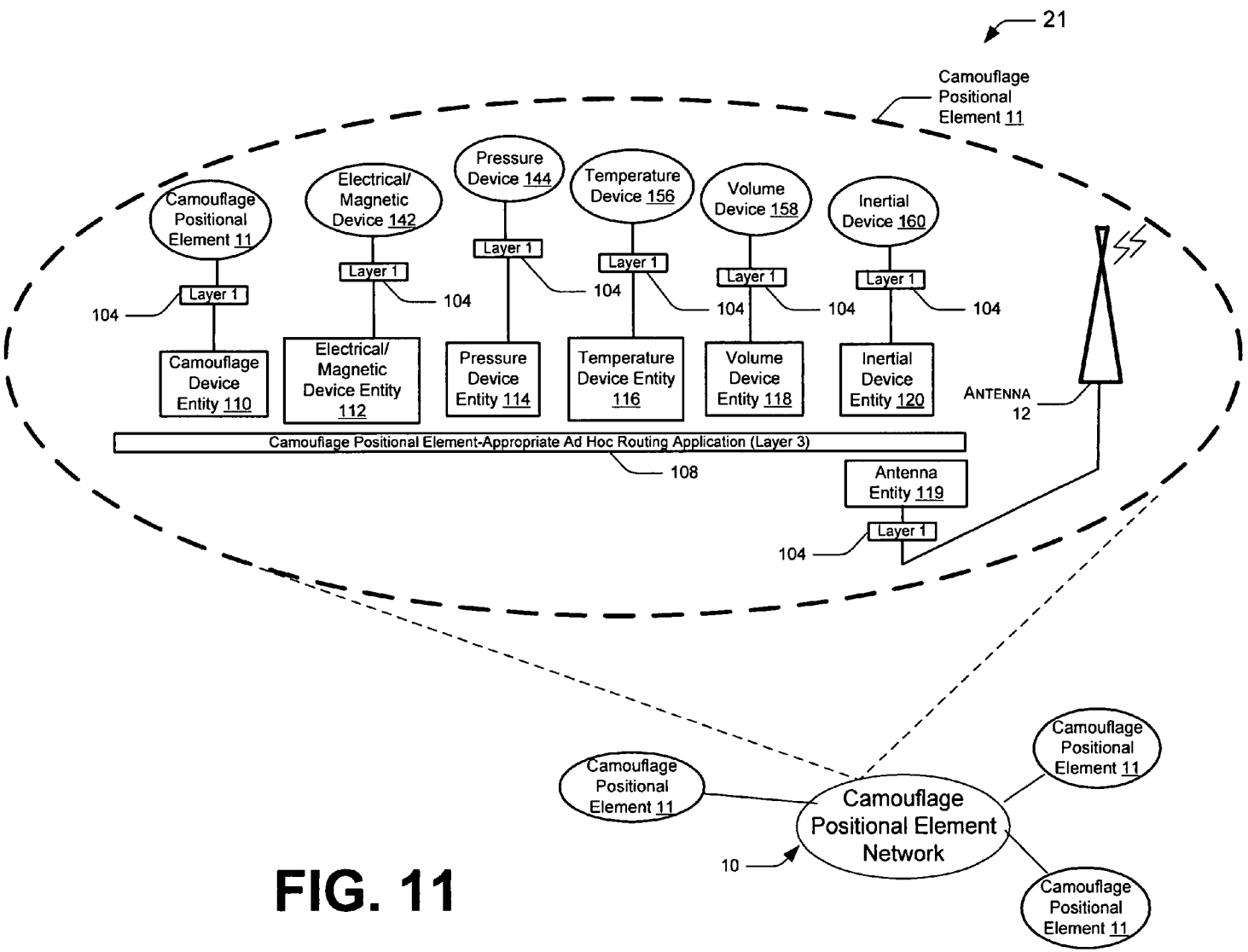
FIG. 11 is a schematic diagram of another embodiment of the at least one camouflage positional element.
Figure 12:
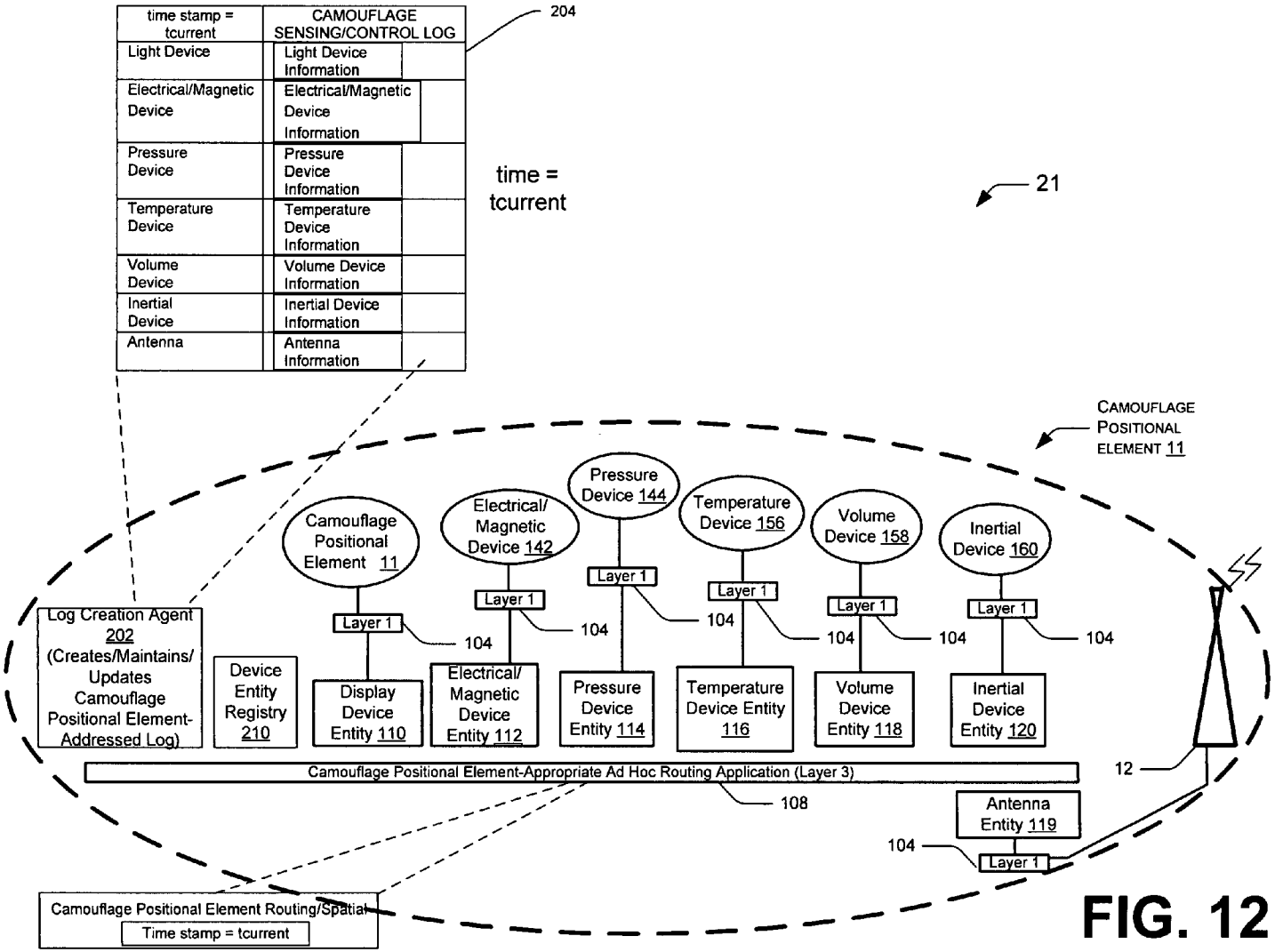
FIG. 12 is a schematic diagram of still another embodiment of the at least one camouflage positional element.

Certain embodiments of the camouflage positional element(s) may be configured as described in this disclosure with respect to FIGS. 10 to 12, and therefore may utilize motes or other technology. The camouflage positional element(s) can be configured to allow for a variety of camouflaging, actuating, and/or sensing operations. One embodiment of a network 10 that, together, provides at least a portion of the camouflage 21, and can include a number of the camouflage positional element(s) 11, as described with respect to FIG. 10. It is envisioned that certain camouflage positional element(s) within the network 10 can transmit camouflage information such as data and/or signals to other devices (e.g., to establish the camouflage). Certain embodiments of the camouflage positional element(s) 11 can utilize wireless communications (e.g., in certain embodiments at radio frequencies) therebetween.

As used herein, the term "mote(s)" can, depending on context, indicate a semi-autonomous computing, communication, camouflaging, actuating, and/or sensing as described in the mote literature (e.g., Intel Corporation's mote literature) as well as those fabricated by Crossbow Technologies, Inc., as well as equivalents recognized by those having skill in the art (e.g., Intel Corporation's smart dust projects), similar to as illustrated with respect to FIGS. 10 to 12. Those embodiments of camouflage positional element(s) that include and/or interact with motes, as described in this disclosure, are intended be illustrative in nature and not limiting in scope.

Other embodiments of camouflage positional element(s) may include a device other than a mote. While motes are described as being included in certain embodiments of the camouflage positional element(s) 11, it is be understood that other embodiments of the camouflage positional element(s) may not include the one or more motes since there may not be a clear delineation of motes. In certain instances therefore, whether a particular processing entity is or is not a mote may be subject to interpretation. In certain embodiments, it may be desired to physically separate a portion of the camouflage positional element(s) that performs processing on camouflage information from that portion of camouflage positional element(s) that camouflages as a result of the received camouflage information. In certain embodiments, it may be desired to utilize different technology from the mote technology to more effectively affect the camouflage presentation to achieve greater resolution, provide a more responsive camouflage response, and/or otherwise improve, alter, or quicken the imaging, positioning, or camouflaging processes.

A variety of wireless communication techniques can thereby be applied to a variety of networked camouflage positional element(s) to provide effective communication, actuation, illumination, etc. therein. Certain embodiments of the camouflage positional element(s) 11 can be configured to affect a variety of the camouflage presentation(s). Such camouflage information that can be used to affect the camouflage presentation can be transmitted, utilizing wireless (and/or in certain embodiments wired-based) communication techniques, between one or more camouflage positional element(s) 11 and/or, in certain embodiments, one or more computers/controllers 18 as described with respect to FIG. 10.

Certain embodiments of the camouflage positional element(s), either in the mote cloud such as described with respect to FIG. 3 or as attached to a substrate as described with respect to FIG. 1*b*, can be arranged in a variety of regular, irregular, and/or randomized configurations, perform a variety of operations, be constructed utilizing a variety of techniques and/or technologies, and be sized in a variety of dimensions. While the embodiments of camouflage positional element(s) as described with respect to FIG. 3 can be used to hide, mimic, distort, or obfuscate the target or object such as an aircraft on the ground, such techniques can be used to hide, mimic, or obfuscate aircraft in the air as well. When the camouflage positional element(s) are situated in a cloud, etc., they can be allowed to move independently with respect to the target and/or certain other camouflage positional element(s).

Figure 2:
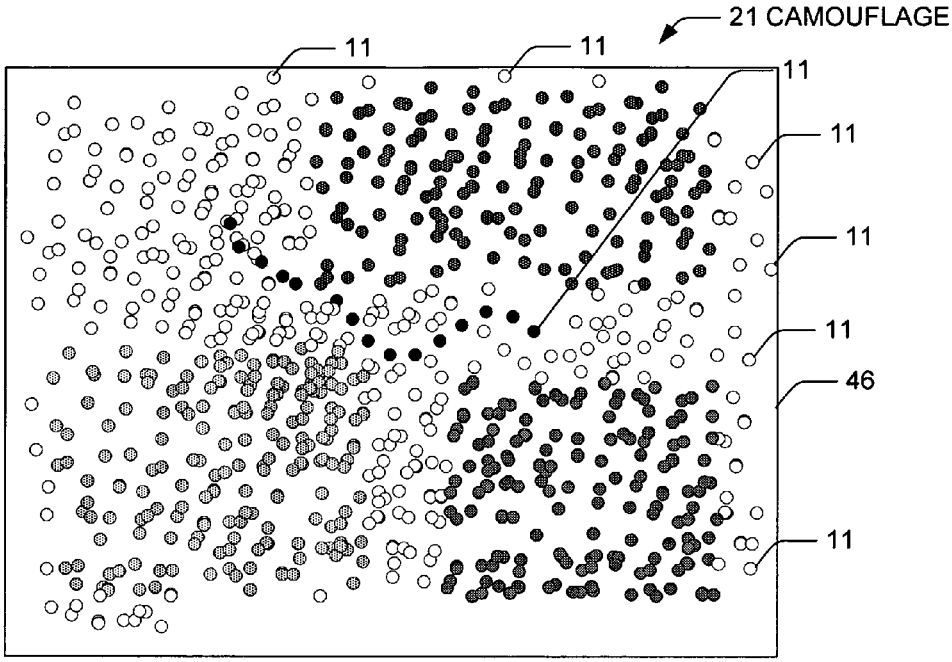
FIG. 2 is a diagram of one embodiment of the camouflage including the at least one camouflage positional element.

One embodiment of camouflage, as described with respect to FIG. 2, can be used to optically hide, mimic, or obfuscate a target such as a vehicle, person, or building with respect to the background. For instance, FIG. 2 illustrates an embodiment of the camouflage 21 that includes the at least one (e.g., a plurality of) camouflage positional element(s) 11 as described with respect to FIG. 1. The camouflage 21 can be situated about, on, situated to float or be located nearby, and/or within the target. In certain embodiments, the support for the camouflage positional element(s) 11 at least partially forming the camouflage can be either naturally occurring or man-made. A driver element can be added to support the camouflage positional element(s) 11, that is sufficient to support and/or suspend the camouflage positional element(s) for a sufficient duration to, for example, camouflage the target or object 23. Each of the camouflage positional element(s) as described with respect to FIG. 3 can be supported using an air, gaseous, liquid, or other fluid media that can be either contained or exist in the air, in outer-space, etc. In certain embodiments, the air, gaseous, fluid, or liquid media forming the fluid curtain (e.g., air or outer-space) can be clear, translucent, opaque, etc. to allow at least some of the light generated by the camouflage positional element that can be used for camouflaging, as described in this disclosure. The support for the camouflage positional element(s) can be provided within one, two, or three dimensions, as described in this disclosure.

In certain embodiments of the camouflage 21, certain ones of the camouflage positional element(s) can be "actuated" or "de-actuated" to be made more visible than other camouflage positional element(s) and thereby more effectively hide, mimic, or obfuscate the target or object. For example, certain ones of the at least one camouflage positional element(s) can controllably be made to conceal or blend in the target with respect to the background, or vice versa, as a result of their electromagnetic (or vibrations chemical traces, heat, or acoustics) emission, color, intensity, reflectivity, absorption, or other characteristics. One technique of camouflage can involve making certain camouflage positional element(s) a similar electromagnetic (or vibrations, chemical traces, heat, or acoustics) radiation, color, reflection, absorption, or other characteristics as the background, and therefore tend to hide or confuse the target into the background. Changing color, reflection, absorption, or other characteristics of the at least one camouflage positional element(s) can be utilized to affect the camouflage presentation (e.g., to achieve a goal), such as to camouflage the target with respect to the background. Such change in the color, reflection, absorption, other characteristics, or optical characteristics of the camouflage positional element(s) can occur as a result of the determining the position of the camouflage positional element(s), and thereupon determining a suitable camouflage presentation to affect.

As a result, certain camouflage positional element(s) 11 that are positioned at certain positions relative to the camouflage 21 (or using another camouflage coordinate system), can be camouflaged as being relatively dark to be concealed against dark portions of the background as described with respect to FIGS. 1*a* and 1*b*, while the camouflage positional element(s) that are situated at different positions will be camouflaged as being relatively light to be concealed against light portions of the background. As the dimensions of the camouflage positional element(s) increase and/or their illumination areas increase, the effectiveness of the camouflage may improve or detract accordingly since different sized camouflage positional element(s) may more likely tend to "hide" the target into the background. The particular pattern, shape, contour, or image, of the camouflage, and/or the target or object 23 that is being camouflaged, can vary as desired. In effect, each camouflage positional element(s) 11, as included in the camouflage 21, can be actuated or de-actuated depending on whether it can be used to more effectively affect the camouflage presentation, such as by using camouflage, etc. The embodiment of the camouflage positional element(s) 11 can be configured to provide an effective two-dimensional or three-dimensional camouflage.

The particular dimensions, shape, components, colors, optical characteristics, etc. of the camouflage positional element(s) is intended be illustrative in nature and not limiting in scope. As such, it is envisioned that a different device density of camouflage positional element(s) and/or different size of the camouflage positional element(s) may be considered in the camouflage 21. In certain embodiments, additional camouflage positional element(s) could be applied in proximity to existing camouflage positional element(s) to increase the density of the camouflage positional element(s). For example, if it is desired to improve the effectiveness of the camouflage than the number of the camouflage positional element(s) may be increased and/or their effective light-generating dimensions may be decreased. For use by viewers who are viewing closer to the camouflage, the dimensions of the camouflage positional element(s) and/or their number or density can be altered as appropriate or desired along one, two or three dimensions.

Certain embodiments of a two-dimensional or a three-dimensional camouflage including a driver or supporting element (not shown) such as a fan, blower, that can support the camouflage positional element(s), or configuration of the camouflage positional element(s) to support themselves (e.g. spinners, propellers, balloons, or other supporting devices). In certain embodiments, for example, reducing the height dimension (or other dimension) can effectively convert a three-dimensional camouflage to a two-dimensional camouflage. Additionally, in certain embodiments, a two-dimensional camouflage can be provided by affecting the camouflage presentation in which the camouflage positional element(s) are constrained, to follow a two-dimensional element, such as within a plate that the camouflage positional element(s) can be supported by the object, contained within the object, attached to the object, attracted to the object, secured to the object, etc.

In certain instances where a number of camouflage positional element(s) 11 might be displaced with respect to the target and/or the background to affect the camouflage 21, as described with respect to FIG. 2, those camouflage positional element(s) that are actuated but move out of an actuated region will become de-actuated. Additionally, those camouflage positional element(s) that are de-actuated, but move on to an actuated region will become actuated. As such, those particular camouflage positional element(s) that are being used by the camouflage 21 to affect a particular presentation (such as creating a particular camouflage, changing reflective or absorptive characteristics, etc.) may change as the target moves with respect to the background, and/or the background changes color, texture, etc.

Certain embodiments of the camouflage positional element may be physically displaced, while still affecting a suitable camouflage presentation or non-camouflage presentation. If the at least one camouflage positional element(s) 11 move, then different ones of the camouflage positional element(s) may have to be actuated or de-actuated to affect a suitable camouflage presentation. Also, if the shape, content, appearance, color, etc. of the camouflage 21 changes, then a different set of camouflage positional element(s) may have to be actuated or de-actuated to reflect the camouflage presentation being affected by the camouflage.

The optical-based embodiments of the camouflage positional element(s) that can affect a camouflage presentation can be mono-chromatic, multi-chromatic, or color. For example, in certain embodiments, certain ones of the camouflage positional element can change to one of brown, green, or blue to create a color camouflage. In other multi-chromatic embodiments, certain camouflage positional element(s) can be actuated (or de-actuated) to change to a single color such as blue, while other camouflage positional element(s) can be actuated to change to another color such as green or brown, etc. as such, a variety of embodiments of multi-chromatic camouflages can represent a variety of camouflage presentations to be affected. As such, each of the at least one camouflage positional element(s) 11 can be configured to affect camouflage presentations including color ranging from white to black, and each color in between.

FIG. 5 shows another embodiment of the camouflage positional element(s) that can be secured to a variety of substrates such as a wall, a fabric portion, or a window, etc. to provide the camouflage 21. As such, certain embodiments of the camouflage can be used to hide, mimic, or obfuscate buildings, vehicles, weapons, etc. One embodiment of fabric can include, for example, fiberglass that the camouflage positional elements can be situated on, and covered by resin. A number of camouflages 21 are described with respect to FIG. 5 to indicate that a variety of embodiments of the camouflage can be situated at different positions, situated on or attached to different materials, etc. Certain embodiments of the camouflage 21 may be related, be networked to each other, or operate similarly; while others may not be. The dimensions of the camouflage positional element(s) 11 can vary considerably in size, granularity, dimensions and/or uniformity of camouflage positional element(s), and/or a variety of other factors such as illustrated in FIG. 1*b*. It is envisioned that certain embodiments of the camouflage 21, as described with respect to FIG. 5, can be applied to a fixed building or structure, a home, an office, a commercial place, a business, a restaurant or bar, a vehicle, a weapon, or anywhere in which it may be desired to position the camouflage 21.

Certain embodiments of the camouflage positional element(s) 11 as described with respect to the camouflage 21 of FIG. 5 can be secured to the substrate 46 such as a substrate, wall, fabric, mesh, a billboard, etc. For instance, the camouflage positional element(s) 11 forming the camouflage situated on the substrate or wall can be attached, pasted, painted, fabricated, adhered to, tiled, or otherwise secured thereto. Certain embodiments of the "fabric" can include a composite material such as fiberglass. In certain embodiments, the thickness of the camouflage positional element(s) can equate to the thickness of the individual camouflage positional element(s) plus any substrate or adhesives used to secure the camouflage positional element(s). Although certain ones of the camouflage 21, as described in this disclosure are illustrated as being rectangular, it is envisioned that any form, size, or shape of camouflage can be provided. The dimension of the camouflage 21 can reflect the area that camouflage positional element(s) are attached, maintained within, displaced within, or otherwise supported by. As such, additional camouflage positional element(s) 11 can also be attached to an existing camouflage positional element to thereby increase the effective dimension, resolution, operating characteristics, etc. of the camouflage 21.

It would be possible, for example, to attach the camouflage positional element(s) to an entire wall, or any suitable portion thereof, included in a house, building, office, dwelling, billboard, external wall, etc. to effectively apply camouflage to the house, building, etc. In certain embodiments, the deactuated or actuated camouflage positional element(s) can be configured to be clear, opaque, or of the color of the background to appear hidden when not in use. As such, when image or the camouflage 21 is not being utilized, certain embodiments of the camouflage positional elements may appear hidden.

Also described with respect to FIG. 5 is an embodiment of the camouflage 21 that can be situated on the material (fabric or overlay) of the target or object 23 to be camouflaged. To create such a camouflage, at least one camouflage positional element(s) may be attached, secured, affixed, or otherwise positioned relative to the fabric, material, mesh, etc. forming at least a portion of the target or object 23 to be camouflaged. As such, the target or object 23 that can be covered by, or attached to by certain embodiments of the camouflage positional element(s), can affect the camouflage presentation, are truly limited only by the imagination of the user, the designer, and/or the operating characteristics of the camouflage positional element(s).

Certain embodiments of the camouflage 21 can also be situated on, between, behind, or otherwise relative to windows made of glass, plexiglas, or another material. For example, the camouflage positional element(s) can be affixed to or adhered to the glass of the window. In certain embodiments, the camouflage positional element, when deactuated, can be clear, opaque, or translucent to permit light to pass therethrough to not be overly visible when it is desired to not use the camouflage. Alternatively, the camouflage can be directed outward relative to the window such as to provide camouflage in one direction (outward), and a clear window in another (inward) direction. In certain embodiments, the color of certain embodiments of the camouflages situated on or in windows can be selected to improve viewing capabilities, appearance, etc.

Figure 7:
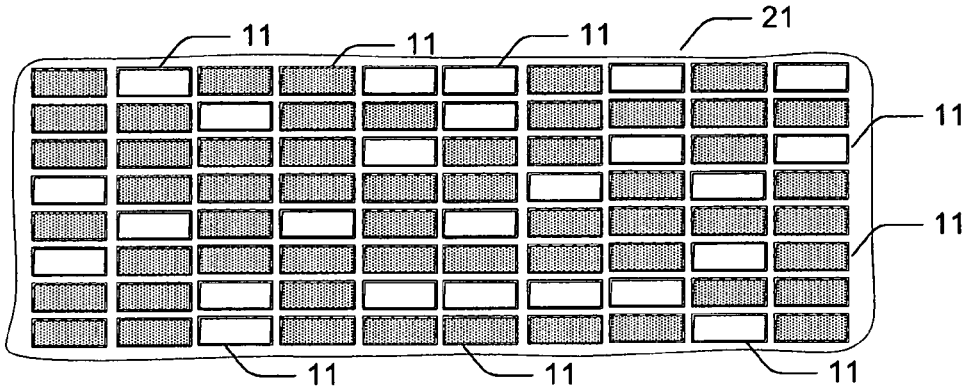
FIG. 7 is a plan view of an embodiment of the camouflage including the camouflage positional element(s) as secured to a substrate.

One embodiment of the camouflage 21 including a regular configuration of the at least one camouflage positional element(s) 11 is described with respect to FIG. 7. Such a regular configuration of the at least one camouflage positional element(s) can be fabricated using semiconductor processing techniques similar in many aspects to the techniques used to fabricate LEDs, LCDs, and/or other light or photonic generating devices. In addition to the light generating portion, each of the camouflage positional element(s) can be associated with the controller portion 19 and/or the computer controller 18. As such, certain embodiments of the controller portion 19 and/or the computer controller 18 as described with respect to FIG. 10 can control multiple ones of the at least one camouflage positional element(s).

Figure 8:
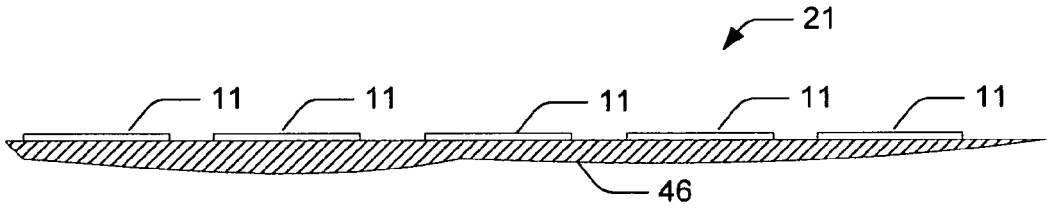
FIG. 8 is a partial cross-sectional view of another embodiment of the camouflage element including the at least one camouflage positional element.

Certain embodiments of the at least one camouflage positional element(s) 11 can be situated as discrete elements on the substrate 46, similar to as described with respect to FIG. 8. The substrate 46 can include, in different illustrative but not limiting embodiments, metal, paper, wood, a portion of a wall, a portion of a floor, the ground, a piece of furniture, a fabric, a mesh, a composite material, etc. In different embodiments, spacing between the at least one camouflage positional element(s) can be uniform or varied along two dimensions or three dimensions.

As such, a variety of devices can be utilized to determine positions of different embodiments of the at least one camouflage positional element(s) 11. By determining the position of the at least one camouflage positional element(s) 11, it can be determined what should be camouflaged thereupon to affect at least a portion of the camouflage presentation to provide the camouflage 21. Since there are a considerable variety of materials, substrates, fluid curtains, liquids having different viscosity, etc. that can support the at least one camouflage positional element(s), the camouflage positional element can often be expected to move at different rates depending upon how they are supported. As such, the controller portion 19 of the camouflage positional element 11, or alternatively the computer/controller 18 as described with respect to FIG. 10, should be adaptable depending upon the likely rate of movement of the particular camouflage positional element 11.

Certain embodiments of the camouflage positional element(s) may be attached to a jacket, pants, helmet, hat, shirt or other piece of clothing, a tattoo, or a piece of jewelry or a watch. As such, the clothing, tattoos, or jewelry, etc. can be configured to change color or appearance as desired to provide camouflage to a person, or even be configured to affect the camouflage presentation such as by using camouflage using the camouflage positional element(s). Certain embodiments of the camouflage positional element(s) can also be configured to be operated outdoors. Such camouflage positional element(s) should be configured to be able to withstand the particular operating characteristics (rain, snow, temperature variation, moisture, etc.) that they are likely to encounter, depending largely on the duration that they are likely to be operating. Other embodiments of the camouflage positional element(s) 11 may be configured to operate indoors.

The camouflage positional element(s), as described in this disclosure, can thereby perform a variety of camouflage operations that can be used in a variety of scenarios. Certain embodiments of the camouflage positional element(s) as described with respect to FIGS. 10 to 12 and throughout the remainder of this disclosure (and the control thereof such as provided by the computer/controller 18), are therefore intended to be illustrative in nature and not limiting in scope.

II. Examples of Configuration of Camouflage Positional Element(s)

This portion of the disclosure describes certain aspects of a variety of embodiments of the camouflage positional element(s) 11 that are configured in many embodiments to act as the camouflage 21. It is envisioned that certain embodiments of the camouflage can generate other non-camouflage features that can include but are not limited to sound, voice, temperature (heat and/or cool), visible gasses for appearance or effects, vibrations, chemical traces, biological, etc. Certain embodiments of the camouflage positional element(s) 11, as configured with respect to FIG. 10, can therefore include, but are not limited to, a communication interface 13, a functional camouflage portion 15, a power converter portion 17, a power source 25, and a controller portion 19. In certain embodiments, the communication interface 13 can be configured to provide communications of camouflage signals and/or transfer camouflage data with other camouflage positional element(s) 11 and/or the computer/controller 18 to allow the discrete camouflage positional element(s) to act as a unitary camouflage using networking techniques and/or systems. As such, the camouflage positional element(s) can affect a presentation other than the camouflage presentation in addition to affecting the camouflage presentation. In certain embodiments, the communication interface 13 can include an antenna 12 that may operate (send or receive electromagnetic radiation, vibrations, chemical traces, or acoustics) at radio frequencies, optical frequencies, infrared frequencies, etc. that can be configured to provide a wireless link between the camouflage positional element(s) and other camouflage positional element(s) or computer/controllers 18, etc. In certain embodiments, the antenna 12 can thereby provide a transmission of electromagnetic radiation, heat, vibrations, chemical traces, or acoustics (configured as signals and/or information) to other camouflage positional element(s) 11, the computer/controller 18, and/or other device(s).

Certain embodiments of the camouflage positional element(s) 11 can be configured to affect the camouflage presentation by, for example depending upon context, emitting light. A variety of such parameters that can be camouflaged are described with respect to the various devices as described with respect to FIGS. 10, 11, and 12. These parameters to be camouflaged, as well as the circuitry, software, hardware, and/or firmware of the camouflage positional element(s) to determine what to camouflage, are intended to be illustrative in nature and not limiting in scope. It is envisioned that the rate at which each of these individual parameters are camouflaged may be controlled depending upon the particular configuration and/or operating set-up of the camouflage positional element(s) 11. Operating the camouflage positional element(s) can include, but is not limited to: affecting the camouflage presentation for the camouflage positional element(s) 11, controlling input to the camouflage positional element(s), etc. In certain embodiments, the camouflage positional element(s) camouflaging rate of any or each of the camouflaged parameters can be controlled by the computer/controller 18.

In certain embodiments, the computer/controller can control the general camouflage operation of camouflage information (e.g., data, signals, etc.) by the camouflage positional element(s) 11. Certain embodiments of the computer/controller can be referred to herein and in general industry as a "base station" among those skilled in networking technologies.

Certain embodiments of the controller portion 19 can include, but is not limited to: a processor 605, a memory 607, a circuit 609, and an input/output (I/O) 611. The controller portion 19 in general, as well as its component, can rely on computing architecture and technologies, such as utilized by a microprocessor or microchip. FIG. 10 also illustrates the computer/controller 18 that can include similarly referenced components: 605, 607, 609, and 611, since this also is a computer-based device. The camouflage positional element(s) 11, as well as the device(s) 18 can each be provided with similar components having similar component reference characters 605, 607, 609, and 611. The components 605, 607, 609, and 611 can rely on similar computer architecture as understood by those skilled in the computer and/or controller technology. Each camouflage positional element(s) 11 or device(s) 18 can also rely on any combination of hardware, software, and/or firmware as is generally understood by those of ordinary skill in the computer and/or controller technologies. As such, any one of, or any combination of, the camouflage positional element 11 or device(s) 18 can perform certain camouflage positional elements.

Certain embodiments of the camouflage positional element(s) 11 can, depending upon fabrication technique and/or design be configured to be quite small. Certain embodiments of the camouflage positional element(s) 11 can measure less than an inch, or even a small fraction thereof. Therefore certain embodiments of the camouflage positional element(s) can be distributed in relatively large numbers within an area to affect the camouflage presentation. Miniaturization and operational concepts and designs, similar to as developed with certain embodiments of optical systems, microprocessors, microcomputers, motes, and the like can be applied to certain embodiments of camouflage positional element(s). Those embodiments of the camouflages 21 that are envisioned to be viewed closer to the user and/or for a longer duration may not generally include similar, more densely-packed camouflage positional element(s) that may be capable of providing a higher resolution or crisper image. As such, certain embodiments of the camouflage positional element(s) can be configured to perform their camouflaging or other operation functionality relatively unobtrusively. Additionally, many embodiments of the camouflage positional element(s) can be powered by the power source 25 that in certain embodiments can include a relatively low-power device (such as a battery that can be rechargeable or replaceable, or a power cell). For many of the reasons described in this disclosure, maintaining a longevity of operation for the power source can become an important consideration for many embodiments of this disclosure.

In certain embodiments, the power converter portion 17 can convert the power received into a form that can be used to power to camouflage positional element(s). For example, the power converter portion 17 can include an energy source that receives energy from another source, such as a solar panel, which in certain embodiments can be integrated in the power source 25 of the camouflage positional element(s) 11. The energy received from the power converter portion 17 can be converted to one that can be used to power the camouflage positional element(s) 11. In certain embodiments, the power converter portion 17 can be physically and/or operationally separated. In an alternate embodiment, energy contained in a received signal can be converted into frequency and/or form of energy that can be utilized by the camouflage positional element(s) 11 for power purposes. These and other configurations of operations of the communication interface 13, the functional camouflage portion 15, the power source 25, and the power converter portion 17, are provided as illustrated within this disclosure, and are not intended the limiting in scope.

Positioning certain embodiments of the camouflage positional element(s) can be challenging, especially considering the relatively small dimensions, large numbers, imprecision of distribution, and varied applications of certain embodiments of the camouflage positional element(s), etc. Certain embodiments of camouflage positional element(s) can be positioned in a variety of dangerous and/or difficult for a human to reach, access, repair, configure, and/or replace, etc. positions. For example, certain embodiments of camouflage positional element(s) can be attached to, impregnated in, or integrated in a composite (e.g., Kevlor, fiberglass, or other) member of an aircraft. As such, it may be difficult to service such camouflage positional element(s) such as by ensuring that they are operating properly, are properly configured, and are therefore capable of affecting a variety of camouflage presentations or performing a variety of operations.

Due to the relatively low cost of a variety of the individual camouflage positional element(s) compared with a variety of discrete components, it is envisioned that certain embodiments of the camouflage positional element(s) can be distributed in relatively large numbers such as to provide a gradient of camouflaged portions of images and/or provide a variety of related operations (such as within a relatively small area). As the technology of the camouflage positional element improves (e.g., due to diminishing size and/or improved semiconductor or other processing techniques), and the cost of the camouflage positional elements are reduced, the usage of the camouflage positional elements within the camouflages would become more commonplace or accepted. Many of the applications for the camouflage positional element(s) can rely on a considerable amount of reliability from the power portion.

The computer/controller 18 can be configured using a variety of computers and/or controllers, platforms, technologies, and/or techniques. For instance, the computer can be implemented in camouflage positional element(s), computer/controller, and/or other computer-based systems, as described with respect to FIG. 10. Many embodiments of the camouflage positional element(s) can be configured to determine positions of the camouflage positional element(s) 11, to control at least some camouflage presentation affecting operations by the camouflage positional element(s) 11, and/or receive, store, or otherwise process at least some image information that can be camouflaged from the camouflage positional element(s) 11 and/or the other device(s) 18. In certain embodiments, the computer/controller 18 can be configured as a standalone computer, a mote, a laptop computer, a desktop computer, a microprocessor, a microcomputer, a mainframe computer, and/or any other type of computer that can process data or other information relating to affecting the camouflage presentations such as provided by the camouflage positional element(s) 11 and/or the other device(s) 18. The configuration of the computer/controller 18, as described with respect to FIG. 10, is intended to be illustrative in nature depending on the context and not limiting in scope; more detail relating to the camouflage positional element(s) 11 or other device(s) 18 are provided in this disclosure.

While the computer/controller can be utilized in certain embodiments of the camouflage, other embodiments of the camouflage can be manually set or controlled. For instance, a camouflage operator could modify the settings of the camouflage positional element(s) by considering the suitable background, and thereupon manually set the level of the camouflage. FIGS. 11 and 12 each illustrate an embodiment of the camouflage positional element(s) 11. FIG. 11 shows an example of the camouflage positional element(s) 11 of the camouflage network 10 that may serve as a context for introducing one or more processes and/or devices described herein. Certain embodiments of the camouflage positional element(s) 11 can generally be configured to include camouflages, sensors, actuators, computational entities, and/or communications entities, depending upon their intended operation. The embodiment of the camouflage positional element(s) 11 of FIGS. 11 and/or 12 is illustrated as including the antenna 12, physical layer 104, antenna entity 119, network layer 108 (shown for sake of example as an appropriate ad hoc routing application), camouflage device entity 110, electrical/magnetic device entity 112, pressure device entity 114, temperature device entity 116, volume device entity 118, and inertial device entity 120. The particular camouflage device entities 110, 112, 114, 116, 118, and 120, as well as the other components in these figures, are intended to be illustrative in nature and not limiting in scope. Those entities that are selected can determine those parameters that the camouflage positional element(s) 11 can affect the camouflage presentation, as well as those operations that the camouflage positional element(s) can perform. Additionally, the camouflage positional element(s) 11 can be configured to provide a variety of operations and/or functions.

Certain embodiments of the physical layer 104, as provided within the camouflage positional element(s) 11, can provide for data transfer to/from a number of devices as described with respect to FIGS. 11 and/or 12, that allow for affect the camouflage presentation. Each of the respective camouflage device entity 110, electrical/magnetic device entity 112, pressure device entity 114, temperature device entity 116, volume device entity 118, antenna entity 119, and inertial device entity 120, as depicted, can couple through physical layers 104 using the respective camouflage 21, electrical/magnetic device 142, pressure device 144, temperature device 156, volume device 158, antenna 12, and inertial device 160. Those skilled in the art will appreciate that the herein described entities and/or devices are illustrative, and that other entities and/or devices consistent with the teachings herein may be substituted and/or added.

Those skilled in the art will appreciate that herein the term "device," as used in the context of devices comprising or coupled to the camouflage positional element(s) 11, is intended to represent but is not limited to transmitting devices and/or receiving devices dependent on context. In some exemplary contexts, the camouflage 21 can be implemented using one or more light transmitters (e.g., coherent light transmission devices or non-coherent light transmission devices) and/or one or more light receivers (e.g., coherent light reception devices or non-coherent light reception devices) and/or one or more supporting devices (e.g., optical filters, hardware, firmware, and/or software). As such, the camouflage 21 can perform a variety of light-emitting or light-receiving operations, upon actuation, by which camouflage information and/or camouflage data can be camouflaged, and as such the camouflage presentation can be affected.

Certain embodiments of the camouflage positional element(s) can actuate a variety of other devices which can affect one or more other-than camouflage presentations in addition to those device(s) that are necessary to affect the camouflage presentation, such as produce suitably electromagnetic radiation (or vibrations, heat, chemical traces, or acoustics) for the camouflage. For example, audio, sound, speech, vibration, chemical traces, heat, biological, and a variety of other-than camouflage presentation affects can be included in or actuated by certain embodiments of the camouflage positional element(s) 11. In some exemplary implementations, the electrical/magnetic device 142 can be implemented using one or more electrical/magnetic transmitters (e.g., electrical/magnetic transmission devices) and/or one or more electrical/magnetic receivers (e.g., electrical/magnetic reception devices) and/or one or more supporting devices (e.g., electrical/magnetic filters, supporting hardware, firmware, and/or software). An example of such a supporting device might be a heat producer that could act as a de-icer in certain portions of aircraft that may be equipped with the camouflage. In certain embodiments, the inertial device 160, for example, could be utilized by avionics of the aircraft, for example. As such, at least some of the camouflage positional element(s) as described in this disclosure could be utilized to provide a variety of functionality in addition to camouflage.

A large variety of camouflage presenting affects are within the intended scope of the present disclosure. In some exemplary implementations, the pressure device 144 can be implemented, e.g., using one or more pressure transmitters (e.g., pressure transmission devices) and/or one or more pressure receivers (e.g., pressure reception devices) and/or one or more supporting devices (e.g., supporting hardware, firmware, and/or software). In some exemplary implementations, the temperature device 156 can be implemented using one or more temperature transmitters (e.g., temperature transmission devices) and/or one or more temperature receivers (e.g., temperature reception devices) and/or one or more supporting devices (e.g., supporting hardware, firmware, and/or software). In some exemplary implementations, the volume device 158 can be implemented using one or more volume transmitters (e.g., gas/liquid transmission devices) and/or one or more volume receivers (e.g., gas/liquid reception devices) and/or one or more supporting devices (e.g., supporting hardware, firmware, and/or software). The examples of the devices that affect the other-than camouflage presentation, as described in this disclosure, are intended to be illustrative in nature and non-limiting in scope.

In some exemplary implementations, the inertial device 160 can be implemented using one or more inertial transmitters (e.g., inertial force transmission devices) and/or one or more inertial receivers (e.g., inertial force reception devices) and/or one or more supporting devices (e.g., supporting hardware, firmware, and/or software). Those skilled in the art will recognize that although a quasi-stack architecture can be utilized herein for clarity of presentation, other architectures may be substituted in light of the teachings herein. In addition, although not expressly shown, those having skill in the art will appreciate that entities and/or functions associated with concepts underlying Open System Interconnection (OSI) layer 2 (data link layers) and OSI layers 4-6 (transport-presentation layers) are present and active to allow/provide communications consistent with the teachings herein. Those having skill in the art will appreciate that these layers are not expressly shown/described herein for sake of clarity, and are not intended to be limiting in scope.

Certain embodiments of the camouflage positional element(s) can be configured to affect the camouflage presentation, such as to camouflage the camouflage positional element(s) 11 as described with respect to FIGS. 11 and/or 12. A variety of camouflages 21 that include the camouflage positional element(s) can be configured to camouflage a wide variety of parameters. Certain embodiments of the camouflage positional element(s) 11 can be configured so that designer and/or user of the camouflage positional element(s) 11 can determine or configure that camouflage information or camouflage data that the camouflage positional element(s) will camouflage. By comparison, certain embodiments of the camouflage positional element(s) 11 can be reconfigured during normal operation. During reconfiguration, certain embodiments of the camouflage positional element(s) 11 can be connected to or modified to the at least one camouflage 21, such as providing a new hardware, software, firmware, etc. During reconfiguration, other embodiments of the camouflage positional element(s) 11 can be reconfigured such that certain camouflages 21 that include the camouflage positional element(s) can be actuated, such as by reconfiguring the hardware, software, firmware, etc.

FIG. 12, depicts an exploded view of two embodiments of the camouflage positional element(s) 11, as described herein. The camouflage positional element(s) 11 can form a part of a camouflage network, in which the at least one camouflage positional element(s) can communicate with other camouflage positional element(s) and/or other devices. The camouflage positional element(s) 11 as described with respect to FIG. 12 is illustrated as similar to the camouflage positional element(s) 11 (e.g., described with respect to FIGS. 11 and 12), can include a log creation agent 202 and a device-addressed camouflage sensing/control log 204.

Device-addressed camouflage/control log 204, as described with respect to FIG. 12, as having illustrative entries of camouflage information, electrical/magnetic device information, pressure device information, temperature device information, volume device information, inertial device information, and antenna information. Certain embodiments of the camouflage information can correlate to a measure of the light or illumination to affect the camouflage presentation that can be provided by the camouflage 21 including the camouflage positional element(s) 11, which can include brightness, saturation, intensity, color, reflectivity, transmissivity, hue, power (e.g., watts), flux (e.g., lumens), irradiance (e.g., Watts/cm$^2$), illuminance (lumens/m$^2$, lumens/ft$^2$), pixel information (e.g., numbers of pixels (e.g., a small image capture device), relative pixel orientation)), etc. Examples of electrical/magnetic device information include measures of field strength, flux, current, voltage, etc. Examples of pressure device information include measures of gas pressure, fluid pressure, radiation pressure, mechanical pressure, etc. Examples of temperature device information include measures of temperature such as Kelvin, Centigrade, and Fahrenheit, etc. Examples of inertial device information include measures of force, measures of acceleration, deceleration, etc. Examples of antenna information include measures of signal power, antenna element position, relative phase orientations of antenna elements, delay line configurations of antenna elements, beam directions, field of regard directions, antenna types (e.g., a variety of antenna types that can include but are not limited to horn, biconical, array, Yagi, log-periodic, etc.).

In the implementation, as described with respect to FIG. 12, certain embodiments of a log creation agent 202 can be a computer program, that can be resident in the camouflage positional element(s) 11, that executes on a processor of the camouflage positional elements) 11 and that constructs and/or stores the camouflage sensing/control log 204 in memory of the camouflage positional element(s) 11. In some implementations, log creation agent 202 can be pre-installed on the camouflage positional element(s) 11 approximately when the camouflage positional element(s) 11 are added to the camouflage network. In other embodiments, the log creation agent 202 can crawl and/or is transmitted to the camouflage positional element(s) 11 from another position (e.g., a log creation agent at another camouflage positional element(s) or another networked computer (not shown) to thereby replicate or clone itself, and transmits that log clone to the camouflage positional element(s) 11). In yet other implementations, the log creation agent 202 can be installed at a proxy (not shown) for the camouflage positional element(s) 11.

The structure and operation of each camouflage positional element(s) 11, as described with respect to FIGS. 1*a*, 1*b*, 2, 3, 4, 5, 6*a*, or 6*b* are intended to be illustrative in nature, and represents a number of illustrative embodiments of the camouflage positional element(s) structure and operation. Certain embodiments of the camouflage positional element(s) 11 continue to undergo development, and it is to be understood that other camouflage positional element(s) 11 structures and operations (such as described in the articles, publications, and research as described herein) are also intended to be within the scope of the present disclosure as long as such camouflage positional element(s) structures and operations satisfy the claim limitations of the present application, as interpreted based on the present disclosure.

In certain embodiments of this disclosure, the systems and/or processes transfer their camouflage information (which may take the form of instructions, data, etc.) in a piecewise fashion over time. In some applications, the camouflage positional element(s) 11 can be considered as relatively low-power and/or low bandwidth devices, and thus in certain implementations the system(s) and process(es) described herein allow many minutes (e.g., hours, days, or even weeks) for herein described agents and/or processes to migrate to and establish themselves at various camouflage positional element(s) 11. The same can be true for transmission of camouflage information among the camouflage positional element(s) 11 in that in some implementations such transmission may be done over the course of hours, days, or even weeks depending upon bandwidth, power, and/or other constraints. In other implementations, the migrations and/or transmissions are accomplished more rapidly, and in some cases may be accomplished as rapidly as possible.

Certain embodiments of the camouflage positional element(s) 11 can include logic (which may be integrated using software, hardware, and/or firmware, and also may be installed within a memory) that may be applied to cause the at least one camouflage positional element(s) 11 to facilitate acts as described herein.

Figure 15:
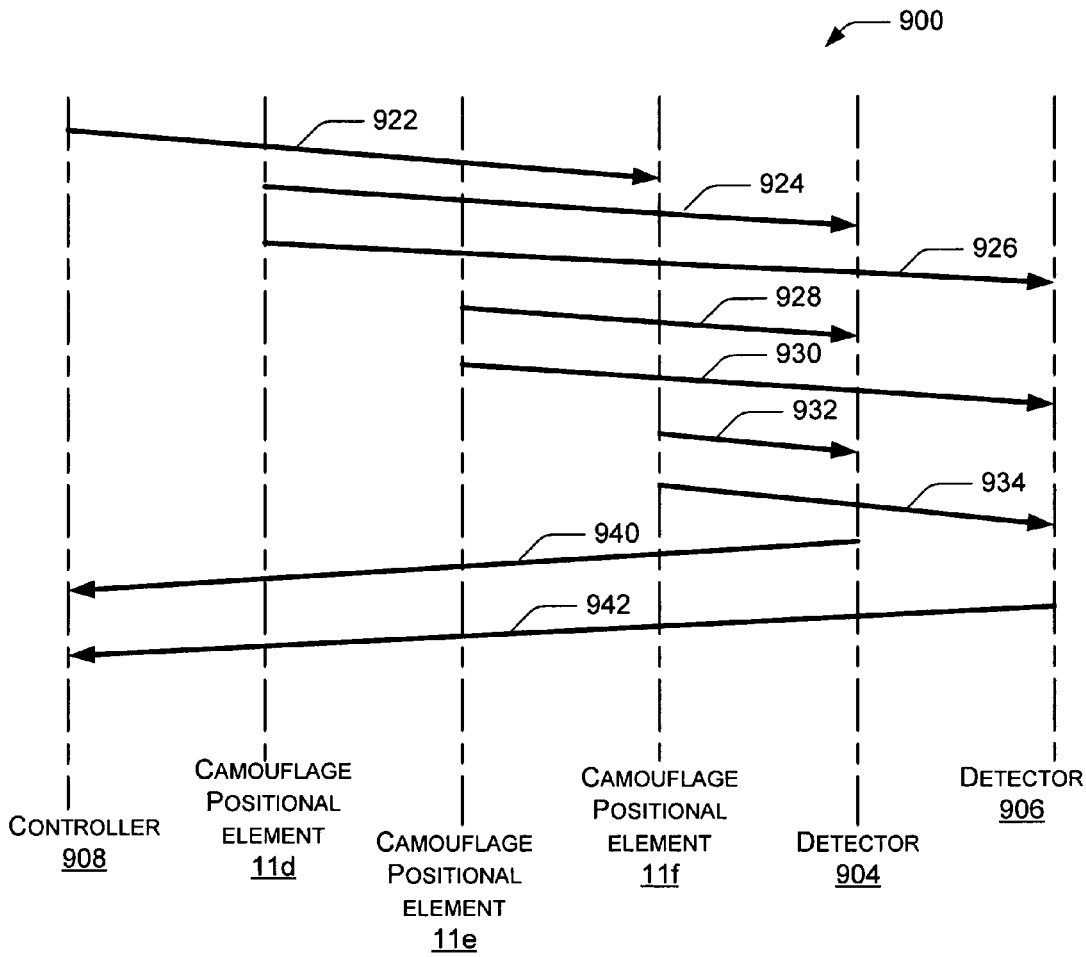
FIG. 15 is a signal diagram of signals transmitted between the at least one camouflage positional element and other devices.

FIG. 15 shows a flow diagram of one illustrative (but non-limiting) embodiment of a process of determining positions of the at least one camouflage positional element(s) 11, and one illustrative embodiment of the signaling that can be associated therewith. Other embodiments, which are within the scope of the appended claims can be considered as within the scope of the present disclosure. In one embodiment, the controller 908 as described with respect to FIG. 15 may generate a signal 922 that indicates an attempt to position the at least one camouflage positional element(s) 11. With signal 922, the controller 908 as described with respect to FIG. 10 (which may be integrated within the camouflage positional element 11, another camouflage positional element, and/or one or more computers/controller 18 such as the base station) can provide a signal to the at least one camouflage positional element(s) 11. In some cases, the signal 922 may be provided to those camouflage positional element(s) 11 that are positioned closest to the controller, or to the at least one camouflage positional element(s) 11 that are specifically enabled to recognize the controller signal. Other scenarios of signaling selected or unselected camouflage positional element(s) may also be utilized. In some implementations, the controller 908 may in fact form a part of the network signaled, or alternatively may be remote from the network.

Certain embodiments of the at least one camouflage positional element(s) 11 (e.g., 11*d*, 11*e*, 11*f*, etc.) that receive the signal 922 can thereupon respond with position information, such as by transmitting data that can indicate their relative position within the network, relative to the camouflage 21, their geographic positions; or alternatively activating a light-emitting device at their present position that can be detected to position the at least one camouflage positional element(s) 11. Certain embodiments of the response(s) (e.g., 924, 926, 928, 930, 932, and/or 934) may be recorded or detected by various detectors at different positions. For example, certain embodiments of the respective response(s) 924, 926 that can be generated by the respective at least one camouflage positional element(s) 11*d*, 11*e* may be recorded by respective detectors 904, 906. Additionally, certain embodiments of the respective response(s) 928, 930 as generated by the respective at least one camouflage positional element(s) 11*d*, 11*e* may be recorded by respective detectors 904, 906. Also, the certain embodiments of the respective response(s) 932, 934 as generated by the respective at least one camouflage positional element(s) 11*e*, 11*f* may be recorded by the respective detectors 904, 906. The respective detectors 904 and 906 can thereupon receive the responses to the controller 908 using the signals as described with respect to FIG. 15.

Certain embodiments of the respective detectors 904 and 906 may provide respective recorded responses 940, 942 (that pertain to the camouflage positional element(s)) that are to be received by the controller 908. In certain embodiments, as described above, the controller 908 may be included alternatively in the camouflage positional element 11, and/or the computer/controller 18 as described with respect to FIG. 10. In certain embodiments, the controller 908 may then thereupon process the recorded responses 940, 942 into graphical indications of camouflage positional element position and/or layout.

III. Examples of Determining Camouflage Positional Element(s) Position

For a camouflage positional element to determine what color or intensity of light it should generate (and/or cause to be generated) to affect the visual presentation, it initially has to be determined where the camouflage positional element (and the generated light) is positioned. Similarly, a picture element (pixel) used as camouflage might generate light of a particular color or intensity based on its position across the traditional monitor. This portion of the disclosure describes communications between multiple camouflage positional element(s) and/or other devices such as can utilize signaling, as described herein.

Certain embodiments of the camouflage positional element(s) 11 can further comprise a communication interface, which may be configured as desired using hardware, software, firmware, etc. to provide communications with other camouflage positional element(s), controllers, computers, or devices. The camouflage positional element(s) 11 may employ certain embodiments of the communication interface to communicate with other camouflage positional element(s) 11 and/or other devices. Communication between different camouflage positional element(s) 11 may be accomplished in certain embodiments at least partially wirelessly utilizing electromagnetic radiation (or vibrations, chemical traces, heat, or acoustics) at, e.g., a radio frequency, a light frequency, an acoustic frequency, or by other wireless and/or wired-based communication mechanisms known in the art. In other embodiments, at least a portion of the communication interface can include a wired portion. As such, communications can be provided using wireless communications, wired communications, and/or a combination thereof.

Camouflage positional element(s) 11 may further comprises an actuator/camouflage (not shown). As such, each camouflage positional element(s) 11 can include none, one, or more actuator(s), as well as none, one, or more sensor(s). Certain embodiments of the actuator/camouflage may thereby affect a presentation and/or affect the visual presentation. Not all embodiments will include these additional features to affect the presentation, but they may be present in others.

A variety of device(s) (not shown) can be operationally associated with and may interact with the at least one camouflage positional element(s) 11. The device may include, for example, a controller device, a wireless device, a communication device, a testing device, a monitoring device, a sensing device, or a computer device (configured as, for example, a personal computer, a laptop computer, a desktop computer, a handheld computing device), one wireless device such as a digital assistant or a phone, an industrial device, or test equipment, to name just some of the possibilities. The device can include, e.g., logic such as is known to facilitate activities described within this disclosure. Certain embodiments of the system can include, for example: camouflages 21 that can be situated at a variety of different positions to, for example, camouflage.

It is envisioned that the embodiments of the camouflage positional element(s) 11 can vary considerably in size, but many are intended be relatively small, such as of less than an 1 inch across, and sometimes a fraction of that. Due to the relatively small size of many embodiments of the camouflage positional element(s) 11, a relatively large number of camouflage positional element(s) 11 may be distributed across or within an area and/or volume. The particular dimension(s), configuration(s), and/or operability(s) of the camouflage positional element(s) 11 can be selected and/or designed for based largely on where a typical or particular viewer would be situated with respect to the camouflage. Due to the autonomy of potential operations between different ones of multiple embodiments of camouflage positional element(s) 11, it can be important to maintain up-to-date information about the position and/or relative layout of the at least one camouflage positional element(s) 11, which can therefore allow communication(s) and/or data transfer(s) therebetween, such as can be used to create camouflage. Certain embodiments of the camouflage positional element(s) 11 can be designed to be self-configuring. As such, a number of camouflage positional element(s) 11 may be positioned at a prescribed position such as within a structure, field, building, etc. Certain embodiments of the camouflage positional element(s) 11 can utilize self configuring techniques to effectively establish the camouflage positional element(s) 11, that can include at least one of the camouflage positional element(s) 11, and typically many of the camouflage positional element(s). It may not be important that all camouflage positional element(s) 11 within a network (such as can form the camouflage) can contain all of the data relating to that network. It may be important, however, at least certain camouflage positional element(s) 11 that are situated within the camouflage (e.g., that may be configured as a network) can therefore be able to configure themselves and others appropriately, and thereupon transfer at least some data and/or information relating to the camouflage positional element(s) 11 therebetween.

To facilitate determination of position and/or layout of the camouflage positional element(s) 11, at least one signal may be communicated between the camouflage positional element(s) 11 (henceforth, 'signaling the camouflage positional element(s)'), which may result in one or more return signals being returned to the camouflage positional element. The position of the camouflage positional element(s) 11 may be derivable from the positional information being transferred within the signal and/or the return signal. Although the camouflage positional element(s) 11 may not have sufficient power to communicate back to an external source, it may be possible for their neighbor(s) to detect the response signals and forward the signal to a desired position.

Between certain embodiments of the camouflage positional element(s) 11 and/or other devices, signaling may be accomplished wirelessly, for example, utilizing some form of electromagnetic radiation (or vibrations, chemical traces, heat, or acoustics) such as sound or light signals. In certain embodiments, those camouflage positional element(s) 11 that receive a signal may harness the energy of the signaling to provide one or more return signals. In certain embodiments, the camouflage positional element(s) 11 may provide a phosphorescent response to signaling with light. For example, the camouflage positional element(s) 11 may be present in a dark nighttime or underwater environment. When stimulated by a quick, intense light pulse, the camouflage positional element(s) 11 may phosphoresce, thus providing a marker to their position which could be viewed by a person, camera, recording device, etc.

The camouflage positional element(s) 11 may be signaled from one or more positions external and/or internal to the at least one camouflage positional element(s) 11. The signal may be provided to at least some camouflage positional element(s) 11 more or less simultaneously, or may propagate through the network including the camouflage positional element(s) 11. Thus, some camouflage positional element(s) 11 may receive the signal to report position, and the first camouflage positional element(s) 11 to receive the signal may provide one or more return signals, and may signal one or more neighbor camouflage positional element(s) 11 to provide a position, etc. The neighbor camouflage positional element(s) 11 may provide one or more return signals, signal their neighbors, and so on. For example, certain embodiments of the camouflage positional element(s) 11 may be a part of a security system over the camouflage. The device(s) (not shown) may communicate to the nearest camouflage positional element(s) 11 using the camouflage positional element's communication interface (not shown), causing the camouflage positional element(s) 11 to respond with position information and signal its neighbor camouflage positional element(s) 11. The neighbor camouflage positional element(s) 11 may then respond to camouflage positional element(s) 11 with its position information, which the camouflage positional element(s) 11 will pass on to the device. The camouflage positional element(s) 11 may signal neighbor camouflage positional element(s) 11, resulting in multiple ones of the camouflage positional element(s) communicating their position among themselves and/or to/from other devices.

Signaling the camouflage positional element(s) 11 may cause the camouflage positional element(s) to return some of the identifying information or camouflage information such as at least one device identification (id). The device id may be used to identify those camouflage positional element(s) 11 that are responding. In general, the camouflage positional element(s) 11 may respond to the signaling in any manner that distinguishes the camouflage positional element(s) 11 within the network. For example, the camouflage positional element(s) 11 may respond with (a) one or more wireless identifiers, (b) one or more distinguishing light patterns and/or colors, or (c) one or more distinguishing sounds and/or tones. For example, certain embodiments of the camouflage positional element(s) 11 communicating relative position information wirelessly may include a unique name, such as their wireless device identifier as part of the communication. The camouflage positional element(s) 11 responding with light signals may flash in a pattern, for example, if the last two digits of their device number is 21 flashing 21 times. The camouflage positional element(s) 11 responding using sound may respond with a particular tone, for example, by modifying the frequency of response from a base tone by adjusting an amount dependent on the camouflage positional element(s) identifier.

In certain instances, the type, characteristics, or state of the camouflage positional element(s) 11 may be indicated by the camouflage positional element response. For example, the camouflage positional element(s) 11 affecting a first visual presentation might respond to a signal by generating light at a first (e.g., red) wavelength to be camouflaged at a position of the camouflage 21. The camouflage positional element(s) 11 affecting a second visual presentation might respond by generating light at another (e.g., yellow) wavelength to be camouflaged at another position of the camouflage 21.

In some implementations the signaling may cause the camouflage positional element(s) 11 to provide return signals indicative of its position relative to other camouflage positional element(s) 11, as was discussed in the example where the camouflage positional element(s) 11 returned information identifying their neighbors. In some implementations, signaling the camouflage positional element(s) 11 may cause the camouflage positional element(s) 11 to provide return signals indicative of a position of the camouflage positional element(s) 11.

Some implementations may involve both types of information; certain camouflage positional element(s) 11 may provide signals indicative of their position relative to other camouflage positional element(s) 11, and certain camouflage positional element(s) 11 may return signals indicative of an absolute position. For example, certain embodiments of camouflage positional element(s) 11 used, for example, in a security system camouflaging to a large outdoor area may be of at least two types. Some camouflage positional element(s) 11 may comprise GPS positional capability and communication interfaces. Other camouflage positional element(s) 11 may comprise various relative position and a communication interface. The position of the camouflage positional element(s) 11 may in certain instances be inferred by the known position of a reference neighbor, using calculations of their approximate distance to that reference neighbor made using ultrasound or in some other technique.

Some implementations of the camouflage positional element(s) 11 may be signaled to provide return signals indicative of offsets from one or more previous positions. For example, in some implementations camouflage positional element(s) 11 (such as "robot camouflage positional element(s)") may be provided with a capability for directed and controllable movement. Certain embodiments of camouflage positional element(s) can also provide the camouflage positional element(s) 11 with a capability to calculate how far and/or in what direction they have moved. Thus, the camouflage positional element(s) 11 may, as required, return information on their movement from an initial or previous position.

To prevent false return signals, a "prep" signal may be provided to the camouflage positional element(s) 11, to prepare the camouflage positional element(s) 11 for a subsequent signal to report positional information. Thus, a first signal to the camouflage positional element(s) 11 may cause other camouflage positional element(s) or other devices to be responsive to at least one subsequent signal to report its position. In certain instances, first two occurrences of the pattern act as a prep signal, the third as a trigger.

If frequent shifts in the relative of geographic position of the camouflage positional element(s) 11 are expected, periodically (possibly automatic) signaling may be applied to cause the camouflage positional element(s) 11 to periodically provide return signals indicative of their position. For example, the camouflage positional element(s) 11 having neutral buoyancy may have been spread over a large lake, whereby they might be expected to follow currents throughout the lake. In addition, certain camouflage positional element(s) included within the camouflage positional element supporting region 264 may shift frequently. The camouflage positional element(s) 11 may be queried periodically so that each might identify their current position.

In some implementations, the positions/layout may be expected to shift under certain conditions. In these situations signaling the camouflage positional element(s) 11 may involve signaling to indicate their positions upon occurrence of one or more events and/or conditions associated with changes in camouflage positional element 11 position/layout (henceforth, 'conditional signaling of the camouflage positional element(s)'). For example, the camouflage positional element(s) 11 may be signaled for position indications for the camouflage positional element(s) 11 that provide out-of-range measurements. Certain ones of the camouflage positional element(s) 11 may have shifted beyond their functional boundaries.

Conditional signaling of the camouflage positional element(s) 11 may involve signaling to cause the camouflage positional element(s) 11 that can provide signals indicative of their position upon receiving indications of a positional change from the camouflage positional element(s) 11, or of the position of the camouflage overall (e.g. the entire camouflage has moved). Conditional signaling of the camouflage positional element(s) 11 may take place as a result of turbulence in one or more media including the camouflage positional element(s). Such triggering events may occur, for example, if the camouflage positional element(s) 11 are situated in the air as those that can be configured as at least portions of billboards, then winds may trigger the signaling. Also if the camouflage positional element(s) 11 are situated in water and/or supported by a fluid or air curtain, currents, fluid flows, or waves may trigger the signaling, etc. It may be advantageous, in certain embodiments of the camouflage positional element(s) 11 to provide conditional signaling of the camouflage positional element(s) 11 in such illustrative, but non-limiting, instances as to determine their position. Recognition that the camouflage positional element(s) 11 may have moved or otherwise changed may occur or be detected using a mechanism that is situated either within, or external to, the camouflage positional element(s) 11. Similarly, the signal which causes the relative position determining response may come from either somewhere within or external to the camouflage positional element(s) 11. Such information that the camouflage positional element(s) have moved should be considered as one embodiment of camouflage information, such as to indicate where the camouflage positional element(s) are positioned.

Certain signals returned by camouflage positional element(s) 11 may be received and processed by one or more devices external to the camouflage positional element(s) 11. Some instances may employ external processing of the positional information, whereas others will involve internal processing of the positional information by the camouflage positional element(s) 11 itself. In some situations, both techniques may be employed.

The return signals may be processed to determine which camouflage positional element(s) 11 have changed their position (henceforth, 'camouflage positional element(s) movement determination'). In some cases where internal processing is employed. Movement determination of the camouflage positional element(s) 11 may involve processing using one or more camouflage positional element(s) 11 to process the one or more return signals (of the neighbor camouflage positional element(s) 11) to facilitate the determinations of whether they or their neighbor camouflage positional element(s) 11 have changed positions. In the example given previously where the camouflage positional element(s) 11 report their neighbors and this information is passed between camouflage positional element(s) 11, such as to a desired data processing position, the signal strength of the received messages could be identified by each receiving camouflage positional element(s) 11. The signal strength/distance analysis could be performed either by the receiving camouflage positional element(s) 11 or elsewhere, possibly at a central information gathering point such as the device (not shown) such as a controller or computer. Whenever the received signal strength was very close in value to that previously received, a determination of little or no movement of the camouflage positional element(s) may result.

In some implementations, signals may be repeatedly applied to certain embodiments of the camouflage positional element(s) 11. Photos of emitted light, or other response indications of camouflage positional element(s) 11 position, may be captured. When light is emitted in response, one or more combined photos may be created that include the captured information. In this manner, a visual record may be compiled indicating which camouflage positional element(s) 11 have changed position, and their relative layout. A measured topology (layout) of the camouflage positional element(s) 11 may be compared with desired or expected topologies, to determine deviations from the expected or desired layout.

Stereoscopic applications may involve camouflage positional element(s) 11 providing return signals via light (e.g. the camouflage positional element(s) 11 are actuated such as by lighting up in response to the signaling). Return signals may be captured by two or more devices (e.g. antenna entity 119 and/or inertial device entity 120) that are situated in different places. The captured return signals may be applied to facilitate 2-D or 3-D position determinations for the responding camouflage positional element(s) 11. Stereoscopic applications involving microphones and acoustic responses are also possible that can improve positioning within one, two, or three dimensions.

Certain embodiments of the camouflage positional element(s) 11 may monitor changes in its own position and/or layout. Certain embodiments of the camouflage positional element(s) 11 may signal other camouflage positional element(s) 11 for the signaled positional information (henceforth, 'camouflage positional element(s) signaling') from which it can derive its own position using, e.g., camouflage information and/or camouflage data.

Certain embodiments of the camouflage positional element(s) 11 signaling may involve signaling neighboring camouflage positional element(s) to provide return signals indicative of position, when the neighboring camouflage positional element(s) 11 provide out-of-range readings. Out-of-range readings by a neighbor camouflage positional element(s) 11 may indicate the camouflage positional element has shifted position and is no longer within the functional bounds of the camouflage positional element(s) 11. For example, if the camouflage positional element(s) 11 becomes dislodged from its position and blows out into a room, it may start providing temperature readings of lesser value than its presumed (based on its previous position) neighbor(s) on either side. This may cause some of the camouflage positional element(s) 11 to signal it to ascertain its position and/or a position of another camouflage positional element.

In certain implementations, camouflage positional element(s) 11 signaling may involve a camouflage positional element(s) 11 signaling their neighbors for positional information, and when the neighbors fail to respond as expected, and/or when the neighbors provide a signal that is below an expected signal strength. These conditions may indicate that the neighbor camouflage positional element(s) 11(s) have shifted out of bounds. In the ductwork example provided above, the camouflage positional element(s) may be so distant that its previous neighbor camouflage positional element(s) 11 do not receive its communications. Alternatively, the camouflage positional element(s) 11 may be sending signals which are received as "weak". Either of these situations may cause the neighbor camouflage positional element(s) 11 to initiate signaling of the camouflage positional element(s) 11 in an attempt to ascertain its current position.

This disclosure describes a variety of signaling related to as least one camouflage positional element(s) 11. The camouflage positional element(s) 11 may be signaled for more than just position information. For example, the camouflage positional element(s) 11 may be signaled to provide return signals indicative of its position, status, and/or condition. Examples of status/condition include whether the camouflage positional element(s) 11 are functioning normally, have stored data available, are in communication with their neighbors, or for a variety of other reasons.

In certain embodiments of camouflage positional elements, a visual map and/or layout including graphical indications of the position of camouflage positional element(s) 11 may be constructed and/or refined according to received indications of the positions of camouflage positional element(s) 11. Certain embodiments of a virtual map can be used to provide positional information and/or data pertaining to the camouflage positional element(s). One or more 2D and/or 3-D maps and/or models of the camouflage positional element(s) 11 may be formed according to the received indications of their position. This may involve overlaying position indications on camouflage representing the environment of the camouflage positional element(s) 11. The graphical position indications may in some implementations be camouflaged via a projection system, via glasses that a person wears, on a screen, or via a heads-up camouflage, for example.

Received indications of position of camouflage positional element(s) 11 may include photographs or other representations of the camouflage positional element(s) 11. The camouflage positional element(s) 11 may respond to signaling with light, and these light responses may be captured by a camera and used to construct a map/layout of their positions.

Graphical position indications may indicate which camouflage positional element(s) 11 have changed position or which are in a wrong or unexpected position. The graphical indications may also or alternatively indicate which camouflage positional element(s) 11 are absent or not functioning at an expected position. Normally working camouflage positional element(s) 11 may be shown in with green, yellow, or orange circles, depending on the temperatures they are reporting. The position of a suspect or non-working camouflage positional element(s) 11 may be indicated.

In general, the graphical indications may reflect one or more received indications of the status and/or condition of the camouflage positional element(s) 11, and/or overall statuses and/or conditions of the camouflage 21 itself. Certain positions of the camouflage positional element(s) 11 may be distinctively captured by a graphic. When suspect conditions are found to be pervasive or prevalent, for example if several of the camouflage positional element(s) 11 in a camouflage network are no longer reporting data or are reporting suspect data, an overall camouflage positional element(s) 11 graphic or menu might be shown having different color, flashing, with more bold, or in any other visually distinctive manner. For example, a map camouflaging all camouflage positional element positions might have its borders flashing red.

To configure the at least one camouflage positional element(s) as a camouflage, certain embodiments of the camouflage positional element(s) determine where they are situated relative to the camouflage or some other coordinate system (e.g., a wall, a piece of furniture, a building, a lake, a fluid-curtain, the air, etc.). One technique that can be used to determine the position of the camouflage positional element(s) is, for each dimension of the camouflage, to scan a beam of identifiable electromagnetic radiation, heat, vibrations, chemical traces, or acoustics along the camouflage positional element(s) of the camouflage.

In an alternate embodiment, when the at least one camouflage positional element(s) 11 of the camouflage 21 senses the increase in electromagnetic radiation, heat, acoustics, chemical traces, or vibrations then the camouflage positional element(s) will transmit an indication to the scanner, other controller/computer, or controller portion of the camouflage positional element(s) along with a device identifier. Thereupon, the scanner, other controller/computer, or controller portion of the camouflage positional element(s) can derive the position of the camouflage positional element(s) which can thereupon be transmitted to the particular camouflage positional element(s). Other similar scanning and/or networking techniques can be used to determine the position of the positional camouflage along a single axis. Thereupon, the position of the at least one camouflage positional element(s) can be derived along each remaining axis of the camouflage (e.g., in along the Y-axis and/or the Z-axis).

In still other embodiments, those embodiment(s) of the camouflage positional element(s) that can determine their position relative to some position can utilize that determined position. For example, four camouflage positional element(s) can be positively situated at each corner position of the camouflage. Using wireless communications that can derive distance from other camouflage positional element(s) using geometric derivations, such with motes (included in certain embodiments of the camouflage positional element(s) as described herein), the at least one camouflage positional element(s) can determine its position across the camouflage in one, two, or three dimensions.

Such determination of the position of the camouflage positional element(s) with respect to the camouflage can be performed frequently for those camouflage positional element(s) that move frequently with respect to the camouflage. By comparison, the determination of the position of the camouflage positional element(s) with respect to the camouflage may be performed infrequently or hardly ever for those camouflage positional element(s) that are static with respect to the camouflage.

In certain embodiments of the camouflage, it may be desired to add additional camouflage positional element(s) to existing camouflage positional element(s), such as to improve resolution, color, performance, operating parameters, and/or other desirable aspects. Such additional camouflage positional element(s) can be added at one or more periods after the original camouflage positional element(s), perhaps after the resolution or other technology improves. In certain embodiments, the additional camouflage positional element(s) can be added to compensate for an undesirable operation of the original camouflage positional element(s). Following the positioning of the additional camouflage positional element(s), the additional camouflage positional element(s) could determine their position either relative to other previously-scanned camouflage positional element(s) (which have the capability of determining relative positioning), based on another scanning to determine position as described above, and or other similar networking or positioning techniques to determine the position. As the positions of the additional camouflage positional element(s) are determined, the original camouflage positional element(s) and the additional camouflage positional element(s) can operate together as the camouflage.

Figure 13:
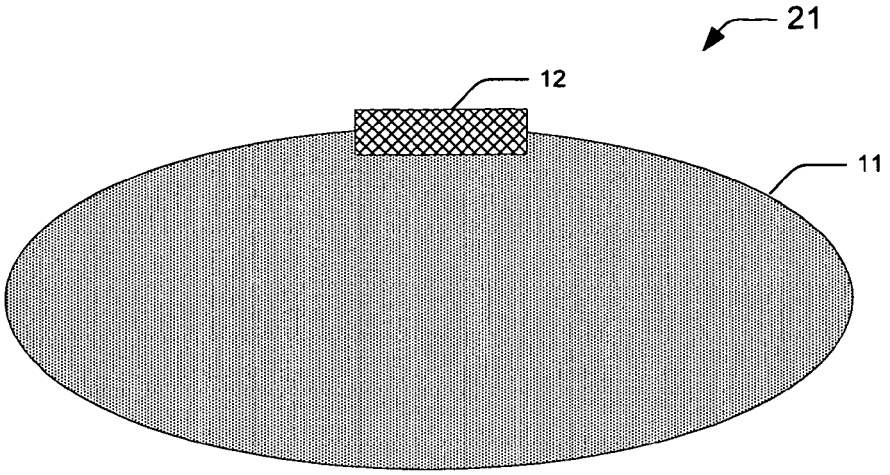
FIG. 13 is a diagram of one embodiment of the at least one camouflage positional element.
Figure 14:
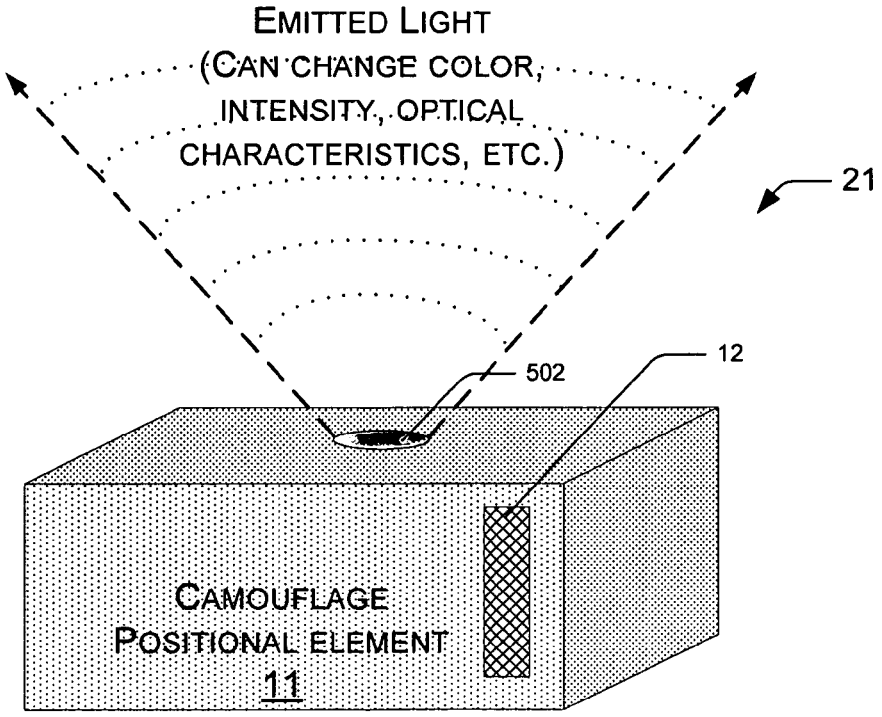
FIG. 14 is a diagram of another embodiment of the at least one camouflage positional element.

IV. Examples of Electromagnetic Radiation, Heat, Vibration, Chemical Traces, and/or Acoustics Emission, Reflection, or Absorbance with Camouflage Positional Element There are a variety of techniques by which the camouflage positional element(s) 11 can generate light, or cause light to be generated, such as could be used to provide at least a portion of the camouflage. The particular shape or surface configuration of the camouflage positional element(s) 11 (and the associated antenna to the camouflage positional element(s)) as illustrated in FIGS. 13 and 14 are intended to be illustrative in nature, and not limiting in scope. Camouflage positional element(s) can be constructed or fabricated in any desired shape. The embodiment of the camouflage positional element(s) 11, as described with respect to FIG. 13, can be configured such that at least one of its surfaces changes color to identify to a maintaining person or maintaining device when it should be maintained. In one embodiment of the camouflage positional element(s) 11 as described with respect to FIG. 13, the color of at least a portion of a surface of the camouflage positional element can be changed, for example, to change a color produced by a portion of the camouflage. Such change in color(s) of the camouflage positional element(s) can be observed by a person or a mechanism looking at the camouflage. Liquid Crystal Displays (LCD) provide one embodiment of devices that change colors to alter a camouflaged color. Certain embodiments of the camouflage positional element(s) can be included in a passive camouflage in which at least some light reflects off, or travels through, the camouflage positional element(s). Certain embodiments of the camouflage positional element(s) can be included in an active camouflage in which at least some light is applied to, and passes through, the camouflage positional element(s) of the camouflage. FIG. 14 illustrates another embodiment of the at least one camouflage positional element that can emit electromagnetic radiation (or vibrations, chemical traces, heat, or acoustics) to affect the camouflage presentation.

Another example of a camouflage positional element that can be used to change color for at least a portion of the camouflage may allow a mechanical change in color, such as may include coloring different surfaces of the camouflage positional element(s) in two colors. As such, during normal operation, one color of the camouflage positional element(s) that is typically facing upwards will be painted a first color (not shown). As particular camouflage positional element(s) are identified as those to be maintained, the camouflage positional element(s) can be "flipped over" using, e.g., some maintaining devices, identifying device, or even a positional actuator located within the camouflage positional element(s) itself, such that the new surface is being exposed on the maintaining device is of a different color that can be observed by an individual. Other embodiments of camouflage positional elements can produce or generate light or other electromagnetic radiation (or vibrations, chemical traces, heat, or acoustics) that can be distributed from a region 502. A light emitting diode (LED), for example, represents one embodiment of a light-emitting device that can also be used as camouflage. Certain embodiments of the camouflage positional element(s) 11 can be configured to emit and/or control emission of light, heat, acoustics, vibrations, chemical traces, or other electromagnetic radiation.

Certain embodiments of camouflage positional element(s), as described in this disclosure, could also provide non-visual information to, at least in parts affect the visual presentation. Such non-visual information could also include, e.g.: vibrating, clicking, biological, buzzing, providing a voice signal, providing a signal of some frequency that may or may not be audible by human ears but might be to the maintaining device or controller, change shape and/or position, etc. Such change of an outward appearance of certain embodiments of the camouflage positional element(s) can be detected by a human, or alternatively a mechanism as a portion of the camouflage. Certain embodiments of image processing and/or filtering techniques can be used to change color and/or intensity.

Another embodiment of camouflage positional element(s) 11 can be configured to emit light of a recognizable color, brightness, blinking rate, etc. In one embodiment, a light emitting diode (e.g., LED) or camouflage device can be actuated as desired. As such, the camouflage positional element(s) 11 can be configured to emit a particular color if it is desired.

Certain embodiments of camouflage positional element(s) 11 can output light using a suitable portion of the camouflage positional element(s).

Certain embodiments of the camouflage positional element(s), as described herein, can be configured to position one or more camouflage positional element(s) such as, but not limited to, providing the exact geographic position of each camouflage positional element(s). Other embodiments of the camouflage positional element(s) 11 can be configured to provide their absolute or relative positions, utilizing a variety of techniques such as provided by global positioning systems (GPS, many of which are commercially available), RNAV, very-high-frequency omni-directional range (VOR), radio locating/ranging, or other such known positioning devices. Camouflage positional element(s) that are situated outside of a building can establish coordinates with respect to that building, etc. As such, the selection of a particular coordinate axis by which the camouflage positional element(s) operate may depend largely upon the positioning of the camouflage positional element(s) themselves, and a user of the camouflage positional element(s) could determine a convenient coordinate axis depending upon the positioning of the camouflage positional element(s) to be maintained. These examples of positional information coordinate axis are not intended to be limiting in scope.

In certain embodiments, the positioning of the camouflage positional element(s) can be largely automated, and can rely upon a variety of automated techniques (e.g., such as those understood to those skilled in the robotics arts), to determine the position of the particular camouflage positional element(s).

V. Examples of Computers/Controllers

This disclosure describes a number of embodiments of the camouflage positional element(s) that can be configured to produce at least a portion of the camouflage. The process associated with positioning of the camouflage positional element(s), and camouflaging information to affect the visual presentation, can be performed at least partially within the camouflage positional element(s) 11, peripherals or other devices associated with the camouflage positional element(s), and/or devices distinct from the camouflage positional element(s) 11 as is understood by those skilled in networking techniques and devices. As such, this portion describes number of embodiments of the computer/controller that operate in a similar fashion whether it is integrated within the peripheral camouflage element(s), and/or some associated or related device.

Certain embodiments of the camouflage positional element(s) 11 can be applied to provide a large variety of camouflaging, positioning, and/or controlling applications, including but not limited to, affecting a variety of visual presentations. It is envisioned that the operation of a single camouflage positional element(s) 11 can be varied, such as by reconfiguring the user interface, downloading different software, hardware, and/or firmware, transmitting signals, etc. Varying the role of the camouflage positional element(s) 11 can provide different visual presentation affecting applications based at least in part on varying a configuration or operation of a computer/controller 18 that can be configured to interface with the camouflage positional element(s) 11. This portion describes certain embodiments of the computer/controller 18 that may be configured to allow such functionality and alterability with respect to the camouflage positional element(s) 11 and/or the computer/controller 18. As such, the processor 605, the memory 607, the circuit 609, and/or the input/output 611 are illustrated in each of the camouflage positional element(s) 11 and the computer/controller 18, since each of these devices can be configured to perform processing operations, positioning operations and/or affect visual presentations at least partially using the camouflage positional element(s) 11.

Certain embodiments of the controller 18 can provide a signal to, or receive a signal from, camouflage positional element(s) or other devices. In some cases, the signal may be provided to camouflage positional element(s) 11 nearby to or communicating with the controller, or to camouflage positional element(s) specifically enabled to recognize the controller signal. In some implementations, the controller camouflage positional element(s) may, in fact, form a part of the camouflage positional element(s) 11 signalled.

Many embodiments of the camouflage positional element(s) 11 utilize processing, timing, filtering and/or other techniques when performing a variety of camouflaging operations. Such processing, timing, filtering, and/or other techniques can be at least partially performed and/or controlled within each individual camouflage positional element(s) 11 at least partially using the controller portion 19. In many embodiments, the processing, timing, filtering, and/or other techniques can be at least partially controlled, externally of the camouflage positional element(s) 11, using the computer/controller 18. In many embodiments, the controller portion 19 integrated in certain embodiments of the camouflage positional element(s) 11 can interoperate with the computer/controller 18 using known networking techniques. As such, depending upon the particular camouflage positional element(s) 11 design, application, configuration, etc., a certain amount of the control of the operations of each camouflage positional element(s) 11 can be provided either within the controller portion 19, or alternatively within the computer/controller 18.

FIG. 10 shows one embodiment of the computer/controller 18 (which can include a computer, mote, microprocessor, microcontroller, etc.) as can be integrated within certain embodiments of the camouflage positional element(s) 11 to assist in providing the sharing of at least portions of data and/or other information associated with the camouflage positional element(s) 11. In certain operations and/or structures, as described with respect to the computer/controller 18 that is distinct from the camouflage positional element(s) 11, can also apply to the operations and structures of the controller portion 19 that is integrated within the camouflage positional element(s) 11. Certain camouflaging-related aspects, such as synchronization and/or designation of aspects as described within this disclosure, can be performed by the computer/controller 18, and/or the controller portion 19. As such, in different embodiments, the camouflage positional element(s) 11 can be operably coupled to each other and/or the computer/controller 18.

As described within this disclosure, multiple embodiments of the camouflage positional element(s) 11 may be able to transfer a variety of data and/or information, etc. to each other and/or other wireless devices via the antennas 12. One embodiment of the computer/controller 18 (that therefore may also be included in the controller portion 19) includes a processor 605 such as a central processing unit (CPU), a memory 607, a circuit or circuit portion 609, and an input output interface (I/O) 611. In certain embodiments, the I/O 611 may include a bus (not shown). In certain embodiments, the processor 605 can have a more limited capacity than perhaps a CPU, such as would occur if the computer/controller 18 included a microprocessor or microcomputer. Different embodiments of the computer/controller 18 can be a general-purpose computer, a specific-purpose computer, a microprocessor, a microcontroller, a personal digital assistant (PDA), and/or any other known suitable type of computer or controller that can be implemented in hardware, software, electromechanical devices, and/or firmware. Certain portions of the computer/controller 18 can be physically or operably configurable in each camouflage positional element(s) 11 as described with respect to FIG. 10. In certain embodiments of the camouflage positional element(s) 11, the processor 605 as described with respect to FIG. 10 performs the processing and arithmetic operations for the computer/controller 18. The computer/controller 18 controls the signal processing, database querying and response, computational, timing, data transfer, and other processes associated with the camouflage positional element(s) 11, as well as other associated or non-related operations. In certain embodiments, one or more simplified versions of the computer/controller 18 that can be provided with respect to FIG. 10, could be configured to provide a transfer of data or other information and/or data between multiple camouflage positional element(s) 11 and/or the computer/controller 18.

Certain embodiments of the memory 607 include random access memory (RAM) and read only memory (ROM) that together store the computer programs, operands, and other parameters that control the operation of the camouflage positional element(s) 11. In certain embodiments, the memory can include flash memory or other similar memory components. The memory 607 can be configurable to contain the data or information obtained, retained, or captured by that camouflage positional element(s) 11 (that may be configurable in different embodiments as the peripheral camouflage positional element(s) 11) such as are used to affect the visual presentation (camouflage).

In certain embodiments, the bus (not illustrated) can be configurable to provide for digital information transmissions between the processor 605, circuits 609, memory 607, and/or the I/O 611 as described with respect to FIG. 10. In this disclosure, the memory 607 can be configurable as RAM, ROM, flash memory, semiconductor-based memory, or any other type of memory that is configurable to store data or other information pertaining to camouflage positional element(s) 11. The bus also connects I/O 611 to the portions of the camouflage positional element(s) 11 that either receive digital information from, or transmit digital information to other camouflage positional element(s).

Many embodiments of the antennas 12 can be configured as both transmitting and receiving devices. As such, each one of the camouflage positional element(s) 11 and/or the computer/controller 18 can be configured to transmit information to other devices, as well as receive information from other devices. Each antenna 12 can be configured to provide effective communications to other devices, and therefore can include, but are not limited to, the radio frequency signals, wireless signals, optical signals, infrared signals, etc.

The memory 607 can provide one example of a memory storage portion that can, for example, store information or data relating to camouflage positional element(s) 11 camouflaging, and/or computer instructions relating to device operations, etc. In certain embodiments, the monitored value includes, but is not limited to: a percentage of the memory 607, a certain amount of information relating to the camouflage positional element(s) 11 that is stored in the memory 607, or at other suitable positions.

The memory 607 can be configured to provide for overflow, primary, secondary, or additional positioning and/or camouflaging ability for the memory 607 of certain embodiments of the camouflage positional element(s) 11 and/or the computer/controller 18 (e.g. when the monitored value of data within the memory 607 exceeds a prescribed value). Other embodiments of the memory 607 can be configurable as a mobile random access memory (RAM) device, a flash memory device, a semiconductor memory device, or any other memory device (that may or may not be distinct from the memory 607) that can store data or other information within the memory 607.

In certain embodiments of the camouflage positional element(s) 11, the particular elements of the computer/controller 18 (e.g., the processor 605, the memory 607, the circuits 609, and/or the I/O 611) can provide a monitoring function to monitor the amount of data or information therewithin. Such a monitoring function by the camouflage positional element(s) 11 can be compared to a prescribed limit, such as whether the camouflage information (or data) contained in the memory 607, the amount of data contained within the memory 607, or some other measure relating to the memory is approaching some value. In certain embodiments, the memory 607 stores data or information relating to the camouflage positional element(s) 11. In certain embodiments the measure relating to the memory approaching some value may pertain to some camouflaged parameter, such as may be associated with the operation of the camouflage positional element(s) 11.

In certain embodiments, the I/O 611 provides an interface to control the transmissions of digital information between each of the components in the computer/controller 18. The I/O 611 also provides an interface between the components of the computer/controller 18 and different portions of the camouflage positional element(s) 11. The circuits 609 can include such other user interface devices as a camouflage and/or a keyboard (which can be varied, miniaturized, and/or be provided in a variety of graphical-based user interfaces for certain embodiments of camouflage positional element(s) 11).

VI. Examples of Flow Charts Involving Camouflage Positional Element(s)

This portion of the disclosure describes a number of flow charts that can relate to a variety of camouflages that include at least one of the camouflage positional element(s) 11.

Figure 16:
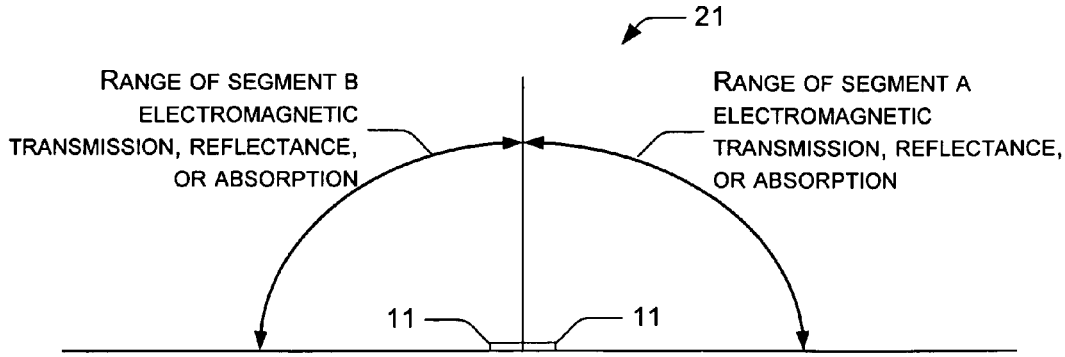
FIG. 16 is a partial cross-sectional view of still another embodiment of the camouflage including the at least one segmented camouflage positional element.
Figure 17A:
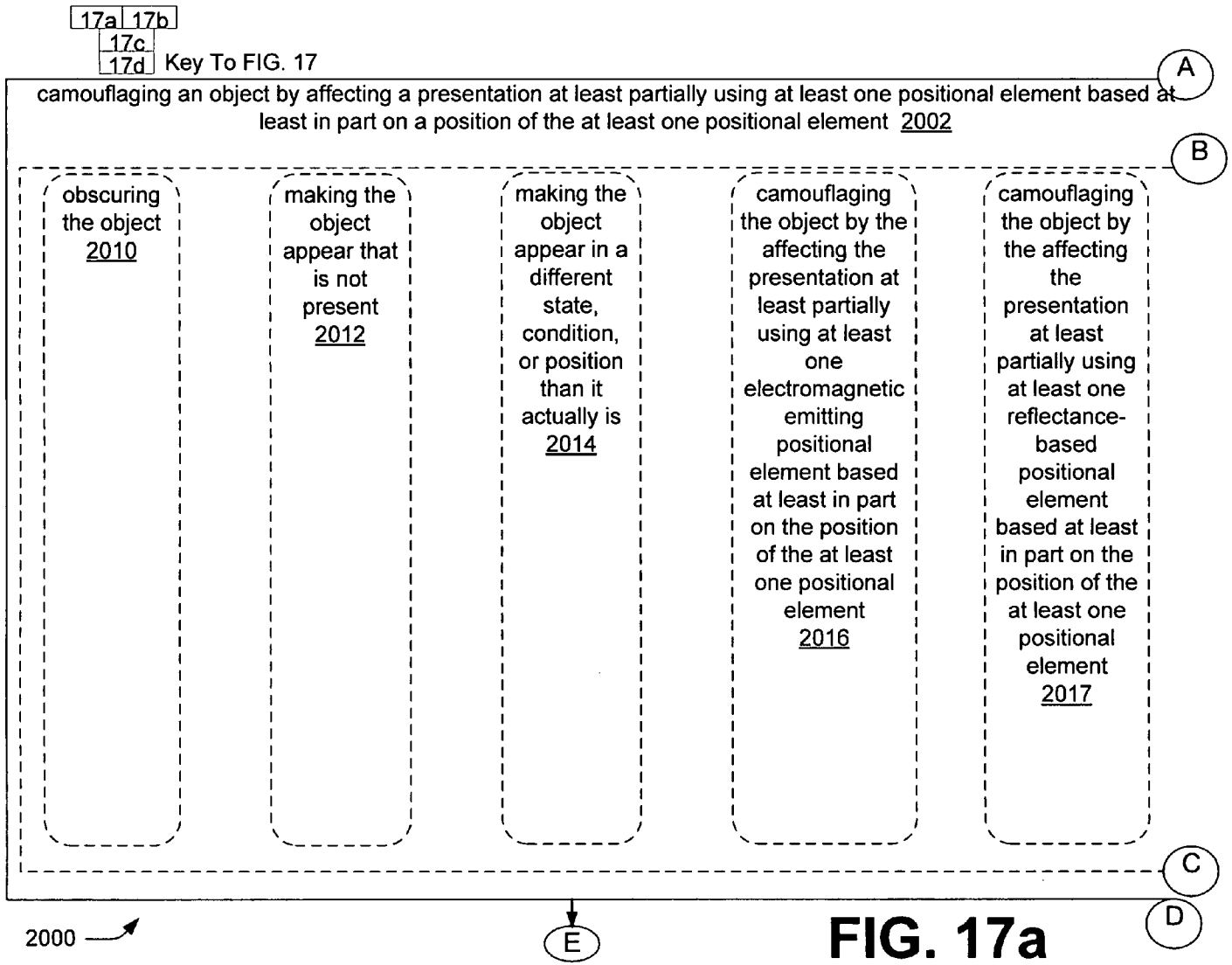
FIGS. 17*a*, 17*b*, 17*c*, and 17*d*, is a high-level flowchart of one embodiment of a positional element technique.
Figure 17B:
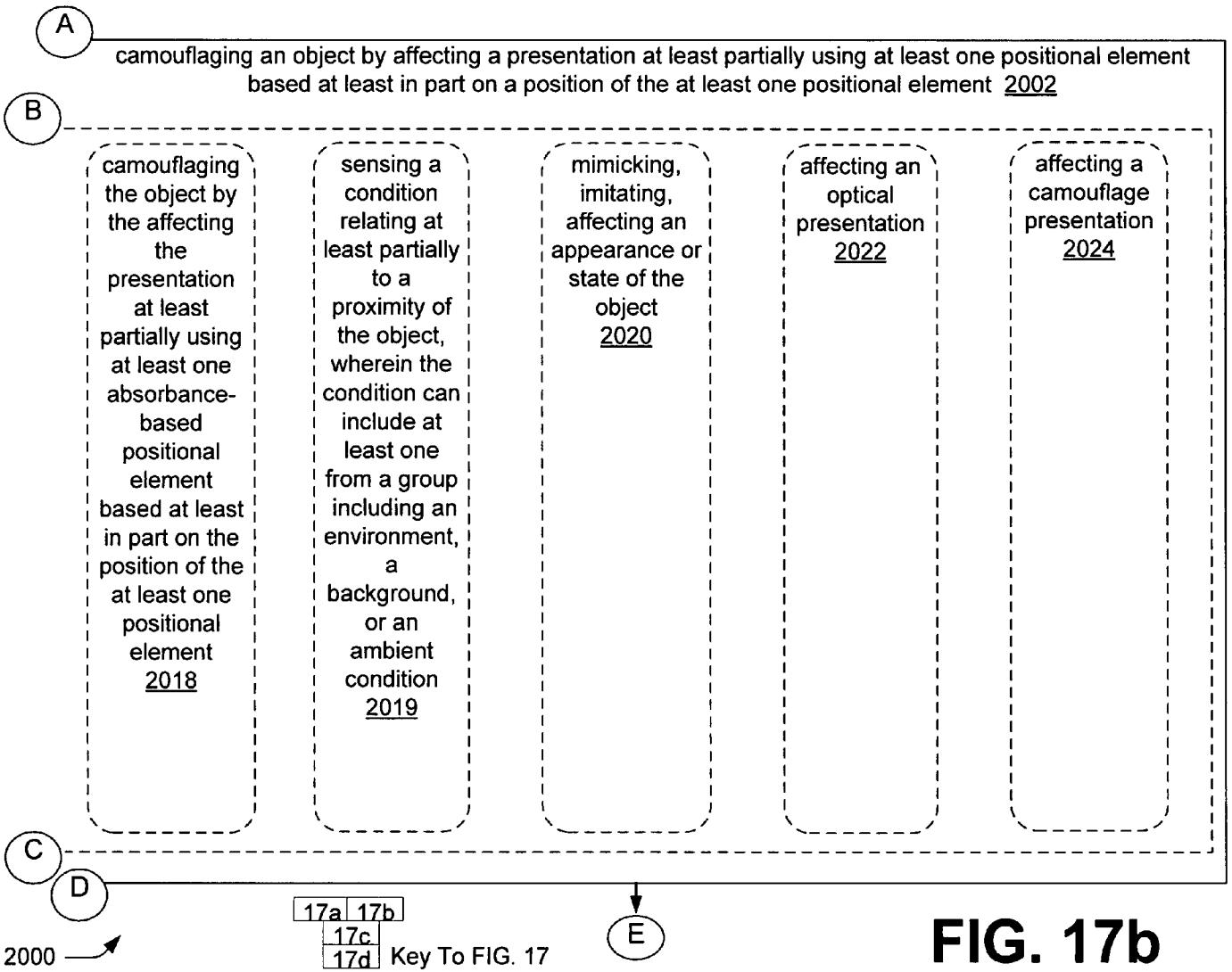
Figure 17C:
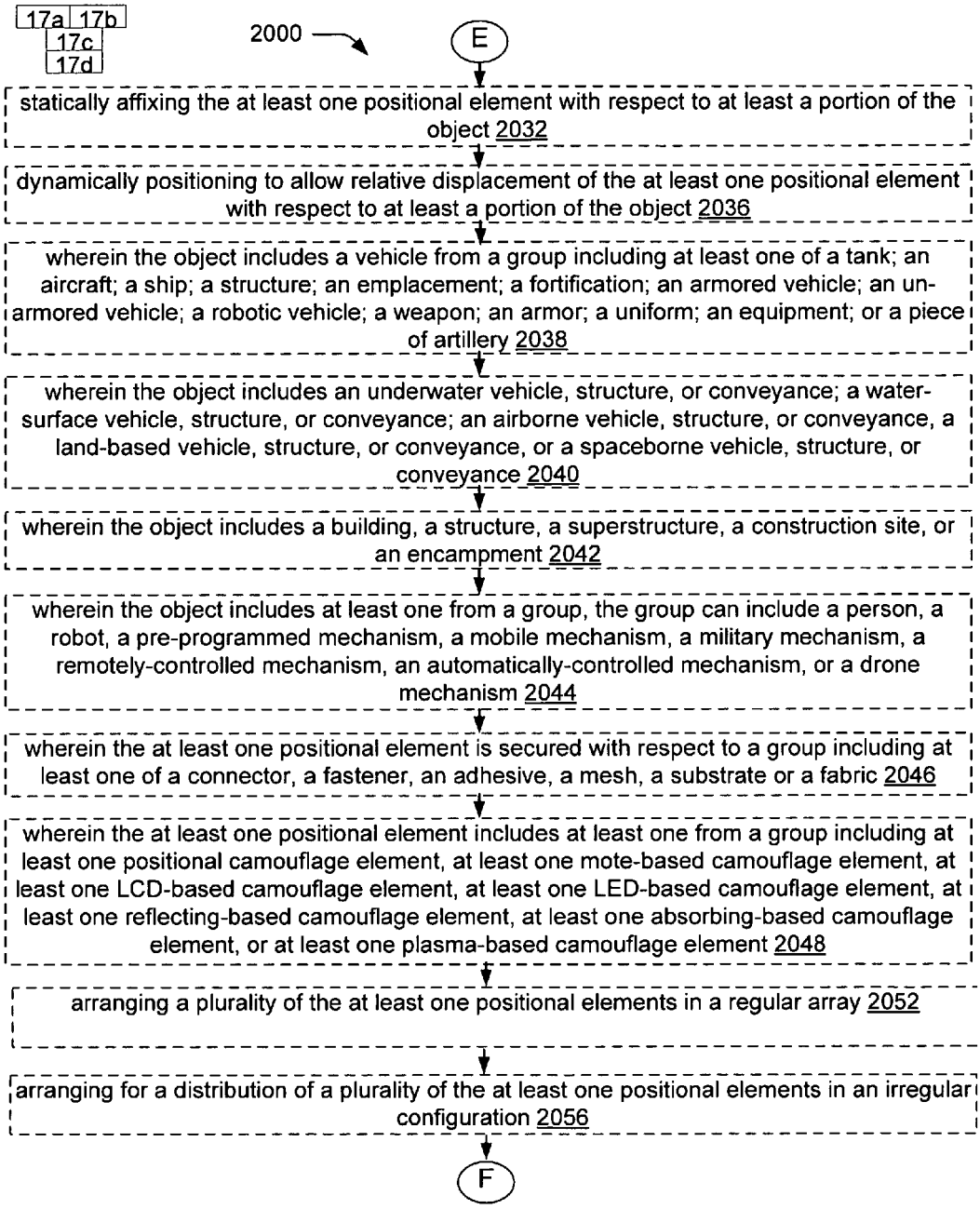
Figure 17D:
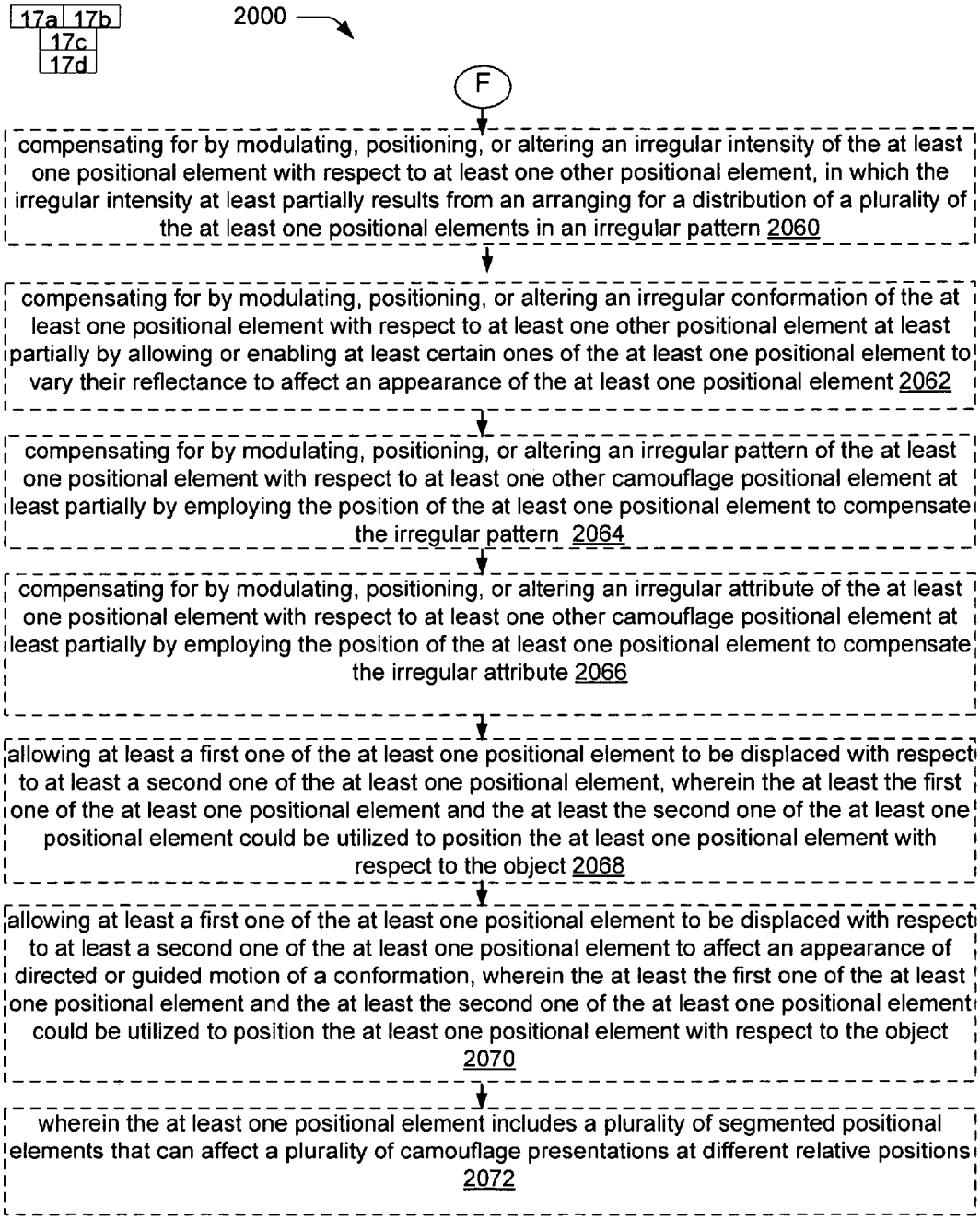

One generalized embodiment of the at least one camouflage positional element(s) is described with respect to FIG. 16, in which a number of camouflage positional elements are associated with the camouflage 21. In certain embodiments, the camouflage positional elements 11 can be attached, adhered, or otherwise situated with respect to the substrate 46 included within the camouflage 21. The substrate 46 can include a solid or flexible material, as described in this disclosure. In other embodiments, the camouflage positional elements can be suspended in a fluid curtain such as a liquid or gas, in which instances the camouflage positional elements can be displaced with respect to each other and/or of the camouflage. In certain embodiments, as described in this disclosure, the camouflage positional elements have sufficient positional processing capabilities to determine their position with respect to other camouflage positional elements, the camouflage, some location on earth, etc. Based at least partially upon the determined position of the camouflage positional elements, at least a portion of the target or object can be camouflaged in a manner corresponding to affecting the presentation, as described in this disclosure. In certain embodiments, one or more controller/computers can be provided to assist in the determining to position of the camouflage positional elements, and/or camouflaging. The camouflage positional elements to 11 within the camouflage 21 as illustrated in FIG. 16 may be sufficiently small such that affecting the presentation of certain ones of the camouflage positional elements can, in certain embodiments, create the effect of writing, images, data, and/or information, etc. as presented by the camouflage with considerable detail. In general, the smaller the light-emitting dimensions of the different camouflage positional elements in combination with the more densely the camouflage positional elements are packed on the camouflage may lead to improved resolution, image quality, reliability, etc. of the camouflage. The opposite of this statement is also true.

Figure 18:
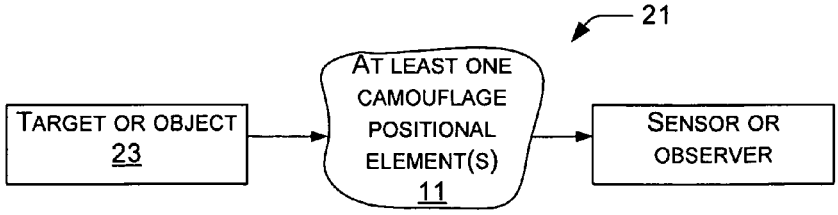
FIG. 18 is a schematic diagram of another embodiment of the camouflage including the at least one camouflage positional element.

FIG. 18 shows one embodiment of the camouflage that includes the at least one camouflage positional element(s) 11 that can affect at least a portion of the camouflage presentation based at least in part on the position of the at least one camouflage positional element(s) 11. Different embodiments of the camouflage can hide the target or object, mimic the target or object, or alter or obfuscate the target or object. As such, the term "camouflage", can have different meanings as described in this disclosure depending upon the context, particularly with respect to FIGS. 17*a*, 17*b*, 17*c*, and 17*d* as described herein. The at least one camouflage positional element(s) may utilize but is not limited to such technologies as emission, reflectance, or absorbance from heat, vibration, chemical traces, or electromagnetic radiation devices.

One embodiment of a high-level flowchart of a camouflage positional element technique 2000 is described with respect to FIGS. 17*a*, 17*b*, 17*c*, and 17*d* and includes, but is not limited to, operations 2002, as well as optional operations 2032, 2036, 2038, 2040, 2042, 2044, 2046, 2048, 2052, 2056, 2060, 2062, 2064, 2066, 2068, 2070 and/or 2072. Operation 2002 can include, but is not limited to, optional operations 2010, 2012, 2014, 2016, 2017, 2018, 2019, 2020, 2022, and/or 2024. The high-level flowchart of FIGS. 17*a*, 17*b*, 17*c*, and 17*d* should be considered in combination with the camouflage positional element(s) 11, as described with respect to FIG. 18. One embodiment of operation 2002 can include, but is not limited to, camouflaging an object by affecting a presentation at least partially using at least one positional element based at least in part on a position of the at least one positional element. For example, at least one positional element, such as to be situated with respect to the target or object, can be camouflaged based at least in part of the position of the at least one positional element. As such, in certain embodiments a background color, texture, heat signature, etc. should be considered such as to consider a suitable color, heat, electromagnetic radiation characteristic, reflectance characteristic, absorption characteristic, etc. of the presentation to affect. One embodiment of the camouflaging an object by affecting a presentation at least partially using at least one positional element based at least in part on a position of the at least one positional element of operation 2002 can include operation 2010, that can include, but is not limited to, obscuring the object. For example, the at least one camouflage positional element can be used to camouflage the object, and thereby obscure or hide the object. One embodiment of the camouflaging an object by affecting a presentation at least partially using at least one positional element based at least in part on a position of the at least one positional element of operation 2002 can include operation 2012, that can include, but is not limited to, making the object appear that is not present. For example, the at least one camouflage positional element can be used to make the object, such as an aircraft, tank, ship, building, etc., appear as if it is not present. One embodiment of the camouflaging an object by affecting a presentation at least partially using at least one positional element based at least in part on a position of the at least one positional element of operation 2002 can include operation 2014, that can include, but is not limited to, making the object appear in a different state, condition, or position than it actually is. For example, the at least one camouflage positional element can be used to make the object appear in a different state, condition, or position it actually is such that a sensor or observer might not be able to positively identify the location or type of the object such as by camouflaging, mimicking, decoying, distorting, or obfuscating objects or electromagnetic associated therewith. In certain embodiments, for example, the camouflage positional element(s) could mimic a background, the sky in the aircraft, or a star, or make aircraft appear like flock of geese. One embodiment of the camouflaging an object by affecting a presentation at least partially using at least one positional element based at least in part on a position of the at least one positional element of operation 2002 can include operation 2016, that can include, but is not limited to, camouflaging the object by the affecting the presentation at least partially using at least one electromagnetic emitting positional element based at least in part on the position of the at least one positional element. For example, the at least one camouflage positional element can include at least one electromagnetic emitting positional element. One embodiment of the camouflaging an object by affecting a presentation at least partially using at least one positional element based at least in part on a position of the at least one positional element of operation 2002 can include operation 2017, that can include, but is not limited to, camouflaging the object by the affecting the presentation at least partially using at least one reflectance-based positional element based at least in part on the position of the at least one positional element. For example, the at least one camouflage positional element can utilize at least one reflectance-based positional element to affect the presentation. One embodiment of the camouflaging an object by affecting a presentation at least partially using at least one positional element based at least in part on a position of the at least one positional element of operation 2002 can include operation 2018, that can include, but is not limited to, camouflaging the object by the affecting the presentation at least partially using at least one absorbance-based positional element based at least in part on the position of the at least one positional element. For example, the at least one camouflage positional element can utilize at least one absorbance-based positional element to affect the presentation. One embodiment of the camouflaging an object by affecting a presentation at least partially using at least one positional element based at least in part on a position of the at least one positional element of operation 2002 can include operation 2019, that can include, but is not limited to, sensing a condition relating at least partially to a proximity of the object, wherein the condition can include at least one from a group including an environment, a background, or an ambient condition. For example, sensing an environmental condition, a background condition, or an ambient condition (e.g., air temperature, pressure, weather, etc.) of the object. One embodiment of the camouflaging an object by affecting a presentation at least partially using at least one positional element based at least in part on a position of the at least one positional element of operation 2002 can include operation 2020 that can include, but not limited to, mimicking, imitating, affecting an appearance or state of the object. For example, mimicking, imitating, or affecting an appearance or state of the object, such as a background of the target or object. With an aircraft, for example, the sky with stars or clouds could be mimicked, perhaps using segmented camouflage positional elements to affect different presentations. The at least one camouflage positional element(s) could mimic the background, for example, such as mimicking the sky behind an the aircraft. Or make aircraft look like flock of geese One embodiment of the camouflaging an object by affecting a presentation at least partially using at least one positional element based at least in part on a position of the at least one positional element of operation 2002 can include operation 2022 that can include, but not limited to, affecting an optical presentation. For example, the at least one positional element can affect an optical presentation. One embodiment of the camouflaging an object by affecting a presentation at least partially using at least one positional element based at least in part on a position of the at least one positional element of operation 2002 can include operation 2024 that can include, but not limited to, affecting a camouflage presentation. For example, the at least one positional element can affect a camouflage presentation. One embodiment of operation 2032 can include, but is not limited to, statically affixing the at least one positional element with respect to at least a portion of the object. For example, the at least one camouflage positional element can be affixed, adhered, fastened, and/or otherwise secured to at least the portion of the object. One embodiment of operation 2036 can include, but is not limited to, dynamically positioning to allow relative displacement of the at least one positional element with respect to at least a portion of the object. For example, the at least one positional element can be allowed to be displaced with respect to the object. One embodiment of operation 2038 can include, but is not limited to, wherein the object includes a vehicle from a group including at least one of a tank; an aircraft; a ship; a structure; an emplacement; a fortification; an armored vehicle; an un-armored vehicle; a robotic vehicle; a weapon; an armor; a uniform; an equipment; or a piece of artillery. For example, the object can include such vehicles as aircraft, tanks, ships, pieces of artillery, etc. One embodiment of operation 2040 can include, but is not limited to, wherein the object includes an underwater vehicle, structure, or conveyance; a water-surface vehicle, structure, or conveyance; an airborne vehicle, structure, or conveyance, a land-based vehicle, structure, or conveyance, or a spaceborne vehicle, structure, or conveyance. For example, the object can include a variety of underwater, water-surface-based, land-based, airborne, or spaceborne vehicles, structures, and/or conveyances. One embodiment of operation 2042 can include, but is not limited to, wherein the object includes a building, a structure, a superstructure, a construction site, or an encampment. For example, the object can include a building, a structure, a superstructure, a construction site, or an encampment. One embodiment of operation 2044 can include, but is not limited to, wherein the object includes at least one from a group, the group can include a person, a robot, a pre-programmed mechanism, a mobile mechanism, a military mechanism, a remotely-controlled mechanism, an automatically-controlled mechanism, or a drone mechanism. For example, the object can include a variety of automated, robotic, pre-programmed, remotely-controlled, and other such mechanisms. Certain embodiments of such automated devices can be provided with mobility (controlled, preprogrammed or random), in a similar manner as robots. One embodiment of operation 2046 can include, but is not limited to, wherein the at least one positional element is secured with respect to a group including at least one of a connector, a fastener, an adhesive, a mesh, a substrate or a fabric. For example, the at least one positional element can be secured (to other positional element(s) of other devices) to a connector, a fastener, an adhesive, a mesh, a substrate, a fabric, or another similar type of connector. One embodiment of operation 2048 can include, but is not limited to, wherein the at least one positional element includes at least one from a group including at least one positional camouflage element, at least one mote-based camouflage element, at least one LCD-based camouflage element, at least one LED-based camouflage element, at least one reflecting-based camouflage element, at least one absorbing-based camouflage element, or at least one plasma-based camouflage element. For example, the at least one positional element(s) can include a variety of display elements, similar to as claimed. One embodiment of operation 2052 can include, but is not limited to, arranging a plurality of the at least one positional elements in a regular array. For example, the at least one positional element(s) can be arranged in a regular array having similar dimensions, spacing, operating characteristics, illuminating characteristics, etc. One embodiment of operation 2056 can include, but is not limited to, arranging for a distribution of a plurality of the at least one positional elements in an irregular configuration. For example, certain embodiments of the plurality of the at least one positional element(s) would be distributed in a random or irregular pattern, and/or be distributed such as to be allowed to be displaced with respect to each other, as described in this disclosure. One embodiment of operation 2060 can include, but is not limited to, compensating for by modulating, positioning, or altering an irregular intensity of the at least one positional element with respect to at least one other positional element, in which the irregular intensity at least partially results from an arranging for a distribution of a plurality of the at least one positional elements in an irregular pattern. For example, the irregular intensity of the at least one positional element can be compensated for by modulating, positioning, or altering an irregular intensity. One embodiment of operation 2062 can include, but is not limited to, compensating for by modulating, positioning, or altering an irregular conformation of the at least one positional element with respect to at least one other positional element at least partially by allowing or enabling at least certain ones of the at least one positional element to vary their reflectance to affect an appearance of the at least one positional element. For example, the reflectivity of the at least one positional element(s) can be varied to alter their appearance such as to affect the camouflage presentation. One embodiment of operation 2064 can include, but is not limited to, compensating for by modulating, positioning, or altering an irregular pattern of the at least one positional element with respect to at least one other camouflage positional element at least partially by employing the position of the at least one positional element to compensate the irregular pattern. For example, the position of the at least one positional element can be modulated, positioned, or altered to compensate for an irregular pattern of the at least one positional element. One embodiment of operation 2066 can include, but is not limited to, compensating for by modulating, positioning, or altering an irregular attribute of the at least one positional element with respect to at least one other camouflage positional element at least partially by employing the position of the at least one positional element to compensate the irregular attribute. For example, an irregular attribute of the at least one positional element can be compensated for. One embodiment of operation 2068 can include, but is not limited to, allowing at least a first one of the at least one positional element to be displaced with respect to at least a second one of the at least one positional element, wherein the at least the first one of the at least one positional element and the at least the second one of the at least one positional element could be utilized to position the at least one positional element with respect to the object. For example, at least one positional element can be allowed to be displaced with respect to another positional element in a manner that can indicate non-controlled motion such as with a falling object. One embodiment of operation 2070 can include, but is not limited to, allowing at least a first one of the at least one positional element to be displaced with respect to at least a second one of the at least one positional element to affect an appearance of directed or guided motion of a conformation, wherein the at least the first one of the at least one positional element and the at least the second one of the at least one positional element could be utilized to position the at least one positional element with respect to the object. For example, at least one positional element can be allowed to be displaced with respect to another positional element in a manner that can indicate controlled motion such as with a guided or controlled vehicle. One embodiment of operation 2072 can include, but is not limited to, wherein the at least one positional element includes a plurality of segmented positional elements that can affect a plurality of camouflage presentations at different relative positions. For example, the at least one positional element can generate two electromagnetic aspects, vibrations, chemical traces, acoustics, or heat intensities, reflectivity, and/or absorption to different positions such that a single side or location of a tank can appear different at different relative angles, such as to correspond to different backgrounds depending on the vantage point of the observer, sensor, or detector. The order of the operations, methods, mechanisms, etc as described with respect to FIGS. 17*a*, 17*b*, 17*c*, and 17*d* are intended to be illustrative in nature, and not limited in scope.

Figure 20:
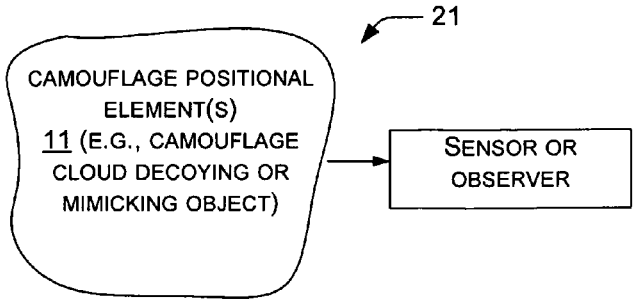
FIG. 20 is a schematic diagram of still another embodiment of the camouflage including the at least one camouflage positional element.

One embodiment of the camouflage 21 is described with respect to FIG. 20, in which the camouflage positional element(s) 11 are configured to mimic the target or object, and thereby act as a decoy presentation, an active chaff, and/or a smart chaff. As such, the target or object such as a vehicle may appear to the sensor or target where none actually exist. The at least one camouflage positional element(s) may utilize but is not limited to such technologies as emission, reflectance, or absorbance from heat, vibration, chemical traces, or electromagnetic radiation devices.

Figure 19:
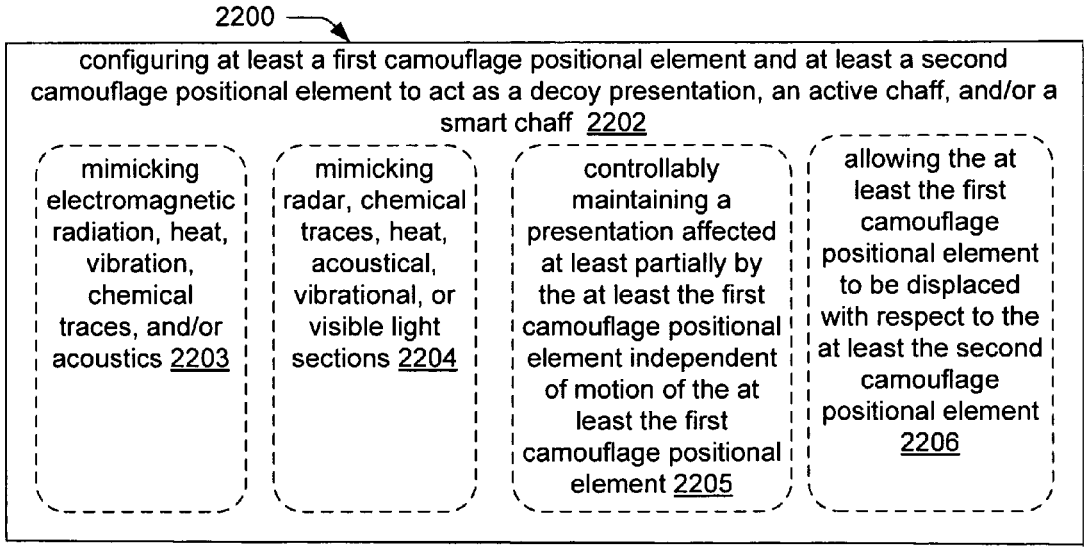
FIG. 19 is a high-level flowchart of one embodiment of a positional element technique.

One embodiment of a high-level flowchart of a camouflage positional element addressing technique 2200 is described with respect to FIG. 19 and includes, but is not limited to, operation 2202. One embodiment of operation 2202 can include, but is not limited to, optional operations 2203, 2204, 2205, and/or 2206. The high-level flowchart of FIG. 19 should be considered in combination with the camouflage positional element(s) 11, as described with respect to FIG. 20. One embodiment of operation 2202 can include, but is not limited to, configuring at least a first camouflage positional element and at least a second camouflage positional element to act as a decoy presentation, an active chaff, and/or a smart chaff. For example, providing the at least one camouflage positional element(s) with the address to be used to derive the position. Such mimicking can be applied to a heat signature, a radar, an acoustical (e.g., similar to SONAR), a vibrational, a chemical trace, a reflectance, an absorbance, electromagnetic radiation. In certain instances, the camouflage could be applied to objects that emit, reflect, or absorb light or other electromagnetic radiation that have a specific directionality. As such, such directional targets or objects could be useful in only certain directions but would be camouflaged in others. Different emitters or beam-formers could change to mimic exhaust, etc. to make it appear that the target or object being mimicked is moving rapidly, such as with a mimicked aircraft (which may hide a real object, or alternatively may only be a phantom object). This could appear to be ripping across cloud or moving in circles. One embodiment of the configuring at least a first camouflage positional element and at least a second camouflage positional element to act as a decoy presentation, an active chaff, and/or a smart chaff of operation 2202 can include operation 2203 that can include, but is not limited to, mimicking electromagnetic radiation, heat, vibration, chemical traces, and/or acoustics. For example, camouflaging at least a portion of the object using the at least one camouflage positional element, as described in this disclosure. One embodiment of the configuring at least a first camouflage positional element and at least a second camouflage positional element to act as a decoy presentation, an active chaff, and/or a smart chaff of operation 2202 can include operation 2204 that can include, but is not limited to, mimicking radar, heat, acoustical, vibrational, chemical traces, or visible light sections. For example, such mimicking radar, heat, acoustical, vibrational, chemical traces, or visible light sections could be mimicked using beam-formers, segmented camouflage positional element(s), irregular heat producers such as motes, etc. to mimic the desired target or object. Certain embodiments of the acoustical mimicking could be similar to SONAR. One embodiment of the configuring at least a first camouflage positional element and at least a second camouflage positional element to act as a decoy presentation, an active chaff, and/or a smart chaff of operation 2202 can include operation 2205 that can include, but is not limited to, controllably maintaining a presentation affected at least partially by the at least the first camouflage positional element independent of motion of the at least the first camouflage positional element. For example, the at least one positional element can generate heat that might, for example, deflect a heat-seeking missile and/or a heat detector. One embodiment of the configuring at least a first camouflage positional element and at least a second camouflage positional element to act as a decoy presentation, an active chaff, and/or a smart chaff of operation 2202 can include operation 2206 that can include, but is not limited to, allowing the at least the first camouflage positional element to be displaced with respect to the at least the second camouflage positional element. For example, camouflage positional elements may be allowed to be displaced with respect to each other. The order of the operations, methods, mechanisms, etc. as described with respect to FIG. 19 are intended to be illustrative in nature, and not limited in scope.

Figure 22:
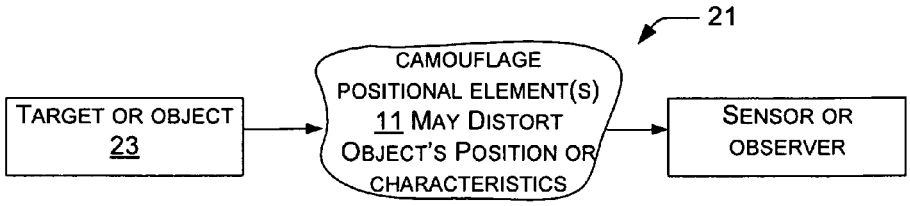
FIG. 22 is a schematic diagram of still another embodiment of the camouflage including the at least one camouflage positional element.

One embodiment of the camouflage 21 is described with respect to FIG. 22, in which the camouflage positional element(s) 11 are configured to providing at least one positional element that can deceive, confuse, defeat, or lead one or more sensors towards or away from a target. As such, the at least one camouflage positional element(s) may indicate in inaccurate position or distortion of the target or object with respect to an observer or sensor. Certain embodiments of the camouflage can therefore act as chaff, one or more flares, fog, one or more decoys, or a combination thereof. The at least one camouflage positional element(s) may utilize but is not limited to such technologies as emission, reflectance, or absorbance from heat, vibration, chemical trace, or electromagnetic radiation devices.

Figure 21:
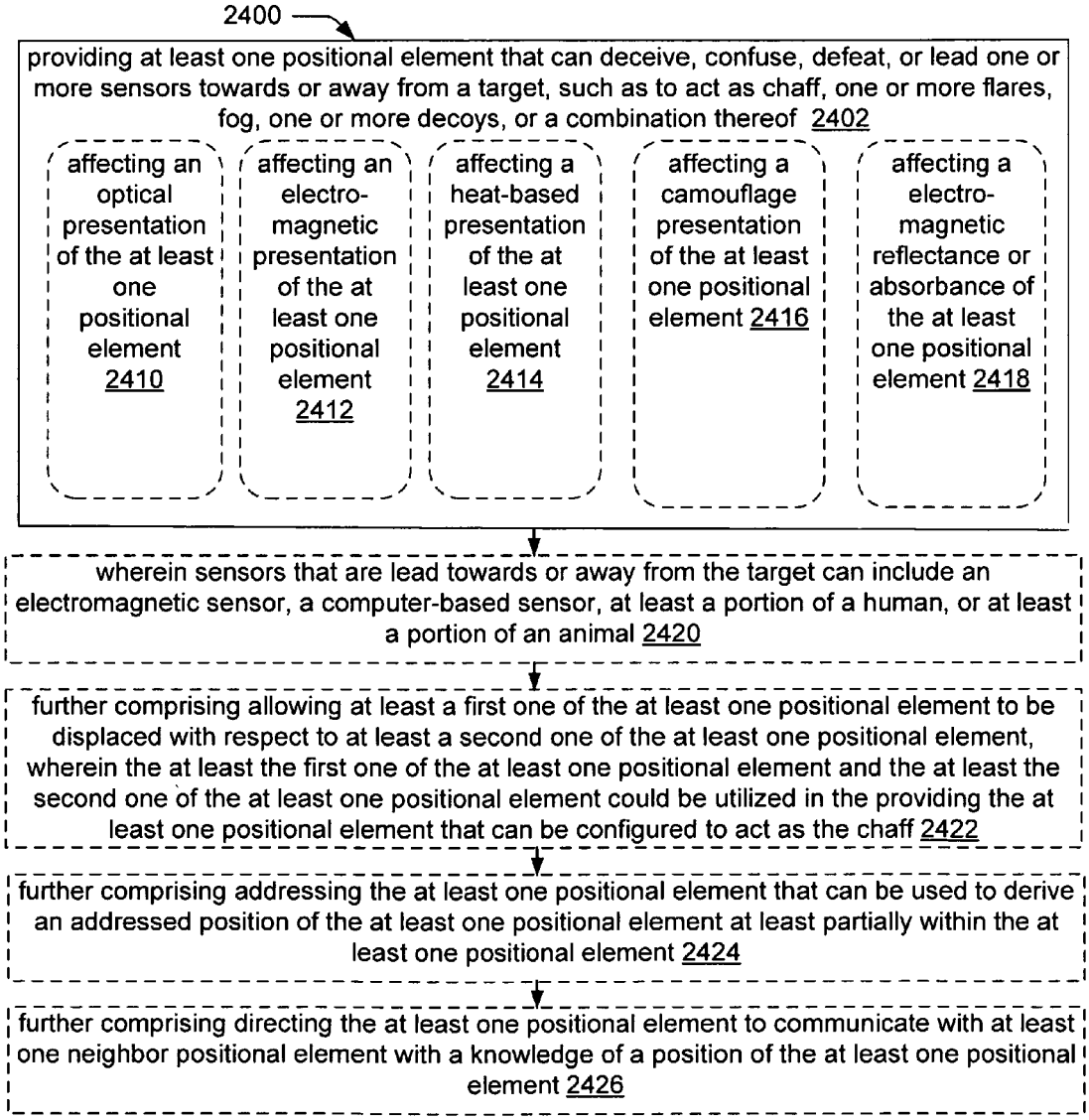
FIG. 21 is a high-level flowchart of one embodiment of a positional element technique.

One embodiment of a high-level flowchart of a camouflage positional element addressing technique 2400 is described with respect to FIG. 21 and includes, but is not limited to, operation 2402, as well as optional operations 2420, 2422, 2424, and/or 2426. One embodiment of operation 2402 can include, but is not limited to, optional operations 2410, 2412, 2414, 2416, and/or 2418. The high-level flowchart of FIG. 21 should be considered in combination with the camouflage positional element(s) 11, as described with respect to FIG. 22. One embodiment of operation 2402 can include, but is not limited to, providing at least one positional element that can deceive, confuse, defeat, or lead one or more sensors towards or away from a target, such as to act as chaff, one or more flares, fog, one or more decoys, or a combination thereof. For example, providing the at least one positional element(s) that can deceive, confuse, defeat, or lead one or more sensors toward or away from the target or object. For example, this would encompass conformational changes that might, for example, change the radar signature of a camouflage positional element. One embodiment of the providing at least one positional element that can deceive, confuse, defeat, or lead one or more sensors towards or away from a target, such as to act as chaff, one or more flares, fog, one or more decoys, or a combination thereof of operation 2402 can include operation 2410 that can include, but is not limited to, affecting an optical presentation of the at least one positional element. For example, the positional element that can deceive, confuse, defeat, or lead the sensors toward or away from a target can be used by the at least one positional element to affect the optical presentation. One embodiment of the providing at least one positional element that can deceive, confuse, defeat, or lead one or more sensors towards or away from a target, such as to act as chaff, one or more flares, fog, one or more decoys, or a combination thereof of operation 2402 can include operation 2412 that can include, but is not limited to, affecting an electromagnetic presentation of the at least one positional element. For example, the at least one positional element can affect the electromagnetic presentation, such as but not limited to providing a conformational changes that, for example, change a signature of the target or object, such as the radar signature of the camouflage positional element(s). One embodiment of the providing at least one positional element that can deceive, confuse, defeat, or lead one or more sensors towards or away from a target, such as to act as chaff, one or more flares, fog, one or more decoys, or a combination thereof of operation 2402 can include operation 2414 that can include, but is not limited to, affecting a heat-based presentation of the at least one positional element. For example, the at least one positional element can affect the heat-based presentation. One embodiment of the providing at least one positional element that can deceive, confuse, defeat, or lead one or more sensors towards or away from a target, such as to act as chaff, one or more flares, fog, one or more decoys, or a combination thereof of operation 2402 can include operation 2416 that can include, but is not limited to, affecting a camouflage presentation of the at least one positional element. For example, affecting the camouflage presentation using the positional element. One embodiment of the providing at least one positional element that can deceive, confuse, defeat, or lead one or more sensors towards or away from a target, such as to act as chaff, one or more flares, fog, one or more decoys, or a combination thereof of operation 2402 can include operation 2418 that can include, but is not limited to, affecting a electromagnetic reflectance or absorbance of the at least one positional element. For example, the at least one positional element can affect an electromagnetic reflectance or absorbance. One embodiment of operation 2420 can include, but is not limited to, wherein the one or more sensors that are lead towards or away from the target can include an electromagnetic sensor, a computer-based sensor, at least a portion of a human, or at least a portion of an animal. For example, the at least one positional element can lead sensors toward or away from the target, in which the sensors can include, but are not limited to, an electromagnetic sensors, a computer-based sensors, at least a portion of a human such as human sight or hearing and/or at least a portion of an animal such as animal sight or hearing. One embodiment of operation 2422 can include, but is not limited to, further comprising allowing at least a first one of the at least one positional element to be displaced with respect to at least a second one of the at least one positional element, wherein the at least the first one of the at least one positional element and the at least the second one of the at least one positional element could be utilized in the providing the at least one positional element that can be configured to act as the chaff. For example, allowing a least one positional element to be displaced with respect to another positional element. One embodiment of operation 2424 can include, but is not limited to, further comprising addressing the at least one positional element that can be used to derive an addressed position of the at least one positional element at least partially within the at least one positional element. For example, the at least one positional element is addressed to derive an addressed position. One embodiment of operation 2426 can include, but is not limited to, further comprising directing the at least one positional element to communicate with at least one neighbor positional element with a knowledge of a position of the at least one positional element. For example, the at least one positional element can be directed to communicate its position with respect to the neighboring positional element (certain embodiments of the neighboring positional element does not have to be directly adjacent, or even closely adjacent). The order of the operations, methods, mechanisms, etc. as described with respect to FIG. 21 are intended to be illustrative in nature, and not limited in scope.

Figure 24:
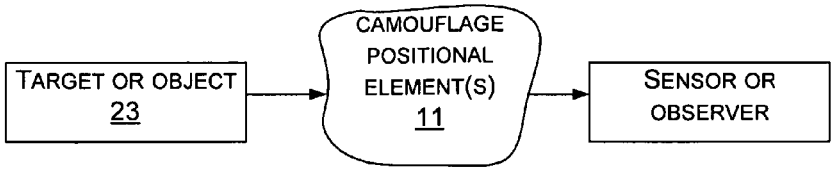
FIG. 24 is a schematic diagram of still another embodiment of the camouflage including the at least one camouflage positional element.

One embodiment of the camouflage 21 is described with respect to FIG. 24, in which a suitable camouflage can be determined for the camouflage positional element(s) 11 considering the background of the target or object. Certain embodiments of the camouflage can change over time as the background changes. Certain embodiments of the at least one camouflage positional element(s) can rely on imaging devices, computers, and/or controllers to determine the suitable background. Certain embodiments of the at least one camouflage positional element(s) can be segmented to provide different camouflage to different viewers or locations. Certain embodiments of the camouflage can therefore act as such as to act to hide the target or object. The at least one camouflage positional element(s) may utilize but is not limited to such technologies as emission, reflectance, or absorbance from heat, vibration, chemical trace, or electromagnetic radiation devices.

Figure 23:
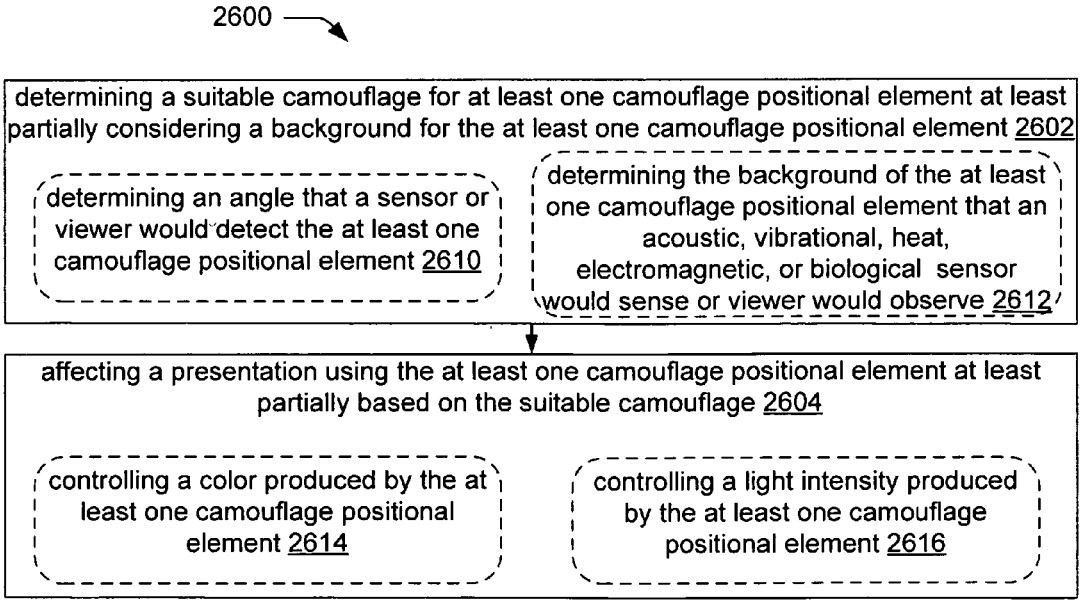
FIG. 23 is a high-level flowchart of one embodiment of a positional element technique.

One embodiment of a high-level flowchart of a camouflage positional element addressing technique 2600 is described with respect to FIG. 23 and includes, but is not limited to, operations 2602 and 2604. One embodiment of operation 2602 can include, but is not limited to, optional operations 2610, 2612. One embodiment of operation 2604 can include, but is not limited to, optional operations 2614, 2616. The high-level flowchart of FIG. 23 should be considered in combination with the camouflage positional element(s) 11, as described with respect to FIG. 24. One embodiment of operation 2602 can include, but is not limited to, determining a suitable camouflage for at least one camouflage positional element at least partially considering a background for the at least one camouflage positional element. For example, a color, texture, change of color, lighting, optical intensity, etc. of the background of the at least one camouflage positional element could be considered to determine the suitable camouflage. One embodiment of operation 2604 can include, but is not limited to, affecting a presentation using the at least one camouflage positional element at least partially based on the suitable camouflage. For example, the at least one camouflage positional element can affect the presentation based least on part on the suitable camouflage. One embodiment of the determining a suitable camouflage for at least one camouflage positional element at least partially considering a background for the at least one camouflage positional element of operation 2602 can include operation 2610, that can include, but is not limited to, determining an angle that a sensor or viewer would detect the at least one camouflage positional element. For example, the angle or position of the user with respect to the at least one positional element should be considered. Within this disclosure, certain embodiments of "sensors" could include sight of a human or animal. One embodiment of the determining a suitable camouflage for at least one camouflage positional element at least partially considering a background for the at least one camouflage positional element of operation 2602 can include operation 2612, that can include, but is not limited to, determining the background of the at least one camouflage positional element that an acoustic, vibrational, heat, or biological sensor would sense or a viewer would observe. For example, the at least one camouflage positional element would determine suitable background, based, for example, on an imaging device such as a camcorder that is capturing the actual background. One embodiment of the affecting a presentation using the at least one camouflage positional element at least partially based on the suitable camouflage of operation 2604 can include operation 2614, that can include, but is not limited to, controlling a color produced by the at least one camouflage positional element. For example, controlling the color of the affected presentation for the at least one camouflage positional element. One embodiment of the affecting a presentation using the at least one camouflage positional element at least partially based on the suitable camouflage of operation 2604 can include operation 2616, that can include, but is not limited to, controlling a light intensity produced by the at least one camouflage positional element. For example, controlling the light intensity produced by the at least one camouflage positional element. The order of the operations, methods, mechanisms, etc. as described with respect to FIG. 23 are intended to be illustrative in nature, and not limited in scope.

In one or more various aspects, related systems include but are not limited to circuitry and/or programming for effecting the herein-referenced method aspects; the circuitry and/or programming can be virtually any combination of hardware, software, electro-mechanical system, and/or firmware configurable to effect the herein-referenced method aspects depending upon the design choices of the system designer.

VII. Conclusion

This disclosure provides a number of embodiments of the camouflage 21 that can include one or more camouflage positional element(s) 11 to affect the camouflage presentation. Each camouflage positional element(s) 11 can allow camouflage information, such as data, to be camouflaged. In certain embodiments, the camouflage positional element(s) can store, process, transfer, and perform other data-processing techniques upon the camouflage information. For example, in certain embodiments, certain camouflage positional element(s) can transfer the camouflage information to another camouflage positional element(s) 11 and/or another device. The embodiments of the camouflage positional element(s) 11 as are described with respect to this disclosure are intended to be illustrative in nature, and are not limiting its scope.

Those having skill in the art will recognize that the state of the art has progressed to the point where there is little distinction left between hardware and software implementations of aspects of systems; the use of hardware or software is generally (but not always, in that in certain contexts the choice between hardware and software can become significant) a design choice representing cost vs. efficiency tradeoffs. Those having skill in the art will appreciate that there are various vehicles by which processes and/or systems and/or other technologies described herein can be effected (e.g., hardware, software, and/or firmware), and that the preferred vehicle can vary with the context in which the processes and/or systems and/or other technologies are deployed. For example, if an implementer determines that speed and accuracy are paramount, the implementer and/or designer of the camouflage positional element(s) and/or the camouflage may opt for mainly a hardware and/or firmware vehicle. In alternate embodiments, if flexibility is paramount, the implementer and/or designer may opt for mainly a software implementation. In yet other embodiments, the implementer and/or designer may opt for some combination of hardware, software, and/or firmware. Hence, there are several possible techniques by which the processes and/or devices and/or other technologies described herein may be effected, none of which is inherently superior to the other in that any vehicle to be utilized is a choice dependent upon the context in which the vehicle can be deployed and the specific concerns (e.g., speed, flexibility, or predictability) of the implementer, any of which may vary.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in standard integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies equally regardless of the particular type of signal bearing media used to actually carry out the distribution. Examples of a signal bearing media include, but are not limited to, the following: recordable type media such as floppy disks, hard disk drives, CD ROMs, digital tape, and computer memory; and transmission type media such as digital and analog communication links using TDM or IP based communication links (e.g., packet links).

All of the above U.S. patents, U.S. patent application publications, U.S. patent applications, foreign patents, foreign patent applications and non-patent publications referred to in this specification and/or listed in any Application Data Sheet, are incorporated herein by reference, in their entireties.

The herein described aspects depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", "operably linked", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

It is to be understood by those skilled in the art that, in general, that the terms used in the disclosure, including the drawings and the appended claims (and especially as used in the bodies of the appended claims), are generally intended as "open" terms. For example, the term "including" should be interpreted as "including but not limited to"; the term "having" should be interpreted as "having at least"; and the term "includes" should be interpreted as "includes, but is not limited to"; etc. In this disclosure and the appended claims, the terms "a", "the", and "at least one" positioned prior to one or more items are intended to apply inclusively to either one or a plurality of those items.

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that could have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that could have A alone, B alone, C alone, A and B together, A and C together, B and C together, and/or A, B, and C together, etc.).

Those skilled in the art will appreciate that the herein-described specific exemplary processes and/or devices and/or technologies are representative of more general processes and/or devices and/or technologies taught elsewhere herein, such as in the claims filed herewith and/or elsewhere in the present application.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. A method comprising:

[a] camouflaging an object by affecting a presentation at least partially using at least one positional element based at least in part on a position of the at least one positional element wherein the camouflaging an object by affecting a presentation at least partially using at least one positional element based at least in part on a position of the at least one positional element further including:

[a1] sensing a condition relating at least partially to a proximity of the object, wherein the condition includes at least one from a group including an environment, a background, or an ambient condition.

2. The method of claim 1, further comprising:

[b] compensating for an irregular intensity of the at least one positional element by modulating, positioning, or altering the irregular intensity of the at least one positional element with respect to at least one other positional element, in which the irregular intensity at least partially results from an arranging for a distribution of a plurality of the at least one positional elements in an irregular pattern.

3. The method of claim 1, further comprising:

[b] compensating for an irregular conformation of the at least one positional element by modulating, positioning, or altering the irregular conformation of the at least one positional element with respect to at least one other positional element at least partially by allowing or enabling at least certain ones of the at least one positional element to vary their reflectance to affect an appearance of the at least one positional element.

4. The method of claim 1, further comprising:

[b] compensating for an irregular pattern of the at least one positional element by modulating, positioning, or altering the irregular pattern of the at least one positional element with respect to at least one other camouflage positional element at least partially by employing the position of the at least one positional element to compensate the irregular pattern.

5. The method of claim 1, further comprising:

[b] compensating for an irregular attribute of the at least one positional element by modulating, positioning, or altering the irregular attribute of the at least one positional element with respect to at least one other camouflage positional element at least partially by employing the position of the at least one positional element to compensate the irregular attribute.

6. The method of claim 1, further comprising:

[b] allowing at least a first one of the at least one positional element to be displaced with respect to at least a second one of the at least one positional element, wherein the at least the first one of the at least one positional element and the at least the second one of the at least one positional element is utilized to position the at least one positional element with respect to the object.

7. The method of claim 1, further comprising:

[b] allowing at least a first one of the at least one positional element to be displaced with respect to at least a second one of the at least one positional element to affect an appearance of directed or guided motion of a conformation, wherein the at least the first one of the at least one positional element and the at least the second one of the at least one positional element is utilized to position the at least one positional element with respect to the object.

8. The method of claim 1, wherein the camouflaging an object by affecting a presentation at least partially using at least one positional element based at least in part on a position of the at least one positional element further comprises:

[a2] obscuring the object.

9. The method of claim 1, wherein the camouflaging an object by affecting a presentation at least partially using at least one positional element based at least in part on a position of the at least one positional element further comprises:

[a2] making the object appear that is not present.

10. The method of claim 1, wherein the camouflaging an object by affecting a presentation at least partially using at least one positional element based at least in part on a position of the at least one positional element further comprises:

[a2] making the object appear in a different state, condition, or position than it actually is.

11. The method of claim 1, wherein the camouflaging an object by affecting a presentation at least partially using at least one positional element based at least in part on a position of the at least one positional element further comprises:

[a2] camouflaging the object by the affecting the presentation at least partially using at least one electromagnetic emitting positional element based at least in part on the position of the at least one positional element.

12. The method of claim 1, wherein the camouflaging an object by affecting a presentation at least partially using at least one positional element based at least in part on a position of the at least one positional element further comprises:

[a2] camouflaging the object by the affecting the presentation at least partially using at least one reflectance-based positional element based at least in part on the position of the at least one positional element.

13. The method of claim 1, wherein the camouflaging an object by affecting a presentation at least partially using at least one positional element based at least in part on a position of the at least one positional element further comprises:

[a2] camouflaging the object by the affecting the presentation at least partially using at least one absorbance-based positional element based at least in part on the position of the at least one positional element.

14. The method of claim 1, wherein the camouflaging an object by affecting a presentation at least partially using at least one positional element based at least in part on a position of the at least one positional element comprises:

[a2] mimicking, imitating, affecting an appearance or state of the object.

15. The method of claim 1, wherein the camouflaging an object by affecting a presentation at least partially using at least one positional element based at least in part on a position of the at least one positional element comprises:

[a2] affecting an optical presentation.

16. The method of claim 1, wherein the at least one positional element includes at least one from a group including at least one positional camouflage element, at least one mote-based camouflage element, at least one LCD-based camouflage element, at least one LED-based camouflage element, at least one reflecting-based camouflage element, at least one absorbing-based camouflage element, or at least one plasma-based camouflage element.

17. The method of claim 1 further comprising:

[b] arranging a plurality of the at least one positional elements in a regular array.

18. The method of claim 1, further comprising:

[b] arranging for a distribution of a plurality of the at least one positional elements in an irregular configuration.

19. The method of claim 1, wherein the at least one positional element includes a plurality of segmented positional elements that can affect a plurality of camouflage presentations at different relative positions.

20. A method comprising:

[a] configuring at least a first camouflage positional element and at least a second camouflage positional element to act as a decoy presentation, an active chaff, a smart chaff, or a combination thereof; and

[b] controllably maintaining a presentation affected at least partially by the at least the first camouflage positional element independent of motion of the at least the first camouflage positional element.

21. The method of claim 20, wherein the configuring at least a first camouflage positional element and at least a second camouflage positional element to act as a decoy presentation, an active chaff, a smart chaff, or a combination thereof further comprises:

[a1] allowing the at least the first camouflage positional element to be displaced with respect to the at least the second camouflage positional element.

22. A method, comprising:

[a] providing at least one positional element configured to deceive, confuse, defeat, or lead one or more sensors towards or away from a target, to act as chaff, one or more flares, fog, one or more decoys, or a combination thereof; and

[b] directing the at least one positional element to communicate with at least one neighbor positional element with a knowledge of a position of the at least one positional element.

23. The method of claim 22, wherein the providing at least one positional element configured to deceive, confuse, defeat, or lead one or more sensors towards or away from a target, to act as chaff, one or more flares, fog, one or more decoys, or a combination thereof further comprises:

[a1] affecting an optical presentation of the at least one positional element.

24. The method of claim 22, wherein the providing at least one positional element configured to deceive, confuse, defeat, or lead one or more sensors towards or away from a target, to act as chaff, one or more flares, fog, one or more decoys, or a combination thereof further comprises:

[a1] affecting an electromagnetic presentation of the at least one positional element.

25. The method of claim 22, wherein the providing at least one positional element configured to deceive, confuse, defeat, or lead one or more sensors towards or away from a target, to act as chaff, one or more flares, fog, one or more decoys, or a combination thereof further comprises:

[a1] affecting a heat-based presentation of the at least one positional element.

26. The method of claim 22, wherein the providing at least one positional element configured to deceive, confuse, defeat, or lead one or more sensors towards or away from a target, to act as chaff, one or more flares, fog, one or more decoys, or a combination thereof further comprises:

[a1] affecting a camouflage presentation of the at least one positional element.

27. The method of claim 22, wherein the providing at least one positional element configured to deceive, confuse, defeat, or lead one or more sensors towards or away from a target, to act as chaff, one or more flares, fog, one or more decoys, or a combination thereof further comprises:

[a1] affecting a electromagnetic reflectance or absorbance of the at least one positional element.

28. The method of claim 22, wherein the one or more sensors that are led towards or away from the target includes an electromagnetic sensor, a computer-based sensor, at least a portion of a human, or at least a portion of an animal.

29. The method of claim 22, further comprising:

[c] addressing the at least one positional element configured to derive an addressed position of the at least one positional element at least partially within the at least one positional element.

30. The method of claim 22, further comprising:

[c] allowing at least a first one of the at least one positional element to be displaced with respect to at least a second one of the at least one positional element, wherein the at least the first one of the at least one positional element and the at least the second one of the at least one positional element could be utilized in the providing the at least one positional element that can be configured to act as the chaff.

31. The method of claim 22, further comprising:

[c] directing the at least one positional element to communicate with at least one neighbor positional element with a knowledge of a position of the at least one positional element.

32. A method comprising:

[a] determining a camouflage for at least one camouflage positional element at least partially considering a background for the at least one camouflage positional element; and

[b] affecting a presentation using the at least one camouflage positional element at least partially based on the camouflage, wherein the determining a camouflage for at least one camouflage positional element at least partially considering a background for the at least one camouflage positional element further including:

[b1] determining the background of the at least one camouflage positional element that an acoustic, vibrational, heat, or biological sensor would sense or a viewer would observe.

33. The method of claim 32, wherein the determining a camouflage for at least one camouflage positional element at least partially considering a background for the at least one camouflage positional element comprises:

[a1] determining an angle that a sensor or viewer would detect the at least one camouflage positional element.

34. The method of claim 32, wherein the affecting a presentation using the at least one camouflage positional element at least partially based on the camouflage comprises:

[b2] controlling a light intensity produced by the at least one camouflage positional element.

35. The method of claim 32, wherein the affecting a presentation using the at least one camouflage positional element at least partially based on the camouflage comprises:

[b2] controlling a color produced by the at least one camouflage positional element.

36. An apparatus comprising:

[a] at least one camouflage positional element configured to camouflage an object at least partially by affecting a presentation based at least in part on a position of the at least one camouflage positional element, wherein the at least one camouflage positional element configured to camouflage an object at least partially by affecting a presentation based at least in part on a position of the at least one camouflage positional element includes:

[a1] the at least one camouflage positional element configured to make the object appear to have different characteristics to a sensor.

37. The apparatus of claim 36, wherein the at least one camouflage positional element configured to camouflage an object at least partially by affecting a presentation based at least in part on a position of the at least one camouflage positional element comprises:

[a2] the at least one camouflage positional element configured to camouflage the object differently at two relative angles depending at least in part on the two relative angles.

38. The apparatus of claim 36, wherein the at least one camouflage positional element configured to camouflage an object at least partially by affecting a presentation based at least in part on a position of the at least one camouflage positional element comprises:

[a2] the at least one camouflage positional element configured to act as a decoy to make the object appear to be positioned in a position where the object is not positioned.

39. An apparatus comprising:

[a] at least one camouflage positional element configured to determine a camouflage at least partially considering its background; and

[b] the at least one camouflage positional element configured to affect a presentation at least partially based on the camouflage, wherein the at least one camouflage positional element configured to determine a camouflage at least partially considering its background includes:

[b1] the at least one camouflage positional element configured to determine the background differently at two relative angles depending at least in part on the two relative angles.

40. A method comprising:

[a] camouflaging an object by affecting a presentation at least partially using at least one positional element based at least in part on a position of the at least one positional element; and

[b] compensating for an irregular intensity of the at least one positional element by modulating, positioning, or altering the irregular intensity of the at least one positional element with respect to at least one other positional element, in which the irregular intensity at least partially results from an arranging for a distribution of a plurality of the at least one positional elements in an irregular pattern.

41. A method comprising:

[a] camouflaging an object by affecting a presentation at least partially using at least one positional element based at least in part on a position of the at least one positional element; and

[b] compensating for an irregular conformation of the at least one positional element by modulating, positioning, or altering the irregular conformation of the at least one positional element with respect to at least one other positional element at least partially by allowing or enabling at least certain ones of the at least one positional element to vary their reflectance to affect an appearance of the at least one positional element.

42. A method comprising:

[a] camouflaging an object by affecting a presentation at least partially using at least one positional element based at least in part on a position of the at least one positional element; and

[b] compensating for an irregular pattern of the at least one positional element by modulating, positioning, or altering the irregular pattern of the at least one positional element with respect to at least one other camouflage positional element at least partially by employing the position of the at least one positional element to compensate the irregular pattern.

43. A method comprising:

[a] camouflaging an object by affecting a presentation at least partially using at least one positional element based at least in part on a position of the at least one positional element; and

[b] compensating for an irregular attribute of the at least one positional element by modulating, positioning, or altering the irregular attribute of the at least one positional element with respect to at least one other camouflage positional element at least partially by employing the position of the at least one positional element to compensate the irregular attribute.

44. A method comprising:

[a] camouflaging an object by affecting a presentation at least partially using at least three positional elements based at least in part on position of the at least three positional elements; and

[b] allowing at least a first one of the at least three positional elements to be displaced with respect to at least a second one of the at least three positional elements, wherein the at least the first one of the at least three positional elements and the at least the second one of the at least three positional elements are utilized to position at least another one of the at least three positional elements with respect to the object.

45. A method comprising:

[a] camouflaging an object by affecting a presentation at least partially using at least three positional elements based at least in part on position of the at least three positional elements; and

[b] allowing at least a first one of the at least three positional elements to be displaced with respect to at least a second one of the at least three positional elements to affect an appearance of directed or guided motion of a conformation, wherein the at least the first one of the at least three positional elements and the at least the second one of the at least three positional elements are utilized to position the at least three positional elements with respect to the object.

46. A method comprising:

[a] determining a camouflage for at least one camouflage positional element at least partially considering a background for the at least one camouflage positional element; and

[b] affecting a presentation using the at least one camouflage positional element at least partially based on the camouflage, wherein the determining a camouflage for at least one camouflage positional element at least partially considering a background for the at least one camouflage positional element further including:

[b1] determining an angle that a sensor or viewer would detect the at least one camouflage positional element.

47. A method comprising:

[a] determining a camouflage for at least one camouflage positional element at least partially considering a background for the at least one camouflage positional element; and

[b] affecting a presentation using the at least one camouflage positional element at least partially based on the camouflage, wherein the affecting a presentation using the at least one camouflage positional element at least partially based on the camouflage further including:

[b1] controlling a light intensity produced by the at least one camouflage positional element.

48. An apparatus comprising:

[a] at least one camouflage positional element configured to camouflage an object at least partially by affecting a presentation based at least in part on a position of the at least one camouflage positional element, wherein the at least one camouflage positional element configured to camouflage an object at least partially by affecting a presentation based at least in part on a position of the at least one camouflage positional element includes:

[a1] the at least one camouflage positional element configured to camouflage the object differently at two relative angles depending at least in part on the two relative angles.

* * * * *

UNITED STATES PATENT AND TRADEMARK OFFICE

CERTIFICATE OF CORRECTION

PATENT NO. : 7,999,720 B2
APPLICATION NO. : 11/352835
DATED : August 16, 2011
INVENTOR(S) : Edward K. Y. Jung et al.

It is certified that error appears in the above-identified patent and that said Letters Patent is hereby corrected as shown below:

Column 56, lines 22-23; Claim 17

"one positional elements" should read --one positional element--

Column 56, line 26; Claim 18

"one positional elements" should read --one positional element--

Column 59, line 2; Claim 40

"one positional elements" should read --one positional element--

Signed and Sealed this
Twenty-fifth Day of October, 2011

David J. Kappos

David J. Kappos
*Director of the United States Patent and Trademark Office*